US005709376A

United States Patent [19]

Ushirogata

[11] Patent Number: 5,709,376

[45] Date of Patent: Jan. 20, 1998

[54] SHEET FINISHER

[75] Inventor: Yoshiaki Ushirogata, Tokyo, Japan

[73] Assignee: Ricoh Company, Ltd., Tokyo, Japan

[21] Appl. No.: 655,865

[22] Filed: May 31, 1996

[30] Foreign Application Priority Data

| | | | |
|---|---|---|---|
| Jan. 30, 1995 | [JP] | Japan | 8-035583 |
| Jun. 1, 1995 | [JP] | Japan | 7-158393 |
| Jun. 13, 1995 | [JP] | Japan | 7-170162 |
| Jun. 13, 1995 | [JP] | Japan | 7-170163 |
| Feb. 29, 1996 | [JP] | Japan | 8-69178 |
| Mar. 4, 1996 | [JP] | Japan | 8-073274 |

[51] Int. Cl.[6] ..... B42C 1/12

[52] U.S. Cl. ..... 270/58.11; 399/410

[58] Field of Search ..... 270/58.11, 58.01, 270/58.08, 58.12; 399/410

[56] References Cited

U.S. PATENT DOCUMENTS

| | | | |
|---|---|---|---|
| 5,037,077 | 8/1991 | Kubita et al. | 270/58.12 |
| 5,388,819 | 2/1995 | Ushirogata et al. | 270/58.11 |
| 5,442,432 | 8/1995 | Tani | 399/410 |
| 5,447,298 | 9/1995 | Watanabe et al. . | |
| 5,580,038 | 12/1996 | Furuya et al. | 270/58.13 |
| 5,590,871 | 1/1997 | Okaba et al. | 399/410 |

FOREIGN PATENT DOCUMENTS

| | | |
|---|---|---|
| 58-36496 | 3/1983 | Japan . |
| 2 219601 | 9/1990 | Japan . |

*Primary Examiner*—John T. Kwon

*Attorney, Agent, or Firm*—Oblon, Spivak, McClelland, Maier & Neustadt, P.C.

[57] ABSTRACT

A sheet finisher for automatically stapling, punching, folding or otherwise finishing a stack of sheets sequentially driven out of an image forming apparatus and positioned is disclosed. The finisher is capable of finishing the sheets at any desired position in an intended direction of sheet transport and in a direction perpendicular thereto. A device for driving the finisher is simple in construction.

7 Claims, 33 Drawing Sheets

SHEET FINISHER

BACKGROUND OF THE INVENTION

The present invention relates to a sheet finisher for automatically stapling, punching, folding or otherwise finishing sheets sequentially driven out of an image forming apparatus and positioned.

A sheet finisher is operatively connected to a copier, printer, facsimile apparatus or similar image forming apparatus to perform the above finishing with sheets sequentially driven out of the apparatus. Japanese Patent Laid-Open Publication No. 58-36496, for example, discloses a sheet finisher capable of stapling and folding a stack of sheet continuously.

The problem with conventional sheet finishers of the type described is that the stapling, punching, folding or similar finishing position cannot be changed in a desired direction, particularly in a direction in which the sheets transferred from the image forming apparatus are transported. Further, because the finisher must be moved in the direction of sheet transport and the direction perpendicular thereto, a complicated drive arrangement is needed. For this reason, a stapler, for example, is implemented as a separated stapler as distinguished from a unitary stapler.

The separate stapler is made up of a stapler unit storing staples, and a clincher unit cooperative with the stapler unit for clinching the staple fed from the stapler unit. The stapler unit and clincher unit are separate from each other. By contrast, the unitary stapler has a stapler unit and a clincher unit inseparably connected to each other.

The separate stapler allows sheets to be passed through between its stapler unit and clincher unit, so that the sheets can be stapled at a desired position in the direction of sheet transport. This makes it needless to move the stapler in the direction of sheet transport perpendicular to the widthwise direction of the sheets and thereby simplifies the drive arrangement. However, the prerequisite with this type of stapler is that the stapler unit and clincher unit facing each other be held in an accurate positional relation during the course of movement in the widthwise direction. This cannot be done without resorting to a complicated drive structure.

Japanese Patent Application No. 7-158393 proposes a sheet finisher having a stapler capable of positioning a stack of sheets and then stapling the stack at one edge in the direction of sheet transport or vertical direction or at substantially the center in the same direction, as desired. In this finisher, the stapler is moved in the widthwise direction of the sheets to staple sheets at their edge or their center at a desired position. However, such a finisher cannot use the unitary stapler because the sheets to be stapled at their center must be passed through between the stapler unit and the clincher unit. This cannot be done with the unitary stapler. This also brings about the problem that the stapler unit and clincher unit facing each other must be held in an accurate positional relation during the course of movement in the widthwise direction, resulting in a complicated and expensive drive arrangement.

It has been customary with the sheet finisher to transport the sheets to a turn-over section for turning them over, convey the sheets to a conveying section contiguous with the turn-over section in the direction of sheet transport, and switch back the sheets toward a stapling section. Usually, a pair of conveyor rollers are disposed between the turn-over section and the conveying section or switchover section in order to transfer the sheets from the former to the latter. The rotation of the conveyor rollers is reversed when the sheets should be driven from the switchback section toward the stapling section.

The above configuration, however, has the following problem. When the preceding sheet brought to the switchback section is driven toward the stapling section, the following sheet cannot be driven into the switchback section unless the trailing edge of the preceding sheet fully moves away from the pair of conveyor rollers. As a result, the distance between the consecutive sheets is increased to increase the period of time necessary for a preselected number of sheets to be fully stacked in the stapling section. This increases the overall stapling time.

A folder which is another specific form of a sheet finisher has two fold rollers. One fold roller has a peripheral face provided with a tapering configuration. The other fold roller is formed with a V-shaped groove complementary to the tapering configuration. The fold rollers are movable in the direction perpendicular to a direction of sheet transport while holding a sheet therebetween. The fold rollers fold sheets one by one when they are passed through a transport path. The folded sheets are positioned by positioning means and then stapled together. This type of folder has a problem that because the sheets are folded one by one and then positioned, it is difficult to neatly position them after the folding operation. Moreover, it is likely that the folds of the sheets are irregular and prevent the sheets from being accurately stapled.

SUMMARY OF THE INVENTION

It is therefore an object of the present invention to provide a sheet finisher capable of changing a stapling, punching, folding or similar finishing position in an intended direction of sheet transport and in a direction perpendicular thereto, as desired.

It is another object of the present invention to provide a sheet finisher which can be driven by a simple drive arrangement.

It is another object of the present invention to provide a sheet finisher capable of driving a separate stapler while maintaining its stapler unit and clincher unit in an accurate positional relation at all times.

It is another object of the present invention to provide a sheet finisher capable of surely stapling a sheet stack at its center or at its edge, as desired.

It is another object of the present invention to provide a sheet finisher capable of selectively stapling a sheet stack, as needed, and reducing the stapling time.

It is another object of the present invention to provide a sheet finisher capable of accurately folding sheets at a preselected position and preventing the folded sheets from being displaced from each other.

In accordance with the present invention, a sheet finisher for finishing at least one sheet introduced into a body thereof and conveyed within the body has a sheet truing device for positioning the sheet at a truing position in an intended direction of sheet transport and a direction perpendicular thereto. A clamp member clamps the sheet positioned by the sheet truing device at the truing position. A finishing device for finishing the sheet at a position different from the truing position. A lamp member driver shifts the sheet away from the truing position until a part of the sheet arrives at the finishing device, and positions the sheet such that the position of the sheet relative to the finishing device is variable in a direction in which the sheet is shifted. A positioning device moves the finishing device in a direction perpendicular to the direction in which the sheet is shifted, and positions the finishing device at a desired position in the direction in which the finishing device is moved.

Also, in accordance with the present invention, a sheet finisher for finishing a plurality of sheets sequentially introduced into a body thereof and conveyed within the body has a sheet truing device for positioning each of the sheet at a truing position in an intended direction of sheet transport and a direction perpendicular thereto. A clamp member clamps the sheets positioned by the sheet truing device at the truing position. A stapler staples the sheets at a position different from the truing position. A clamp member driver shifts the sheets away from the truing position until a part of the sheets arrives at the stapler, and positions the sheets such that the position of the sheets relative to the finishing device is variable in a direction in which the sheet is shifted. A stapler driver moves the stapler in a direction perpendicular to the direction in which the sheets are shifted, and positions the stapler at a desired position in the direction in which the stapler is moved. The stapler is a separate stapler consisting of a stapler unit and a clincher unit between which the sheets to be stapled are passed. The stapler driver has a single drive source, two screw shafts respectively held in threaded engagement with the staple unit and clincher unit, and having spirals identical with or opposite to each other in direction. A transmission mechanism is interposed between the single drive source and the two screw shafts for transmitting the rotation of the drive source to the screw shafts such that the screw shafts rotate in the same direction when the spirals are identical in direction, but rotate in opposite directions when the spirals are opposite in direction.

Further, in accordance with the present invention, a sheet finisher for finishing a plurality of sheets sequentially introduced into a body thereof and conveyed within the body has a sheet truing device for positioning the sheets at a truing position in an intended direction of sheet transport and a direction perpendicular thereto. A clamp member clamps the sheets positioned by the sheet truing device at the truing position. A folder folds the sheets at a position different from the truing position. A clamp member driver shifts the sheets clamped by the clamp member to a folding position. The folder has a block member having a side facing the sheets in the event of folding and formed with a sharply tapering configuration or a V-shaped groove, a fold roller having a peripheral face formed with a V-shaped recess or a sharply tapering configuration complementary to the tapering configuration or the V-shaped groove of the block member, and a fold roller driver for causing the fold roller to run while holding the sheets between the peripheral face of the fold roller and the side of the block member.

Furthermore, in accordance with the present invention, a sheet finisher has a stapling section disposed in the body thereof for stapling a plurality of sheets together. A first sheet turning section turns over, when sheets each carrying an image thereon are sequentially introduced into the body via an inlet, the sheets in a direction substantially parallel to a direction in which the stapling section extends, and conveys the sheets. A second sheet turning section sequentially conveys, when each of the sheets comes out of the first sheet turning section, the sheet toward the stapling section in the opposite direction. A sheet discharging device discharges the sheets stapled by the stapling section to the outside of the body via an outlet. A straight conveying device conveys, when the sheets are not to be stapled, the sheets from the inlet directly to the outlet, bypassing the first sheet turning section. A first and a second conveyor rollers are interposed between the first sheet turning device and second sheet turning device, and conveys the sheet from the first sheet turning section to the second sheet turning section in cooperation. A third conveyor roller contacts one of the first and second rollers adjoining the stapling section, and is rotatable in a direction for conveying the sheet from the second sheet turning section toward the stapling section.

Moreover, in accordance with the present invention, a sheet finisher for finishing a plurality of sheets sequentially introduced into a body thereof and conveyed within the body has a sheet truing device for positioning the sheets at a truing position in a longitudinal direction in which the sheets are transported and a lateral direction perpendicular to the longitudinal direction. A separate stapler is located laterally outside of the sheets sequentially brought to the truing position, and unmovably supported by the body. The separate stapler staples the sheets positioned by the sheet truing device at substantially the center of the sheets in the longitudinal direction. A lateral sheet shifting device shifts the sheets positioned by the sheet truing device laterally to a center stapling position where the separate stapler staples the sheets. A unitary stapler staples the sheets positioned by the sheet truing device at one edge of the sheets in the longitudinal direction. A unitary stapler driver moves the unitary stapler laterally relative to the sheets, and positions the unitary stapler at a desired position.

In addition, in accordance with the present invention, a sheet finisher for finishing a plurality of sheets sequentially introduced into a body thereof and conveyed within the body has a sheet truing device for positioning the sheets at a truing position in a longitudinal direction in which the sheets are transported and a lateral direction perpendicular to the longitudinal direction. A separate stapler has a stapler body and a clincher separate from and facing each other. The portion of the stapler body and the portion of the clincher for stapling the sheets hold the sheets brought to the truing position therebetween for stapling the sheets at substantially the center of the sheets in the longitudinal direction. A unitary stapler has a stapler body and a clincher operatively connected to each other, and for stapling the sheets positioned by the sheet truing device at one edge of the sheets in the longitudinal direction. A unitary stapler driver moves the unitary stapler in the lateral direction relative to the sheets, and positions the unitary stapler at a desired position.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
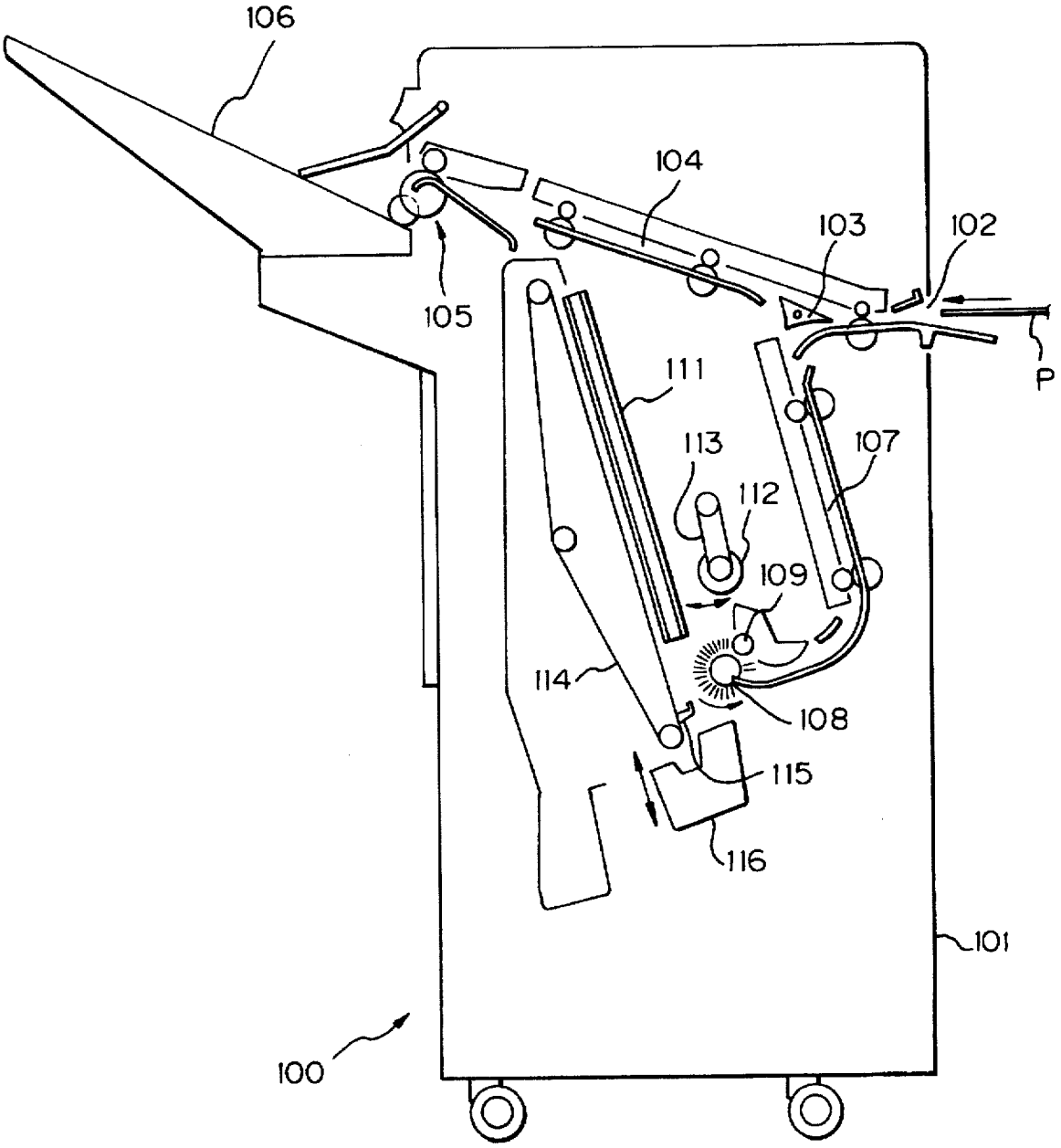
Fig. 1 PRIOR ART
FIG. 1 is a sectional side elevation showing a conventional sheet finisher.

Referring to FIG. 1 of the drawings, a conventional sheet finisher is shown and capable of automatically stapling, punching, folding or otherwise finishing sheets driven out of a copier, printer, facsimile apparatus or similar image forming apparatus. As shown, the finisher, generally 100, has a body 101 connected to the image forming apparatus, not shown.

Figure 2:
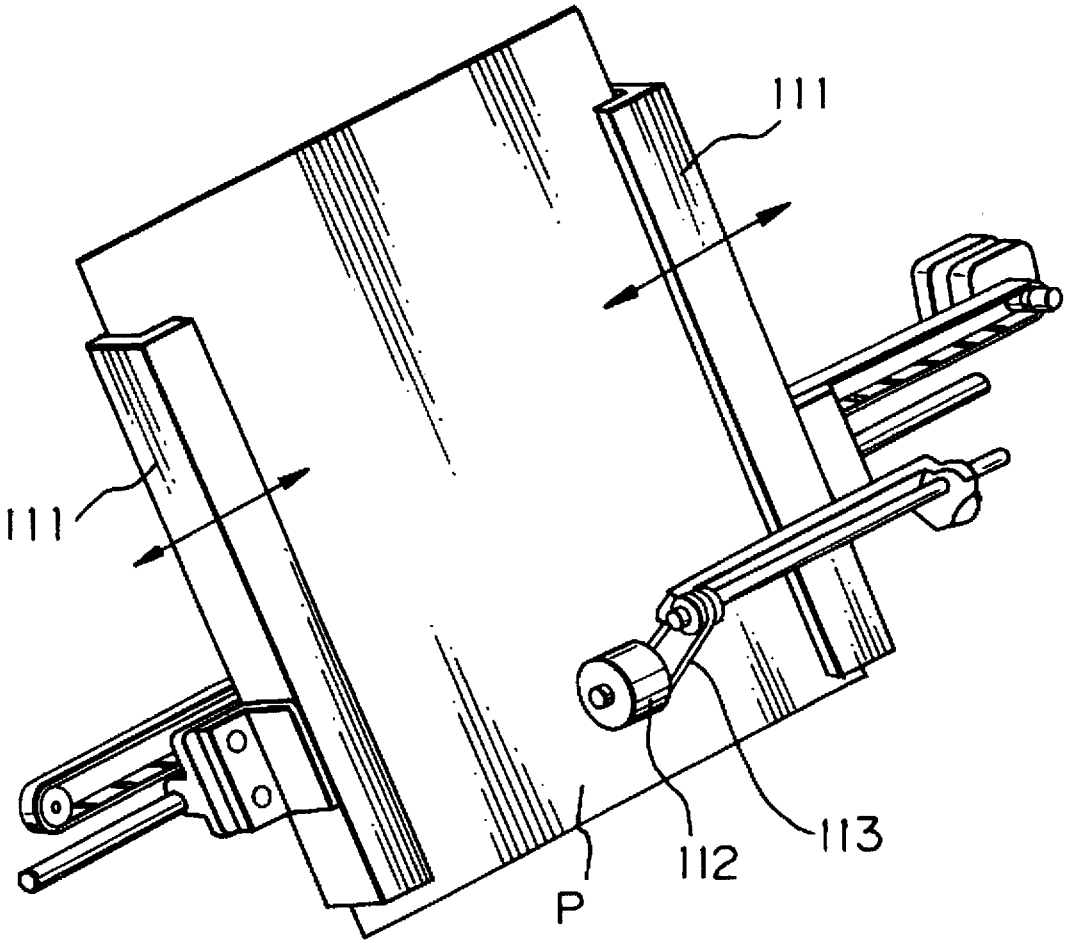
Fig. 2 PRIOR ART
FIG. 2 is a perspective view showing a jogger fence drive mechanism included in the conventional sheet finisher.

A sheet P driven out of the apparatus is introduced into the finisher body 101 via the inlet 102 formed in the body 101. When the sheet P does not need finishing, it is guided by a switchable guide or path selector 103 to a transport path 104. Then, the sheet P is driven out of the finisher body 101 to a tray 106 by a discharge roller pair 105. On the other hand, when the sheet P needs finishing, the path selector 103 is switched to steer the sheet P to another transport path 107. When the sheet P reaches a feed roller or brush roller 108 and a roller 109 by way of the path 107, the rollers 108 and 109 cooperate to convey it toward an endless belt 114. As shown in FIG. 2 in detail, a pair of jogger fences 111 position or true the sheet P reached the belt 114 in the direction perpendicular to the direction of sheet transport (widthwise direction of the sheet P). Specifically, every time a single sheet P is driven out by the rollers 108 and 109, the jogger fences 111 are moved away from each other and then toward each other so as to position the sheet P.

As shown in FIGS. 1 and 2, an arm 113 has a pusher roller 112 at its free end and pivotally moved periodically. When the arm 113 is moved toward the belt 114, the pusher roller 112 pushes the sheet P being driven toward the belt 114, thereby moving it toward the belt 114.

As shown in FIG. 1, a plurality of pawls 115 are arranged on the belt 114 at equally spaced locations in the widthwise direction of the belt 114. Assume that the upstream edge and downstream edge of the sheet P with respect to the direction of transport are the leading edge and trailing edge, respectively. Then, the sheet P driven out toward the belt 114 drops due to its own weight and the operation of the roller 108 until its trailing edge rests on the pawls 115. Thereafter, the jogger fences 111 position the sheet P in the widthwise direction while the pawls 115 position it in the direction of sheet transport.

A stapler 116, for example, is disposed below the belt 114, as viewed in FIG. 1. The stapler 116 staples a plurality of sheets sequentially positioned by the above procedure. Specifically, the stapler 116 is movable back and forth in the direction indicated by a double-headed arrow in FIG. 1. When the stapler 116 is moved toward the pawls 115, it staples the trailing edges of the sheets with a staple or staples, not shown. Subsequently, the belt 114 is driven counterclockwise, as viewed in FIG. 1, with the result that the stapled sheets are discharged from the belt 114. Then, a discharge roller pair 105 conveys the sheets to a tray 106.

Further, the stapler 116 is movable in the widthwise direction of the belt 114 (perpendicular to the direction of sheet transport) by being driven by drive means, not shown. The stapler 116 is therefore capable of selectively stapling a sheet stack P' at a position shown in FIG. 3A with a staple 117, at a position shown in FIG. 3B with staples 117, or at a position shown in FIG. 3C with a staple 117, as desired.

Figure 3A:
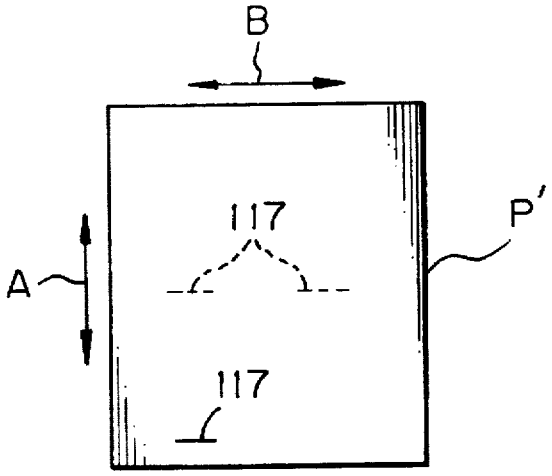
FIGS. 3A—3C each shows a particular position for stapling a sheet stack.

However, conventional finishers including the above-described one have a problem that the position of the sheet stack which can be stapled is limited to the edge and cannot be changed in the direction of sheet transport, i.e., a direction A shown in FIG. 3A. This is also true with a puncher or a folder which is another specific form of the sheet finisher. Another problem is that because the finisher must be moved not only in the widthwise direction of the sheet (arrow B in FIG. 3A) but also in the direction of sheet transport, requiring a complicated drive arrangement.

In light of the above, the unitary stapler 116 shown in FIG. 1 may be replaced with a separate stapler made up of a stapler unit and a clincher unit. In a separate stapler, after a plurality of sheets have been brought to between a stapler unit and a clincher unit, they can be stapled at any desired position or positions in the direction of sheet transport. This makes it needless for the stapler to be moved in the direction of sheet transport; that is, the stapler should only be moved in the widthwise direction of the sheets. As a result, the mechanism for driving the stapler is simplified. However, the stapler unit and clincher unit must be moved in the widthwise direction of the sheets while accurately facing each other, again requiring a complicated drive arrangement.

Preferred embodiments of the sheet finisher in accordance with the present invention will be described hereinafter.

1st Embodiment

Figure 4:
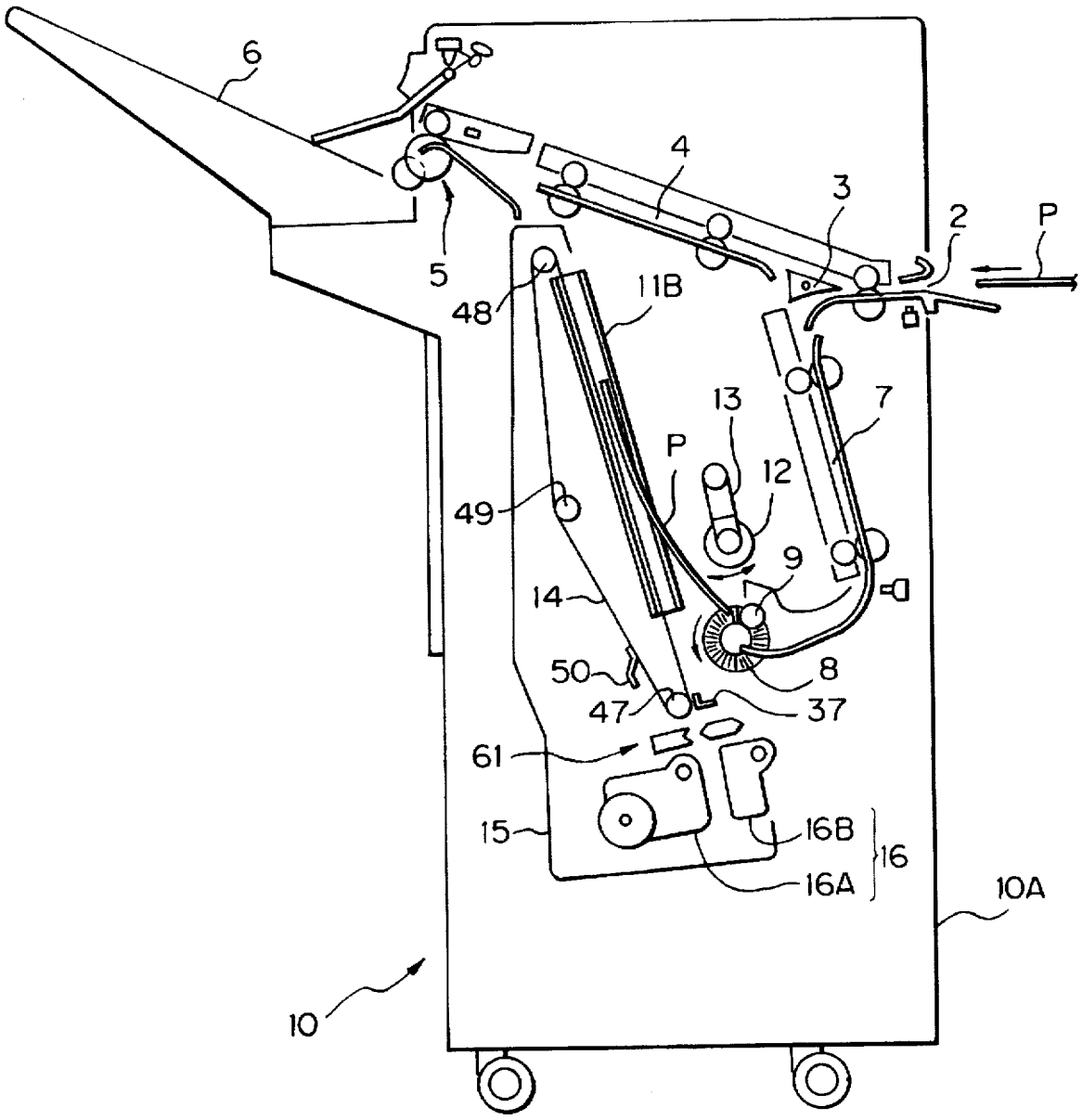
FIG. 4 is a sectional side elevation showing a first embodiment of the sheet finisher in accordance with the present invention.

FIG. 4 shows the general construction of a sheet finisher embodying the present invention. As shown, the finisher, generally 10, has a body 10A formed with a sheet inlet 2 and connected to an image forming apparatus, not shown.

A sheet P driven out of the apparatus is introduced into the finisher body 10A via the inlet 2 formed in the body 101. When the sheet P does not need finishing, it is guided by a switchable guide or path selector 3 to a transport path 4. Then, the sheet P is driven out of the finisher body 10A to a tray 6 by a discharge roller pair 5. On the other hand, when the sheet P needs finishing, the path selector 3 is switched to steer the sheet P to another transport path 7. When the sheet P reaches a feed roller or brush roller 8 and a roller 9 by way of the pub 7, the rollers 8 and 9 cooperate to convey it toward an endless belt 14 included in a jogger unit 15. A pair of jogger fences 11A and 11B (FIG. 5) position the sheet P in the widthwise direction of the sheet P perpendicular to the direction of sheet transport, as will be described in detail later.

An arm 13 has a pusher roller 12 at its free end and pivotally moved periodically by a driving device, not shown. On the movement of the arm 13, the pusher roller 12 pushes the sheet P driven toward the belt 14 by the rollers 8 and 9, thereby moving it toward the belt 14.

The sheet P is positioned also in the direction of sheet transport (up-and-down direction as viewed in FIG. 4), as will be described later. A plurality of sheets so positioned or trued are clamped by a clamp member and then conveyed together to a position where a separate stapler 16 is located. The sheets are stapled by the stapler 16, then folded by a folder 61 which will be described, and then lifted while being continuously clamped. At the same time, the belt 14 is rotated counterclockwise, as viewed in FIG. 4. As a result, the sheet stack is driven out to the tray 6 by the discharge roller pair 5 while being raised by a stop pawl 50 provided on the belt 14.

Figure 5:
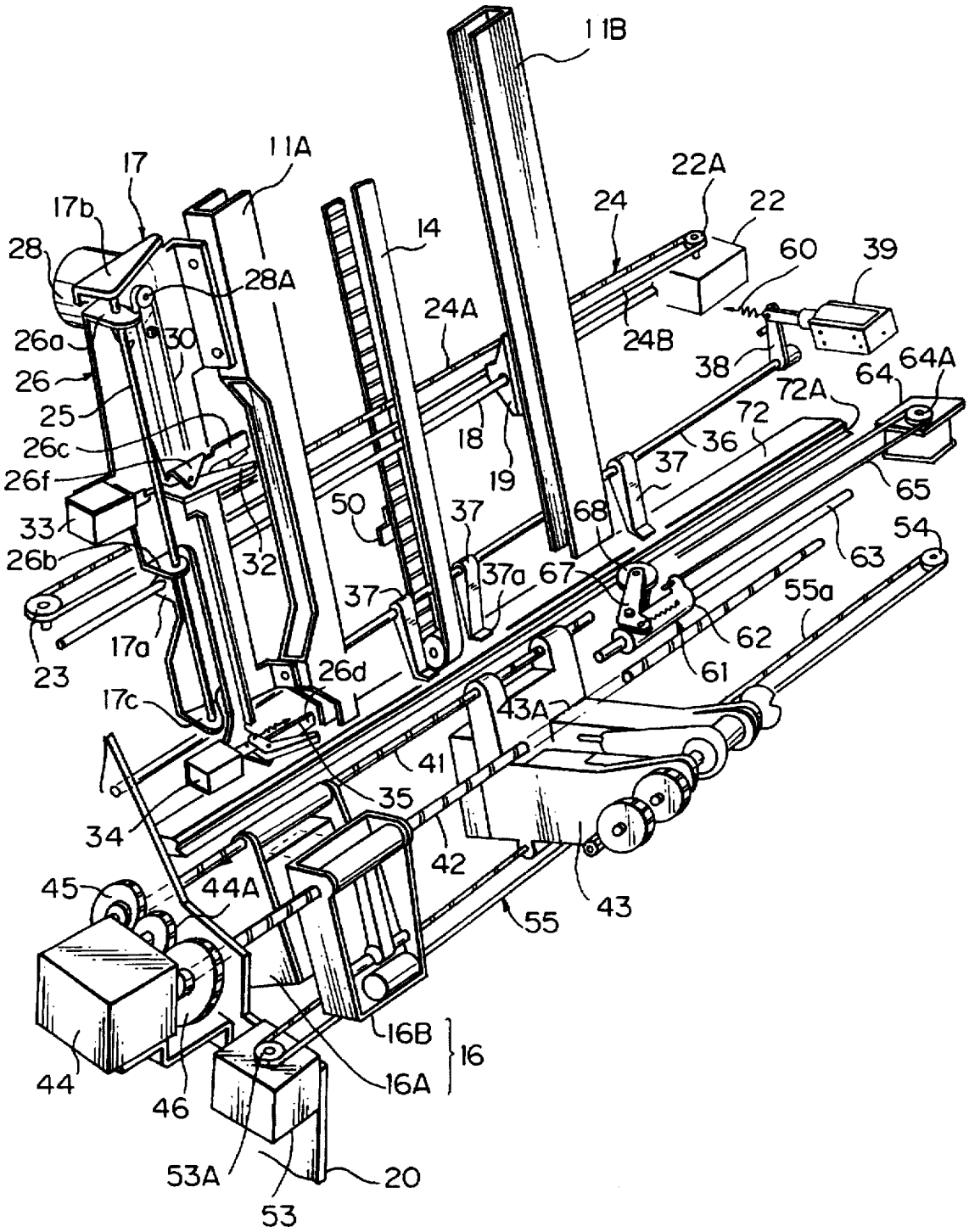
FIG. 5 is a perspective view of a sheet finishing mechanism included in the first embodiment.

Referring to FIG. 5, a clamp holder 17 is affixed to the jogger fence 11A cooperative with the jogger fence 11B. The clamp holder 17 is slidably mounted on a guide shaft 18 at its boss portion 17*a*. A bracket 19 is affixed to the jogger fence 11B and also slidably mounted on the guide shaft 18. The guide shaft 18 has its opposite ends affixed to one side wall 20 and the other side wall, not shown, included in the finisher body 10A.

Figure 6:
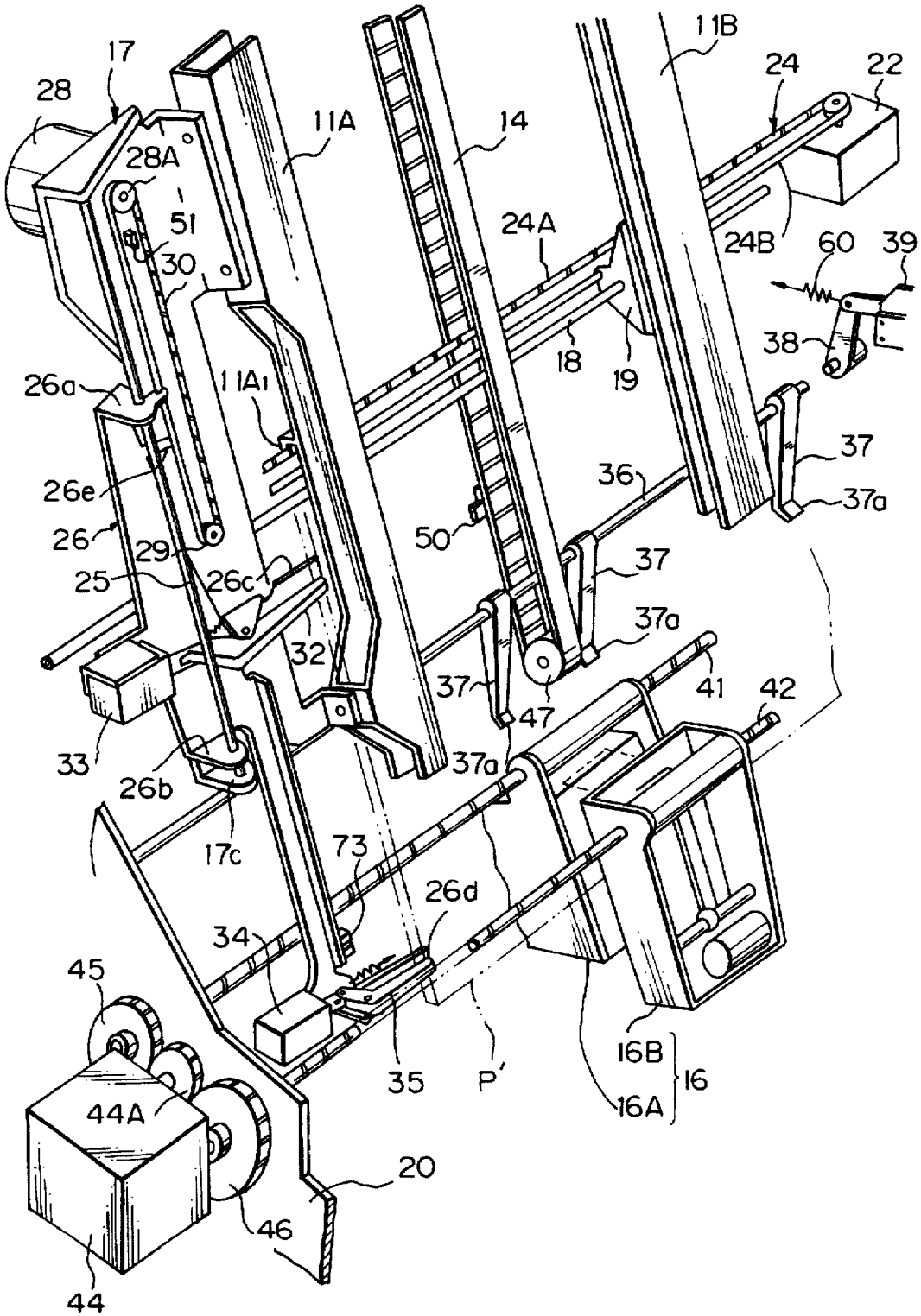
FIG. 6 shows an elevatable bracket included in the mechanism of FIG. 5 and lowered in order to position a sheet stack at a finishing position.

A motor 22 is implemented as, e.g., a stepping motor and has a motor pulley 22A. A timing belt 24 is passed over the motor pulley 22A and a pulley 23 mounted on the side wall 20 of the finisher body 10A. As shown in FIG. 6, the jogger fence 11A has an extension $11A_1$ at its intermediate portion. The extension $11A_1$ is anchored to one 24A of opposite runs of the timing belt 24. The bracket 19 of the other jogger fence 11B is anchored to the other run 24B of the timing belt 24.

As shown in FIG. 5, the clamp holder 17 has an upper bent portion 17*b* and a lower bent portion 17*c*. A guide shaft 25 has its opposite ends affixed to the bent portions 17*b* and 17*c* and extends parallel to the jogger fence 11A. An elevatable bracket 26 has bent portions 26*a* and 26*b* at its upper end and intermediate portion, respectively. The bent portions 26*a* and 26*b* are slidably mounted on the guide shaft 25.

A stepping motor or similar motor 28 is affixed to the clamp holder 17 and has a motor pulley 28A. An endless timing belt 30 is passed over the motor pulley 28A and a pulley 29 (FIG. 6) rotatably supported by the clamp holder 17. The upper bent portion 26*a* of the bracket 26 is anchored to the belt 30. A clamp piece 26*c* extends out from the bracket 26 toward the jogger fence 11A. A clamp member 32 is connected at one end to the plunger of a solenoid 33 and pivotally connected at the other end to a bent portion 26*f* included in the clamp piece 26*c*.

Another clamp piece 26*d* extends out from the lower end of the bracket 26. Another clamp member 35 is connected at one end to the plunger of a solenoid 34 and pivotally connected to the clamp piece 26*d* at the other end. A shaft 36 is journalled to the side wall 20 and the other side wall, not shown. A plurality of stop members 37 are affixed to the shaft 36 at one end thereof. An arm 38 is affixed to the end of the shaft 36 remote from the side wall 20. A solenoid 39 has a plunger connected to the arm 38.

Two parallel screw shafts 41 and 42 are journalled to the side wall 20 and the other side wall at opposite ends thereof. The separate stapler 16 has a stapler unit 16A and a clincher unit 16B held in threaded engagement with the screw shafts 41 and 42, respectively. Specifically, the units 16A and 16B each has a respective nut, not shown, held in threaded engagement with the screw shaft 41 or 42. The stapler unit 16A stores staples, not shown. The stapler unit 16A and clincher unit 16B may each be provided with a conventional arrangement.

A stepping motor or similar motor 44 is mounted on the side wall 20 and has a motor gear 44A. Gears 45 and 46 are held in mesh with the motor gear 44A at both sides of the gear 44A. The gears 45 and 46 are respectively affixed to the ends of the screw shafts 41 and 42 protruding from the side wall 20.

The belt 14 shown in FIG. 4 is passed over pulleys 47, 48 and 49 and driven by preselected one of them. As shown in FIG. 5, the stop pawl 50 is affixed to a part of the outer surface of the belt 14.

The operation of the finisher 10 will be described hereinafter. Assume that in FIG. 4 the upstream edge and downstream edge of the sheet P in the direction of sheet transport are the leading edge and trailing edge, respectively. After the sheet P has been driven out toward the belt 14 by the rollers 8 and 9, it drops due to its own weight and the roller 8 rotating counterclockwise until its trailing edge rests on pawls 37*a* included in the stop members 37. As a result, the sheet P is positioned or trued in the direction of sheet transport.

Figure 7A:
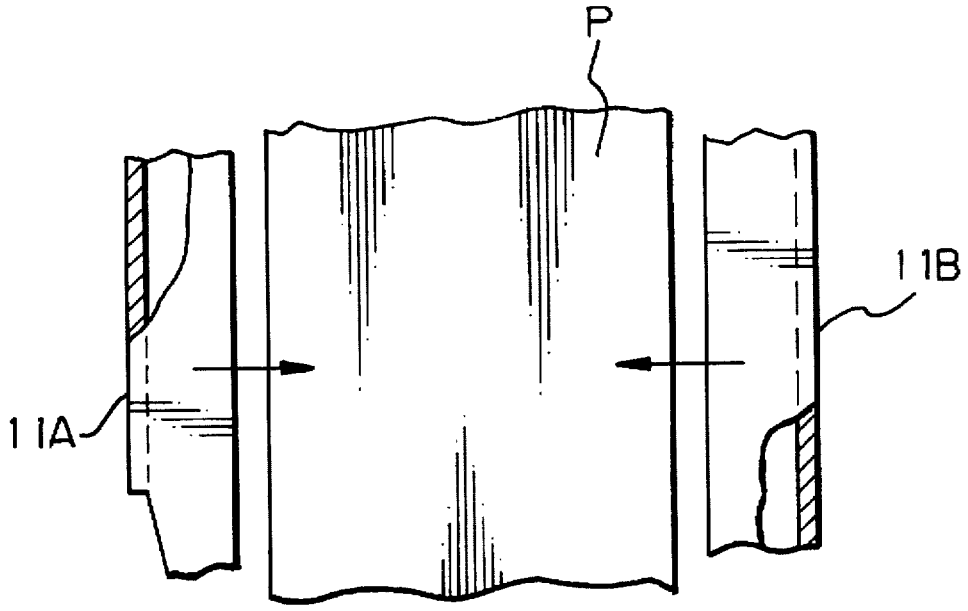
FIGS. 7A and 7B demonstrate the operation of jogger fences for positioning a sheet in a truing position.
Figure 7B:
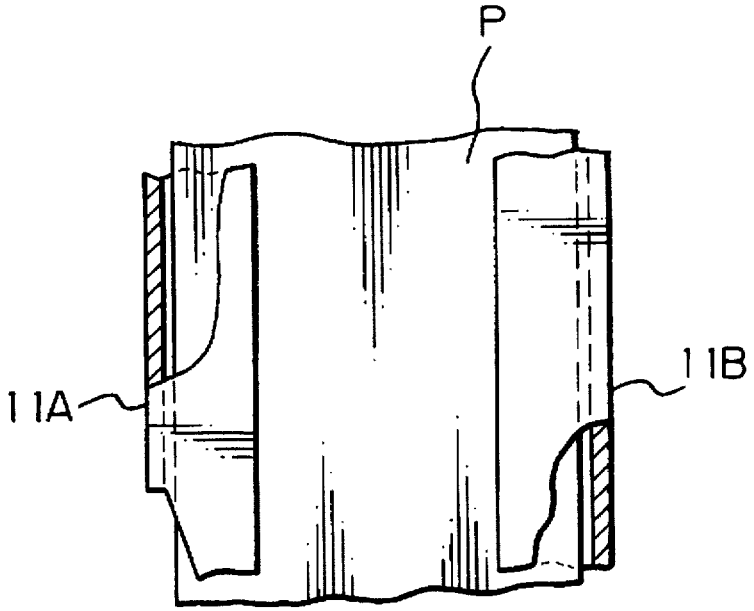

While the sheet P is moved toward the belt 14 away from the rollers 8 and 9, the jogger fences 11A and 11B are spaced from each other by a distance greater than the width of the sheet P, as shown in FIG. 7A. As soon as the sheet P drops onto the stop members 37 between the jogger fences 11A and 11B, the motor 22 is energized to rotate the timing belt 24. As a result, the jogger fences 11A and 11B are moved toward each other to positions shown in FIG. 7B, as indicated by arrows in FIG. 7A. In the positions shown in FIG. 7B, the jogger fences 11A and 11B position the sheet P in the direction perpendicular to the direction of sheet transport (widthwise direction). In this manner, the sheet P is positioned by the stop members 37 in the direction of sheet transport and positioned by the jogger fences 11A and 11B in the widthwise direction.

The motor 22 is reversible such that the jogger fences 11A and 11B move toward and away from each other periodically, so that the sheets are positioned one by one in the widthwise direction.

As stated above, in the illustrative embodiment, the jogger fences 11A and 11B, device for driving them (motor 22 and timing belt 24) and stop members 37 constitute sheet truing means in combination. The sheet truing means positions the sheet in the direction of sheet transport and the direction perpendicular thereto (widthwise direction). Let the positioning in the direction of sheet transport and the positioning in the widthwise direction be referred to longitudinal positioning and lateral positioning, respectively. Then, all the sheets are subjected to longitudinal positioning and lateral positioning by the above truing means before they are stapled, folded or otherwise finished.

Assume that the sheet stack should be bound be a staple. Then, when the number of sheets positioned in the above condition coincides with a preselected number, the jogger fences 11A and 11B are held in their positions shown in FIG. 7B. At the same time, the image forming apparatus connected to the finisher 10 sends a solenoid ON signals to each of the solenoids 33 and 34. Let the preselected number of sheets be referred to as a sheet stack and labeled P' hereinafter.

Figure 8:
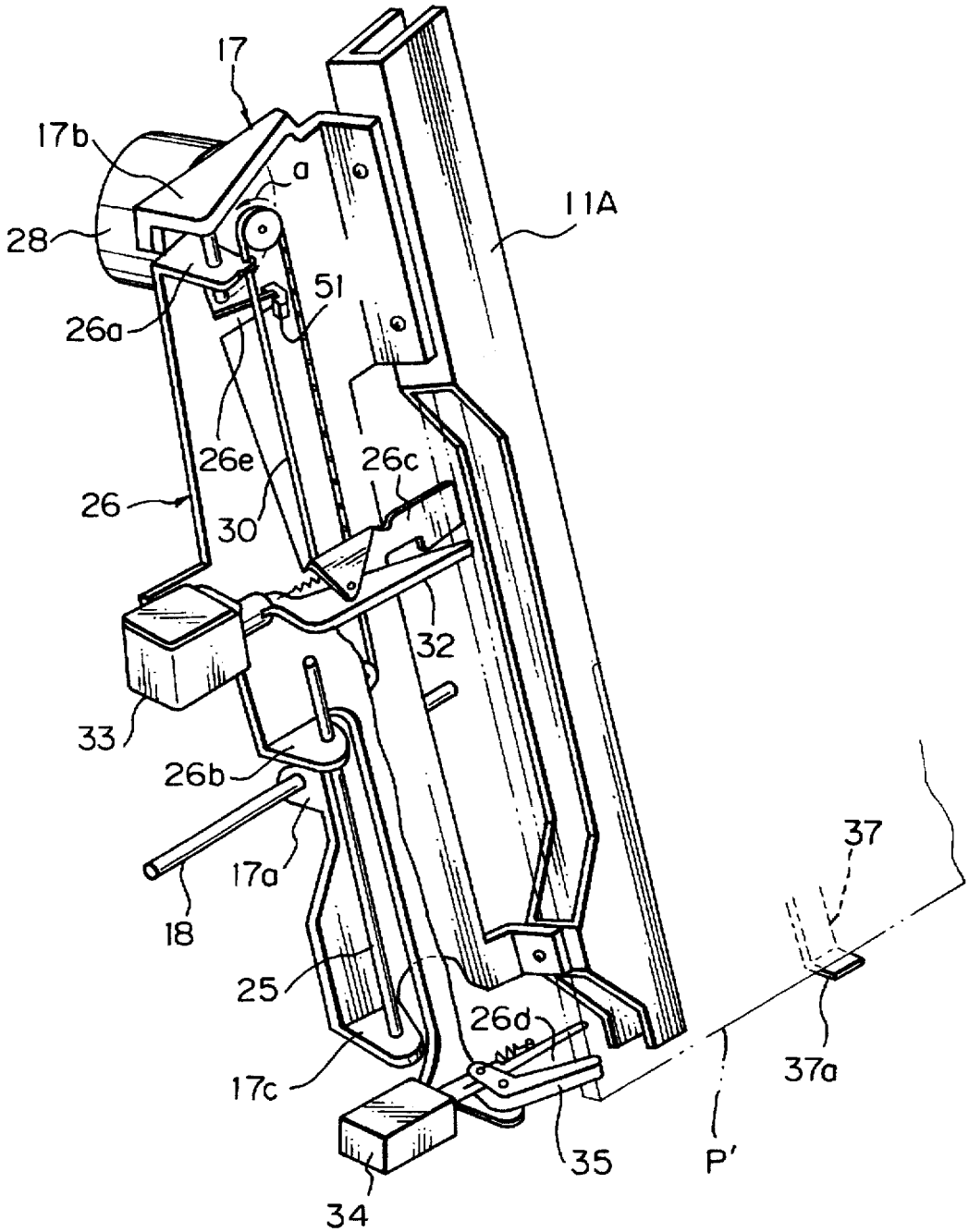
FIG. 8 is a perspective view showing a bracket drive mechanism included in the mechanism of FIG. 5.

The solenoids 33 and 34 shown in FIG. 8 are energized by the solenoid ON signals at the same time. The solenoids 33 and 34 cause their associated clamp members 32 and 35 to pivot toward the clamp pieces 26*c* and 26*d* in the horizontal direction. As a result, the clamp pieces 26*c* and 26*d* clamp the sheet stack P' at an upper and a lower position.

Another solenoid ON signal is sent from the image forming apparatus to the solenoid 39 shown in FIG. 5. In response, the solenoid 39 moves the arm 38 toward it with the result that the shaft 36 is rotated to cause the stop members 37 to retract from the position shown in FIG. 5 to the position shown in FIG. 6. In the position of FIG. 6, the pawls 37*a* of the stop members 37 are released from the trailing edge of the sheet stack P', opening a path extending toward the the sheet stack P'.

After the movement of the stop members 37 to their retracted position, the motor 28 shown in FIG. 8 starts rotating in a direction indicated by an arrow a. The motor 28 causes the elevatable bracket 26 having its bent portion 26*a* anchored to the timing belt 30 to move downward along the guide shaft 25. The bracket 26 in turn lowers the sheet stack P' clamped by the clamp members 32 and 35 from the position shown in FIG. 8 to the position shown in FIG. 6, i.e., until the lower edge of the sheet stack P' reaches the separate stapler 16.

In FIG. 5, the motor 44 mounted on the side wall 20 is a drive source for driving the stapler 16 or similar finishing means. On the rotation of the motor 44, the gears 45 and 46 are rotated in the same direction via the motor gear 44A, causing the screw shafts 41 and 42 to rotate in the same direction.

Figure 9:
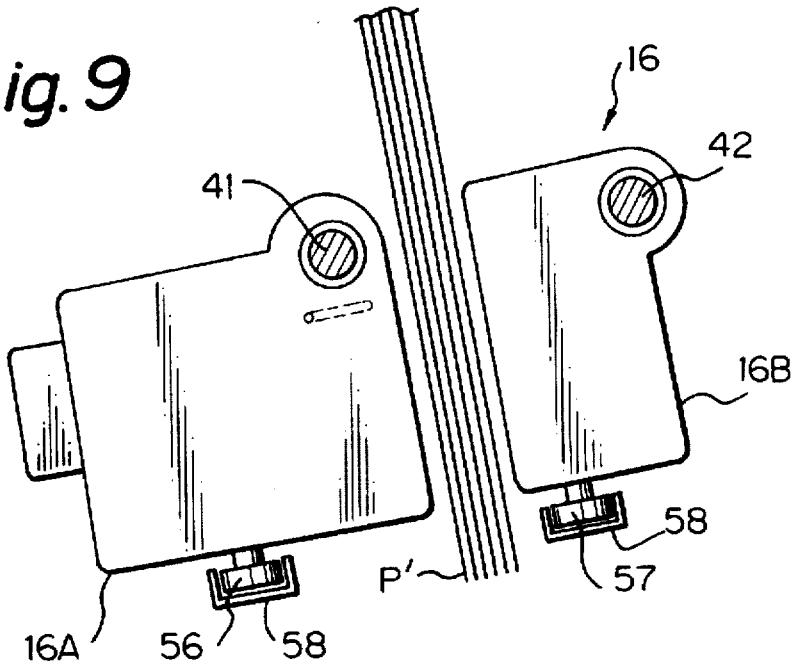
FIG. 9 is a side elevation showing a separate stapler together with a sheet stack.

The screw shafts 41 and 42 have spirals formed in opposite directions to each other. Hence, when the screw shafts 41 and 42 are rotated in the same direction, the stapler unit 16A and clincher unit 16B are moved in the widthwise direction of the sheet stack P' while accurately facing each other. As shown in FIG. 9, rollers 56 and 57 are mounted on the bottoms of the bottom of the stapler unit 16A and that of the clincher unit 16B, respectively. The rollers 56 and 57 are guided by associated guide rails 58 mounted on the finisher body 10A.

Assume that the position of the separate stapler 16 shown in FIG. 5 is the home position. Then, when the bracket 26 is lowered, the stapler 16 will obstruct the bracket 26. In such a case, before the bracket 26 is lowered, the motor 44 starts rotating and moves the stapler 16 away from the home position to a preselected position in the widthwise direction of the sheet stack P', e.g., the position shown in FIG. 6. On the other hand, assume that the home position of the stapler 16 is one which does not obstruct the downward movement of the bracket 26, e.g., the position of FIG. 6 closer to the sheet stack P' than the clamp member 35, or one opposite to the above position. Then, the stapler 16 may be moved after the downward movement of the bracket 26.

Figure 3B:
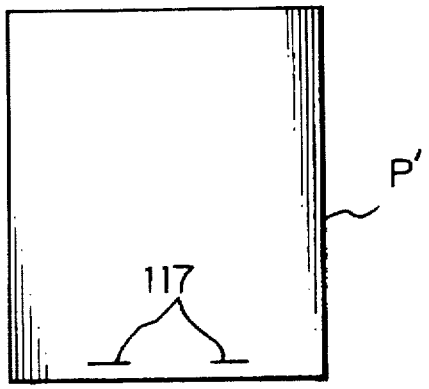
Figure 3C:
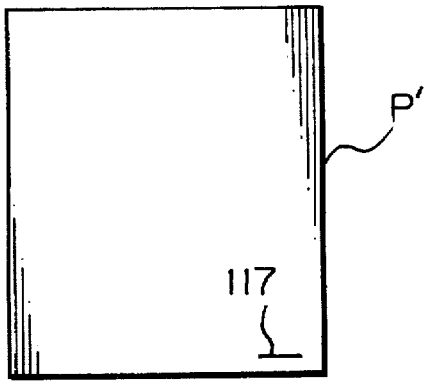

While the sheet stack P' is held in the position shown in FIG. 6, the stapler 16 staples, e.g., the lower end portion of the stack P', as shown in FIG. 3A. If the stapler 16 is moved along the screws 41 and 42 in the widthwise direction of the stack P' and caused to operate twice, then it will staple the stack P', as shown in FIG. 3B. Further, the stapler 16 may staple the stack P' at the position shown in FIG. 3C.

Moreover, the bracket 26 may be further lowered from the position shown in FIG. 6 in the event of stapling. Specifically, in FIG. 3A, dashed lines are representative of staples 117 driven into the sheet stack P' at substantially one half of the lengthwise dimension of the stack P'. When the sheet stack P' is to be folded at the intermediate between its leading edge and trailing edge and then stapled there, the stack P' is lowered beyond the position shown in FIG. 6. In this manner, the sheet stack P' can be stapled at any desired position in the direction of sheet transport.

In practice, the lower bent portion 17*c* of the clamp holder 7 is positioned below the position shown in FIGS. 5, 6 and 8. This allows the bracket 26 to move to below the position of FIG. 6 without being obstructed by the bent portion 17*c*. In FIGS. 5, 6 and 8, the bent portion 17*c* is shown at a position higher than its actual position for the sake of better understanding.

As shown in FIG. 8, the bracket 26 has an actuator lug 26*e* while the clamp holder 17 has a sensor 51 thereon. When the bracket 26 is brought to its uppermost position or home position, the actuator lug 26*e* causes the sensor 51 to turn off.

When the bracket 26 is lowered until the actuator lug 26*e* moves away from the sensor 51, the sensor 51 turns on. Assume that the interval between the turn-on of the sensor 51 and the arrival of the sheet stack P' at the position shown in FIG. 6 is t. Then, if the motor 28 is rotated for the period of time t since the turn-on of the sensor 51, the sheet stack P' can be brought to the stapling position shown in FIG. 6. For example, when the motor 28 is implemented by a stepping motor, a number of pulses corresponding to the period of time t should only be applied to the motor 28. The number of pulses may be changed in order to stop the sheet stack P' at any desired position in the direction of sheet transport (direction A in FIG. 3A). The sheet stack P' can therefore be stapled at any desired position in the direction of sheet transport, e.g., any one of the positions of FIGS. 3A–3C including the phantom line position.

After the stapler 16 has stapled the sheet stack P', the motor 44 is rotated in the opposite direction at a suitable time. As a result, the stapler 16 is returned to the previously mentioned home position and awaits the next stapling operation.

As shown in FIG. 5, a puncher 43 is slidably mounted on the screw shaft 41 at its upper end. The puncher 43 is different from the stapler unit 16*a* and clincher unit 16B in that it is not held in threaded engagement with the screw shaft 41, but simply slidably supported thereby. A motor 53 assigned to the puncher 43 is mounted on the side wall 20 and has a motor pulley 53A. An endless timing belt 55 is passed over the motor pulley 53A and a pulley 54 located at a preselected position in the finisher body 10A. The puncher 43 is anchored to one run 55*a* of the timing belt 55.

When the belt 55 is rotated by the motor 53, the puncher 43 anchored to the run 55*a* of the belt 55 is moved in the widthwise direction of the sheet stack P' along the screw shaft 41.

Figure 10A:
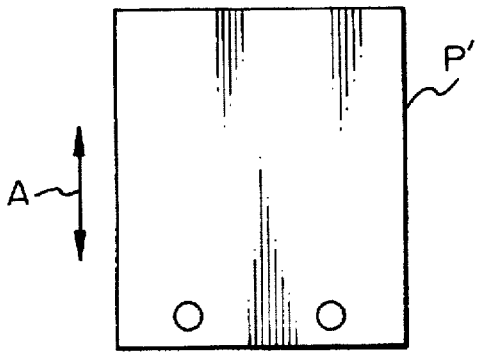
FIGS. 10A and 10B each shows a particular punching position.

The puncher 43 is brought to a stop at any desired position on the basis of a preselected program. Then, the sheet stack P' lowered together with the bracket 26 and clamped by the clamp members 32 and 35, as stated earlier, is inserted into a groove 43A formed in the puncher 43. In this condition, the puncher 43 is operated in the conventional manner in order to punch the sheet stack P', as shown in FIG. 10A specifically. When the sheet stack P' should be punched at two positions, as shown in FIG. 10A, the puncher 43 will be operated twice while being moved along the screw shaft 41. The punching position can be changed in the direction of sheet transport (arrow A) because the bracket 26 with the clamping means is movable in the direction A. In any case, the sheet stack P' can be filed in various ways.

Figure 10B:
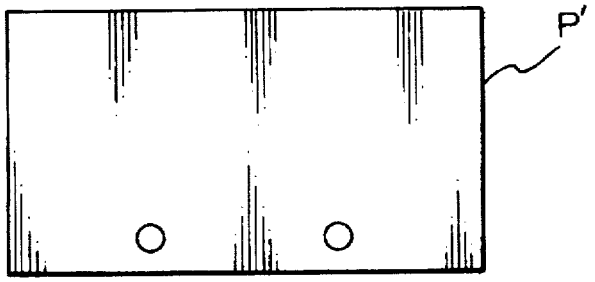
Figure 11A:
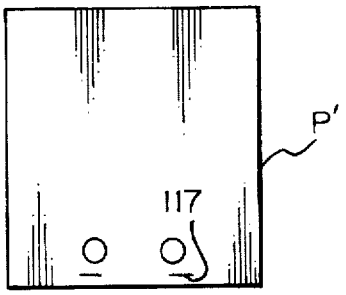
FIGS. 11A and 11B each shows particular stapling and punching positions.
Figure 11B:
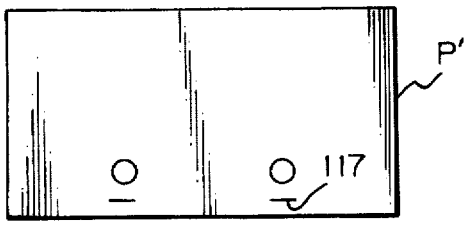

The puncher 43 may punch the sheet stack P' at positions shown in FIG. 10B, if desired. It is to be noted that a single sheet may be punched by the puncher 43 in place of the sheet stack P'. As shown in FIGS. 11A and 11B, the sheet stack P' may be stapled and punched at the same time.

Each of the separate stapler 16, puncher 43 and folder which will be described is a specific form of sheet finishing means for finishing a sheet or sheets at a position different from a position for positioning or truing them. The motor 28, timing belt 30 and elevatable bracket 26 constitute a specific form of clamp member drive means for bringing a part of the sheets clamped by the clamp members 32 and 35 from the position of FIG. 8 to the position of the sheet finishing means, and for allowing the position of the sheets relative to the finishing means to be changed in the direction of sheet transport (arrow A, FIG. 3A).

The motor 44, gears 44A, 45 and 45, screw shafts 41 and 42, motor 53 and timing belt 55 constitute a specific form of means for driving the individual sheet finishing means, i.e., the stapler 16 or the puncher 43 in the direction (arrow B, FIG. 3A) perpendicular to the direction of sheet transport, and for positioning it at any desired position in the direction of movement.

After the above stapling, punching or similar finishing operation, the motor 28 (FIG. 6) is driven in the opposite direction in order to raise the bracket 26. At this instant, the stapler 16, puncher 43 and folder which will be described have been retracted to their positions not obstructing the elevation of the bracket 26. When the actuator lug 26*e* reaches the sensor 51 and causes it to turn off, the motor 28 is deenergized. In this manner, the bracket 26 is returned to its home position shown in FIGS. 5 and 8, while lifting the sheet stack P' clamped by the clamp members 32 and 35.

As soon as the sheet stack P' being lifted by the bracket 26 moves away from the pawls 37*a* of the stop members 37, the solenoid 39 is deenergized. Consequently, the arm 38 is rotated away from the solenoid 39 by the action of a spring 60 (FIG. 6). The arm 38 in turn rotates the shaft 36 and thereby causes the stop members 37 to again protruded to the sheet transport path shown in FIG. 5.

Subsequently, the solenoids 33 and 34 are deenergized in order to unclamp the sheet stack P'. As a result, the sheet stack P' slightly drops due to its own weight until it rests on the stop members 37. At the same time, the belt 14 starts rotating while causing its stop pawl 50 to raise the trailing edge of the sheet stack P'. Consequently, the sheet stack P' has its leading edge nipped by the discharge roller pair 5 (FIG. 4). The roller pair 5 discharges the sheet stack P' onto the tray 6. The procedure described above will be repeated when a plurality of sets of sheets should be bound and/or punched.

As shown in FIG. 5, a folder 61 has a slide block 62 slidably mounted on a guide shaft 63 extending between the side wall 20 and the other side wall. A stepping motor or similar motor 64 is mounted on the finisher body 10A and has a motor pulley 64A. A timing belt 65 is passed over the motor pulley 64A and a pulley, not shown. The slide block 62 is anchored to the belt 65.

Figure 12:
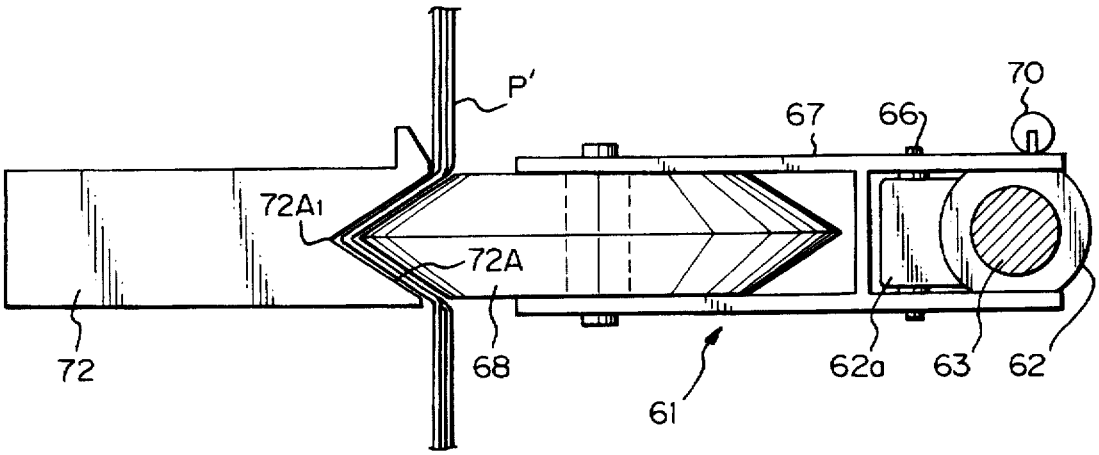
FIG. 12 is a side elevation showing a folder together with a block member and a sheet stack to be folded.
Figure 13:
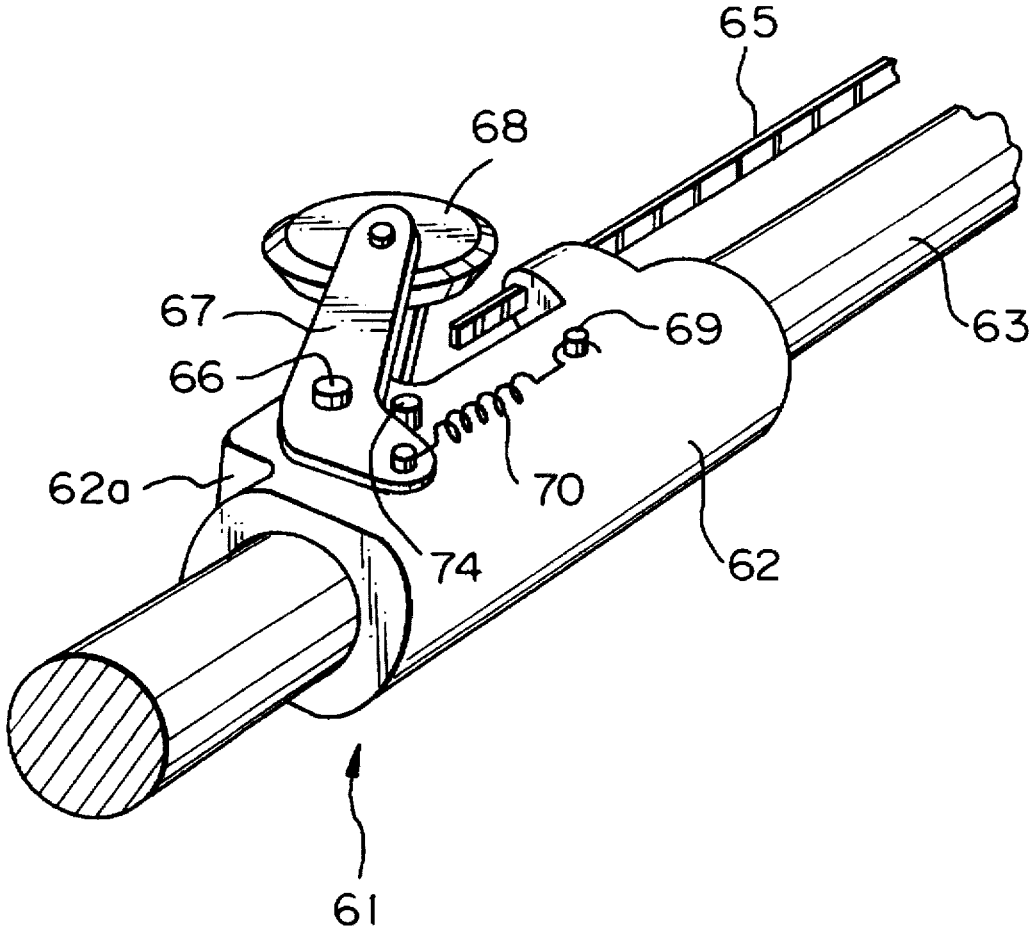
FIG. 13 is a perspective view of the folder shown in FIG. 12.

As shown in FIGS. 12 and 13, the slide block 62 has a projection 62*a*. An arm 67 is pivotably supported by the projection 62*a* via a pivot shaft 66. A fold roller 67 is supported by one end of the arm 67. The fold roller 68 has a sharply tapered peripheral face, as viewed in a section. Specifically, the peripheral face of the roller 68 is sharply projected at its widthwise center. A tension spring 70 is anchored at one end to the other end of the arm 67 and at the other end to a pin 69 studded to the slide block 62. The spring 70 constantly biases the arm 67 in the direction in which the fold roller 68 moves away from the slide block 62. A stop pin 74 restricts the movement of the arm 67 in such a direction.

As shown in FIG. 5, a block member 72 is supported by the side wall 20 and the other side wall and extends parallel to the guide shaft 63. As shown in FIG. 12, one side of the block member 72 facing the fold roller 68 is formed with a V-shaped groove 72A complementary in configuration to the peripheral face of the fold roller 67. The groove 72A extends along the guide shaft 63.

Assume that a sheet stack of, e.g., size A3 and B4 is provided with a fold widthwise at the intermediate between its leading and trailing edges. Then, the sheet stack can be bound or otherwise finished with ease.

Figure 14A:
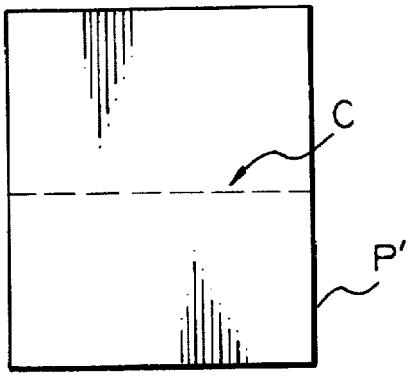
FIGS. 14A and 14B each shows particular stapling and folding positions.

FIG. 8 shows the sheet stack P' held at the truing position. After the stapler 16, puncher 43 and folder 61 have each been retracted to the respective home position, the sheet stack P' is clamped and then lowered by the previously stated procedure. The sheet stack P' is lowered until its center between the leading and trailing edges (position C, FIG. 14A) aligns with the bottom $72A_1$ of the V-shaped groove 72A (FIG. 12). When the motor 28 (FIG. 25) is implemented by a stepping motor, the sheet stack P' can be accurately brought to the above position only if the number of pulses is changed.

Subsequently, a folder motor 64 (FIG. 5) is energized to drive the timing belt 65. The slide block 62 carried on the timing belt 65 is moved from the position of FIG. 5 toward the side wall 20 while being guided by the guide shaft 63. At this instant, as shown in FIG. 12, the fold roller 68 is rotated with its sharply tapered peripheral face mating with the V-shaped groove 72A of the block member 72 with the intermediary of the sheet stack P'. When the arm 67 reaches an arm sensor 73 affixed to the bottom of the bracket 27 (FIG. 6), the motor 64 is deenergized with the result that the slide block 62 and fold roller 68 are stopped.

By the above procedure, the center C (FIG. 14B) of the sheet stack P' is folded by the fold roller 68 and groove 72A, as shown in FIG. 12. At this instant, the fold roller 68 is pressed by the sheet stack P' relatively, so that the spring 70 is held in an extended state. As a result, the fold roller 68 sequentially rolls on and along the bent portion (FIG. 12) of the sheet stack P' under the action of the spring 70.

As stated above, the folder 61 provides the trued sheet stack P' with a fold at a position different from the truing position.

Figure 14B:
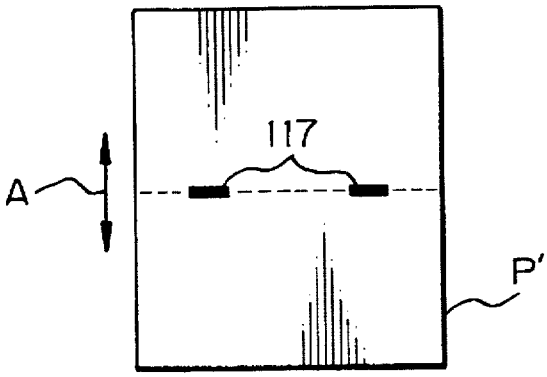

Subsequently, the separate stapler 16, for example, staples the sheet stack P' at the fold with the staples 117, as shown in FIG. 14B. Of course, the sheet stack P' may be stapled before it is folded. The position for folding the sheet stack P' is, of course, not limited to the center C.

After the sequence of operations described above, the motor 28 is rotated in the reverse direction, elevating the bracket 26. At this instant, the stapler 16, puncher 43 and folder 61 have each been retracted to the respective position not obstructing the elevation of the bracket 26. When the actuator lug 26*e* reaches the sensor 51 and causes it to turn off, the motor 28 is energized. As a result, the bracket 26 is restored to the home position shown in FIGS. 5 and 8. The sheet stack P' clamped by the clamp members 32 and 35 is elevating together with the bracket 26.

As soon as the sheet stack P' being lifted by the bracket moves away from the pawls 37*a* of the stop members 37, the solenoid 39 is deenergized. Consequently, the arm 38 is rotated away from the solenoid 39 by the action of the spring 60. The arm 38 in turn rotates the shaft 36 and thereby causes the stop members 37 to again protruded to the sheet transport path shown in FIG. 5.

Subsequently, the solenoids 33 and 34 are deenergized in order to unclamp the sheet stack P'. As a result, the sheet stack P' slightly drops due to its own weight until it rests on the stop members 37. At the same time, the belt 14 starts rotating while causing its stop pawl 50 to raise the trailing edge of the sheet stack P'. Consequently, the sheet stack P' has its leading edge nipped by the outlet roller pair 5. The roller pair 5 discharges the sheet stack P' onto the tray 6. If the sheet stack P' folded and stapled is discharged to the tray 6, then it can be provided with a bound state immediately.

After the sheet stack P' has been folded, the motor 64 is reversed before the stack P' is driven out to the tray 6. As a result, the slide block 62 is returned to its home position shown in FIG. 5 and awaits the next folding operation.

It has been customary with a finisher to fold sheets one by one and then true them together. With this kind of scheme, it is likely that the folds of the consecutive sheets are displaced from each other. In addition, it is difficult to position a plurality of folded sheets in a neat condition. The illustrative embodiment solves such problems because it trues sheets to be stapled together in the longitudinal and lateral directions and then folds them together.

The stapler 16 may staple the sheet stack P' at a position other than the fold, but close to the fold in the direction A, shown in FIG. 14B, if desired.

Figure 15:
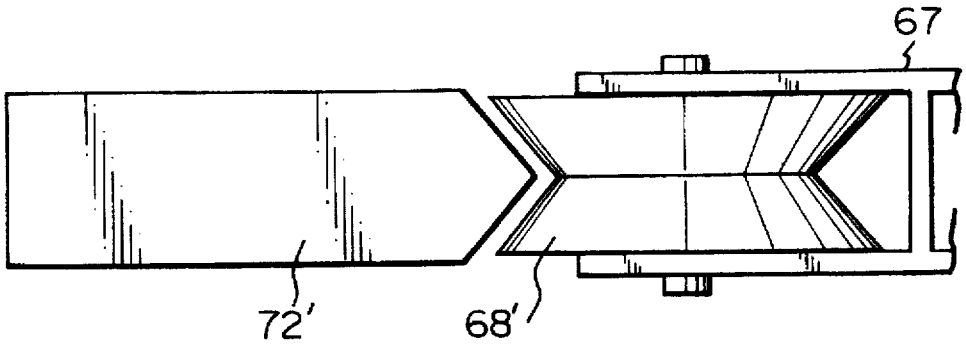
FIG. 15 is a side elevation showing another folder.

As shown in FIG. 15, the fold roller 68 may be replaced with a fold roller 68' formed with a V-shaped groove over its entire peripheral face. In such a case, the block member 72 will be replaced with a block member 72' having a sharply tapering side facing the fold roller 68' and extending along the guide shaft 63.

The motor 64, timing belt 65, pulley 64A and guide shaft 63 constitutes a specific form of means for driving the fold roller 68 or 68'. The motor 28, timing belt 30 and bracket 26 constitute a specific form of clamp member drive means for moving the sheet stack clamped by the clamp members 32 and 35 to the folding position. The folding position refers to the position where the center C of the sheet stack P', for example, aligns with the bottom $72A_1$ of the V-shaped groove 72A.

The separate stapler 16, puncher 43 and folder 61 constitute a specific form of sheet finishing means for finishing a sheet or sheets at a position different from the truing position. The motor 28, timing belt 30 and elevatable bracket 26 constitute a specific form of clamp member drive means for bringing a part of the sheets clamped by the clamp members 32 and 35 from the position of FIG. 8 to the position of the sheet finishing means, and for allowing the position of the sheets relative to the finishing means to be changed in the direction of sheet transport (arrow A, FIG. 3A).

The fold roller 68 forming a part of the folder 61 is rotatably supported by one end of the arm 67 which is pivotably supported by the slide block 62. As shown in FIG. 13, a spring or similar pressing means 70 may be anchored to the other end of the arm 67 in such a manner as to bias the fold roller 69 toward the sheet stack P'. Then, the spring 70 extends more with an increase in the thickness of the sheet stack P'; that is, the force of the spring 70 increases with an increase in the thickness of the sheet stack P'. This successfully intensifies the force for folding the sheet stack P' in proportion to the thickness of the stack P'.

The stapler 16 is made up of the stapler unit 16A and clincher unit 16B for accommodating a plurality of sheets therebetween, as stated with reference to FIG. 5. The stepping motor or similar motor 44 is a specific form of a single drive source for driving the separate stapler 16. The motor 44 or similar single drive source, screw shafts 41 and 42 respectively held in threaded engagement with the units 16A and 16B and identical as to the spiral direction, motor gear 44A and gears 45 and 46 constitute a specific form of stapler drive means for causing the stapler 16 to run in the direction (widthwise direction of sheets) perpendicular to the direction of sheet transport (from the truing position to the stapling position), and for stopping it an any desired position.

The motor gear 44A and gears 45 and 46 are interposed between the motor 44 and the screws 41 and 42. When the spirals of the screw shafts 41 and 42 are identical in direction, the gears 44A, 45 and 46 play the role of transmission members for transmitting the rotation of the motor 44 to the screw shafts 41 and 42 such that they rotate in the same direction. So long as the spiral directions and lead angles of the screw shafts 41 and 42 are the same, the stapler unit 16A and clincher unit 16B are capable of running at the same speed in the widthwise direction of the sheets while accurately facing each other. It is to be noted that the two units 16A and 16B are respectively mounted on the screw shafts 41 and 42 in an accurately facing relation from the beginning.

Even when the screw shafts 41 and 42 are opposite in spiral direction, they can be driven in the above condition only if they are provided with the same lead angle and rotated in opposite directions to each other. For example, an idle gear, not shown, may be positioned between the motor gear 44A and the gear 45 in order to rotate the screw shafts 41 and 42 in opposite directions.

In the illustrative embodiment, when the screw shafts 41 and 42 are opposite to each other in spiral direction, the motor gear 44A, gear 45, idle gear mentioned above and gear 46 serve to transmit the rotation of the motor 55 to the screw shafts 41 and 42 such that they rotate in opposite directions to each other. An idle gear may be disposed between the motor gear 44A and the gear 46, if desired.

While the screw shafts 41 and 42 may each be driven by a respective motor, this cannot be done unless two independent motors are rotated in full synchronous with each other. Moreover, the two motors not only complicate the drive arrangement but also increases the cost of the finisher. In the illustrative embodiment, both the stapler unit 16A and the clincher unit 16B are driven by a single motor. This simplifies the drive arrangement, reduces the cost of the finisher, and drives the two units 16A and 16B in full synchronism.

The puncher 43 is guided by the screw shaft 41, as stated earlier with reference to FIG. 5. This obviates the need for exclusive means for guiding the puncher 43 and thereby simplifies the construction of the drive mechanism while reducing the cost.

While the embodiment has concentrated on a sheet finisher including the stapler 16, puncher 43 and folder 61, the present invention is practicable even with a sheet finisher having any other sheet finishing means.

2nd Embodiment

Figure 16:
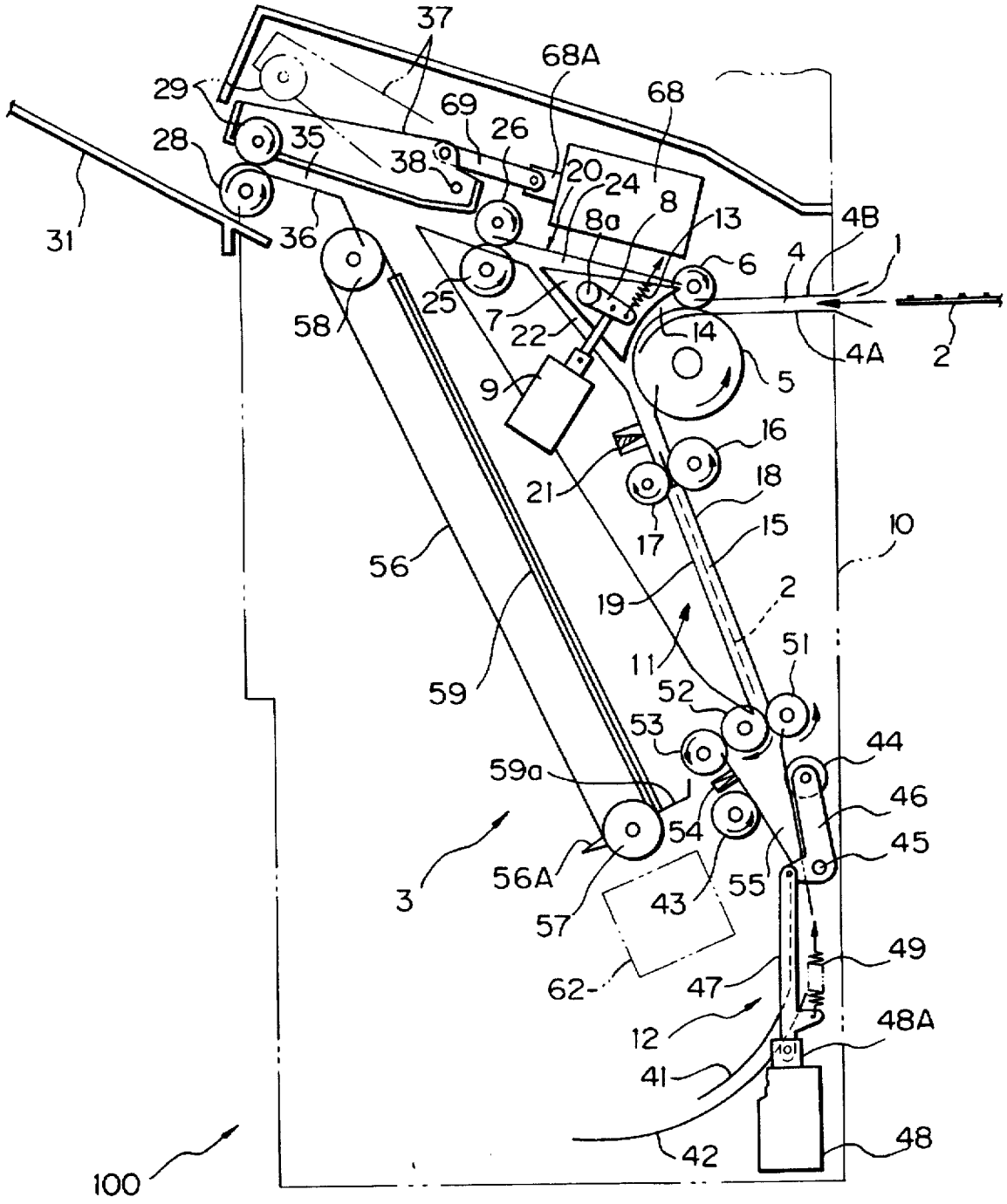
FIG. 16 is a sectional side elevation showing a second embodiment of the present invention.

Referring to FIG. 16, a second embodiment of the present invention will be described. As shown, a sheet finisher 100 has a body 10 operatively connected to an image forming apparatus, not shown. A sheet inlet 1 is formed in the finisher body 10 and aligned with a sheet outlet formed in the apparatus. Assume that the apparatus to which the finisher 100 is connected is of the type transferring a toner image from a photoconductive element to a sheet and fixing the toner image on the sheet. Then, the sheet with the toner image is driven out of the apparatus and then introduced into the finisher body 10 via the inlet 1 as a sheet 2.

A stapling section 3 is arranged in the finisher body 10 in an inclined position in order to staple a plurality of sheets together. The construction and operation of the stapling section 3 will be described specifically later. The sheet 2 entered the finisher body 10 advances a path 4 defined between two guide plates 4A and 4B. A turn-over roller 5 having a large diameter and a conveyor roller 6 having a small diameter are located downstream of the path 4 with respect to the direction in which the sheet 2 advances. The rollers 5 and 6 are held in contact with each other.

A switchable guide or path selector 7 adjoins the rollers 5 and 6. A lever 8 is provided integrally with the path selector 7 at a shaft portion **8*a*. The shaft portion 8*a* is journalled to the front and rear side walls, not shown, of the finisher body 10. The path selector 7 is rotatable about the shaft portion 8*a*. A solenoid 9 has its plunger connected to substantially the center of the lever 8. A tension spring 13 is anchored at one end to the lever 8** and at the other end to one of the side walls.

When the solenoid 9 is not energized, the path selector 7 is held in the position shown in FIG. 16 under the action of the spring 13. The sheet 2 coming in through the path 4 is conveyed by the coactive rollers 5 and 6 and steered into a turn-over path 14 between the path selector 7 and the roller 5.

A path substantially parallel to the stapling section 3 is located downstream of the turn-over path 14 with respect to the direction of sheet transport. A pair of conveyor rollers 16 and 17 contacting each other are positioned in the upstream portion of the path 15. The sheet 2 moved away from the path 14 is almost entirely received in the path 15 via the rollers 16 and 17. The sheet 2 received in the path 15 is indicated by a dashed line. The path 15 is defined by guide plates 18 and 19 facing each other.

The sheet 2 entered the finisher body 10 is conveyed to the path 15 while being turned over substantially along the direction in which the stapling section 3 is arranged. The turn-over path 14 formed by the turn-over roller 5 and path selector 7, conveyor rollers 16 and 17 and path 15 constitute a first sheet turning section 11 for turning the sheet 2 in the above direction, more specifically in a direction in which a tray 59 which will be described extends.

A trailing edge sensor 21 is located in the vicinity of the roller 17 in order to sense the trailing edge of the sheet 2. When the trailing edge of the sheet 2 moved away from the turn-over path 14 moves away from the sensor 21, the resulting output of the sensor 21 is sent to a controller, not shown. In response, the controller causes the rotation of the rollers 16 and 17 to stop and then causes them to rotate in directions opposite to the directions shown in FIG. 16 immediately. As a result, the sheet 2 having its trailing edge nipped between the rollers 16 and 17, as indicated by the dashed line, is driven out of the path 15 into a path 22 between the path selector 7 and a guide plate 19 with its trailing edge now leading the rest. When the sheet 2 enters the path 22, a pair of rollers 25 and 26 each rotating in a direction indicated by an arrow nip the sheet 2 and drive it into a path 35 which terminates at a pair of discharge rollers 28 and 29. The discharge rollers 28 and 29 drive the sheet 2 out of the finisher body 10 onto a tray 31.

Assume that the sheet 2 arrives at the inlet 1 face up, i.e., its image surface facing upward. Then, the sheet 2 is turned upside down by the turning section 11 and then driven out to the tray 31 face down. Specifically, assuming that the sheet 2 reached the inlet 1 is the first page, it is delivered to the tray 31 face down. This is also true with the second and successive pages. If the sheet 2 which is the first page is brought to the inlet 1 first and then driven out to the tray 31 without being turned over by the turning section 11, then the sheet 2 and successive sheets will not be stacked on the tray 31 in order of page. Even when the sheets are sequentially brought to the inlet 1 face down, the last page being first, they can be stacked on the tray 31 in order of page if they are turned over by the turning section 11.

The finisher 100 is capable of stapling a plurality of sheets together, as will be described in detail later. The above procedure relates to a turn-over mode for simply delivering sheets to the tray 31 without stapling them in order to stack them in order of page. For the turn-over mode, the paths 28 and 29 are provided along which the sheet 2 is conveyed to the discharge rollers 28 and 29. The first turning section 11 is used to stack the sheets 2 on the tray 31 in order of page without stapling them. This successfully simplifies the construction of the finisher.

Also available with the illustrative embodiment is a mode in which the sheets 2 are not stapled or turned over. In this mode, the solenoid 9 shown in FIG. 16 is energized by a solenoid ON signal received from, e.g., a controller installed in the image forming apparatus. Then, the solenoid 9 pulls the lever 8 and thereby causes the path selector 7 to rotate about the shaft portion 8*a* to a position shown in FIG. 17. In this condition, the sheet 2 entered the path 4 is conveyed by the turn-over roller 5 and 6 to the path 24 while being guided by the path selector 7 and guide 32. Subsequently, the sheet 2 is conveyed to the path 35 by the rollers 25 and 26 which are rotating in the directions indicated by arrows. Finally, the sheet 2 is driven out to the tray 31 by the discharge rollers 28 and 29. The path 35 is defined between the guide 36 and a bottom wall 37*a* forming part of a roller support member 37 which will be described. The bottom wall 37*a* plays the roll of a sheet guide at the same time.

Figure 17:
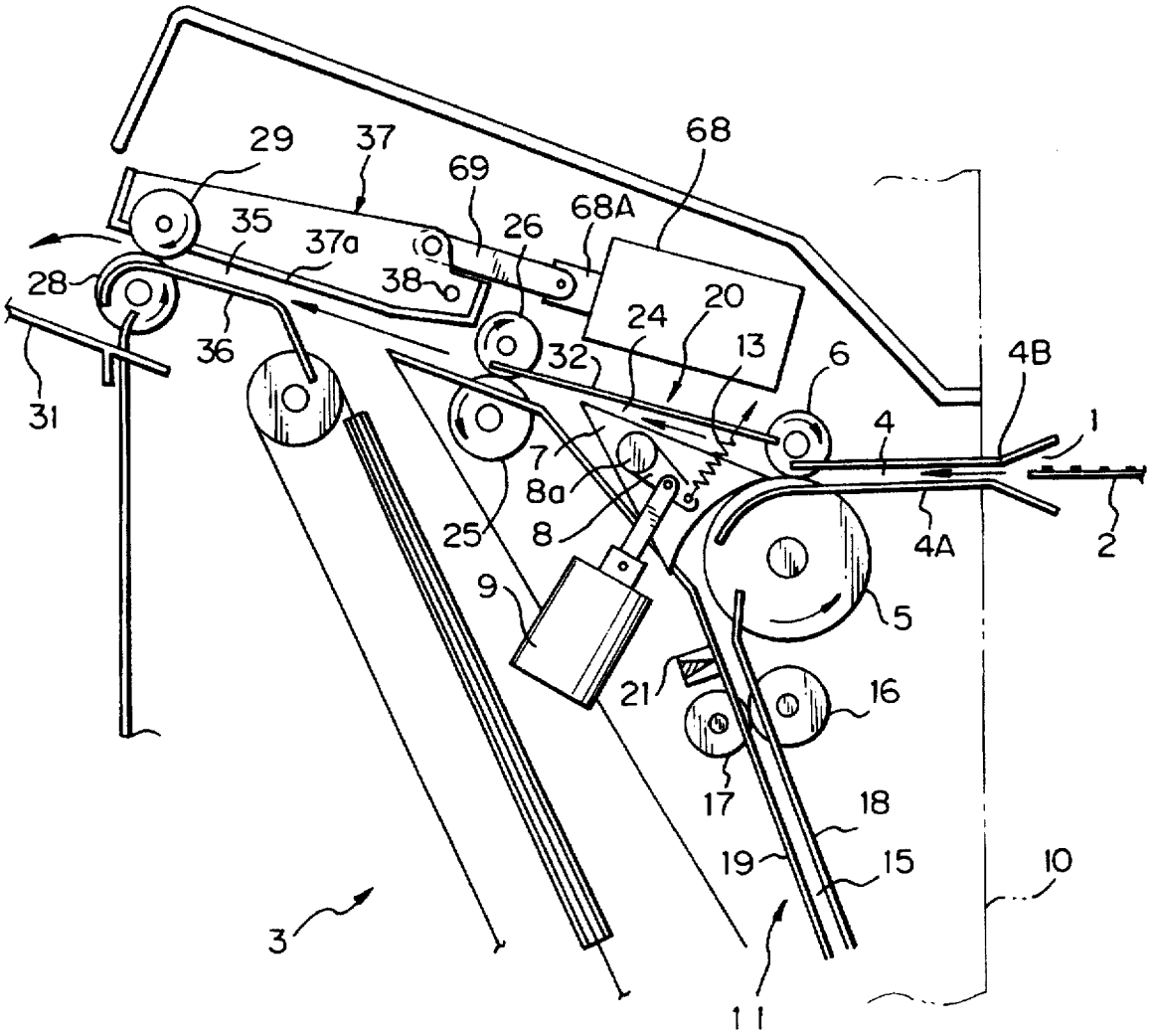
FIG. 17 shows a sheet transport section arranged in an upper portion in the second embodiment.

Assume that the sheet 2 shown in FIG. 17 reaches the inlet 1 face up and is the last page. Then, the sheet 2 is routed through the paths 4, 24 and 35 and driven out to the tray 31 face up by the discharge rollers 28 and 29. The next sheet lower in page number than the first sheet 2 is stacked on the first sheet or last page 2 existing on the tray 31. Finally, the first page is stacked on the second page existing on the tray 31. As a result, the sheets are stacked on the tray 31 in order of page.

In FIG. 17, the path 4 formed by the guides 4A and 4B, the path 24 formed by the rollers 5 and 6, guide 32 and path selector 7 and the path 35 formed by the rollers 25 and 26, bottom wall 37*a* and guide 36 constitute a specific form of straight conveying means 20 for conveying the sheets from the inlet 1 directly to the discharge rollers 28 and 29 when they are not to be stapled.

Even when the sheets are conveyed by the straight conveying means 20 face down from the first page to the last page, they can be stacked on the tray 31 in order of page.

As shown in FIG. 16, a second turning section 12 is arranged in the lower portion of the finisher body 10. A pair of guides 41 and 42 form a part of the second turning section 12 and are convex toward the outside of the finisher body 10. A roller 43 is rotatably mounted on a side wall, not shown, of the finisher body 10 in the vicinity of the inner guide 41 and first turning section 11. The roller 43 is constantly rotated in a direction indicated by an arrow in the figure.

A roller 44 is rotatably mounted on one end of a lever 46 which is in turn pivotably supported by the side wall via a pivot shaft 45. The roller 44 is selectively brought into contact with the roller 43. An arm 47 is connected at one end to the other end of the lever 46 and at the other end to a plunger 48A extending from the solenoid 48. A tension spring 49 is loaded between the arm 47 and the side wall. When the solenoid 48 is not energized, the plunger 48A is constantly biased upward, as viewed in FIG. 16, by the spring 49. In this condition, the roller 44 is spaced from the roller 43.

A pair of rollers 51 and 52 are positioned between the first turning section 11 and the second turning section in order to transfer the sheet 2 from the former to the latter. A roller 53 is held in contact with the roller 52 and conveys the sheet 2 from the second turning section 12 to the stapling section 3. The roller 53 is driven in a direction indicated by an arrow together with the roller 43.

A trailing edge sensor 54 is located between the roller 43 and the roller 53. The distance between the guides 41 and 42 is sequentially increased toward the upper end, and the sensor 54 faces the space between the guides 41 and 42.

How the embodiment turns over sheets and staples them will be described hereinafter. In the turn and staple mode, the solenoid 9 is deenergized, so that the path selector 7 is held in the position shown in FIG. 16 by the action of the spring 13. The sheet 2 coming in through the inlet 1 is routed through the path 4 to the turn-over path 14 and turned over thereby. The sheet 2 entered the path 15, as indicated by the dashed line, is nipped by the rollers 51 and 52 rotating in the directions indicated by arrows. The rollers 51 and 52 convey the sheet 2 to a switchback path 55 between the guides 41 and 42.

When the trailing edge of the sheet 2 moves away from the sensor 54, the resulting output of the sensor 54 is sent to the controller. In response, the controller sends a solenoid ON signal to the solenoid 48 and thereby turns it on. As a result, the arm 47 is pulled by the solenoid 48 against the action of the spring 49, causing the lever 46 to rotate counterclockwise about the pivot shaft 45. The roller 44 presses the trailing edge of the sheet moved away from the rollers 51 and 52 toward the roller 43.

Figure 18:
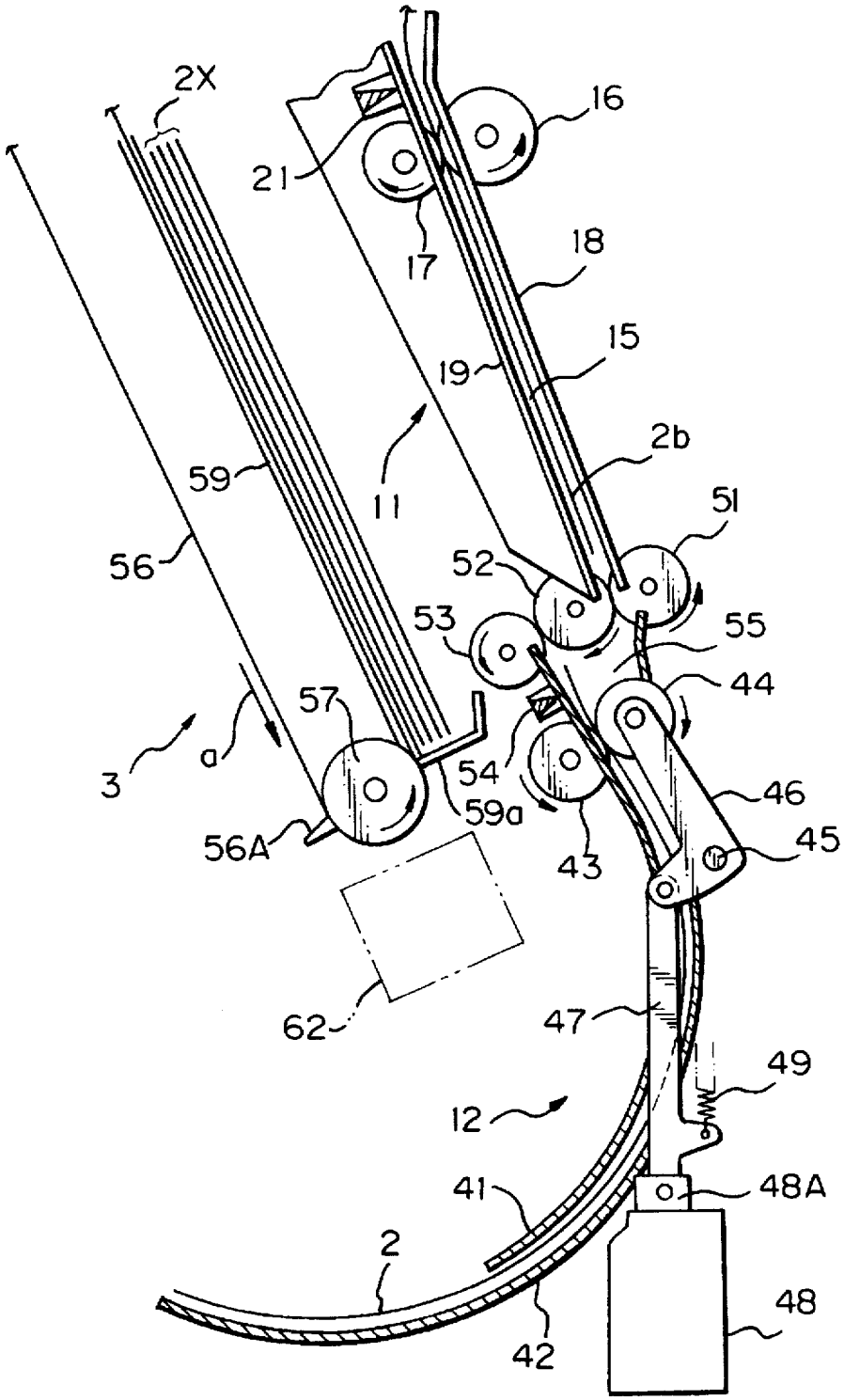
FIG. 18 shows a sheet transport section arranged in a lower portion in the second embodiment.
Figure 19:
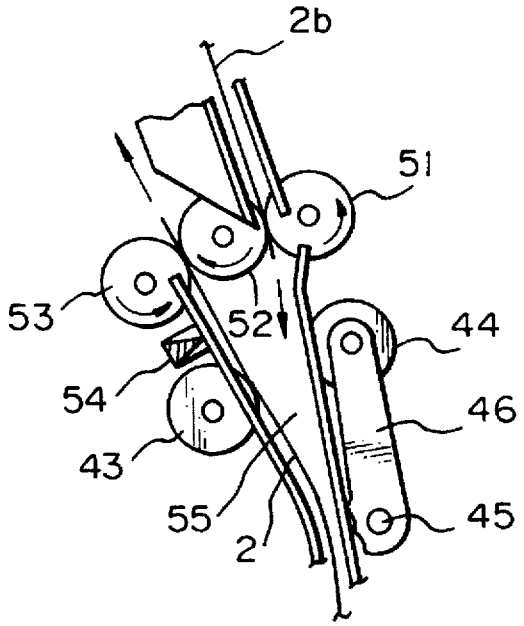
FIG. 19 shows how the preceding sheet and the following sheet are conveyed between a first and a second sheet turning section.

As shown in FIG. 18, the trailing edge of the sheet 2 is nipped by the rollers 43 and 44. As shown in FIG. 19, the rollers 43 and 44 drive the sheet 2 to a nip between the rollers 52 and 53. The rollers 52 and 53 convey the sheet 2 to the stapling section 3.

Figure 20:
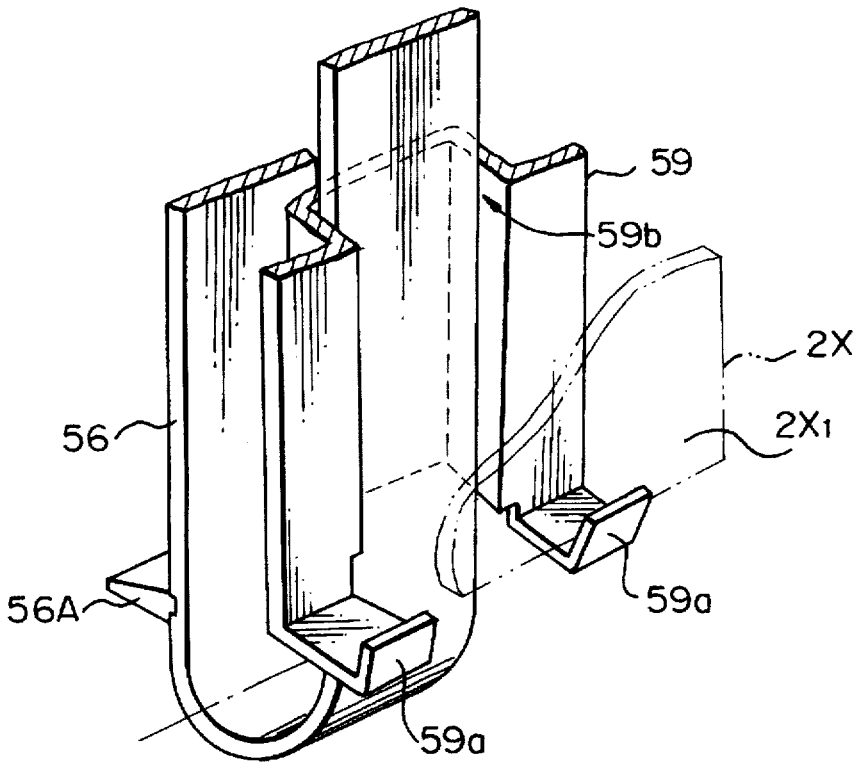
FIG. 20 is a perspective view showing a part of a stapling section.

As shown in FIG. 16, the stapling section 3 has a tray 59 and a stapler 62. The tray 59 is affixed to the side walls of the finisher body 10 in an inclined position and has a pair of pawls 59*a* (FIG. 20) at its lower end. The tray 59 extends parallel to an endless belt 56 passed over a pair of rollers 57 and 58. One of the rollers 57 and 58 is a drive roller. As shown in FIG. 20, one of opposite runs of the belt 56 is received in a channel 59*b* formed in the tray 59 in the up-and-down direction.

Assume that the sheet 2 enters the finisher body 10 face up via the inlet 1 and is the first page. Then, the sheet 2 is routed through the first turning section 11 to the second turning section 12 and then switched back toward the tray 59, as stated earlier. The next sheet or second page is stacked on the tray 59 in the same manner as the first page. Such a procedure is repeated up to the last page. In FIG. 18, labeled 2X is the resulting stack of sheets reached a preselected number.

The first turning section 11 turns over the incoming sheet 2 and conveys it in the direction substantially parallel to the direction in which the stapling section 3 extends, as stated previously. In the illustrative embodiment, the tray 59 extends in the direction in which the stapling section 3 is arranged.

The rollers 52, 53, 43 and 44 and switchback path 55 formed by the guides 41 and 42 constitute a specific form of the second turning section 12 for conveying the consecutive sheets moves away from the first turning section 11 toward the stapling section 3 in the opposite direction.

Figure 21:
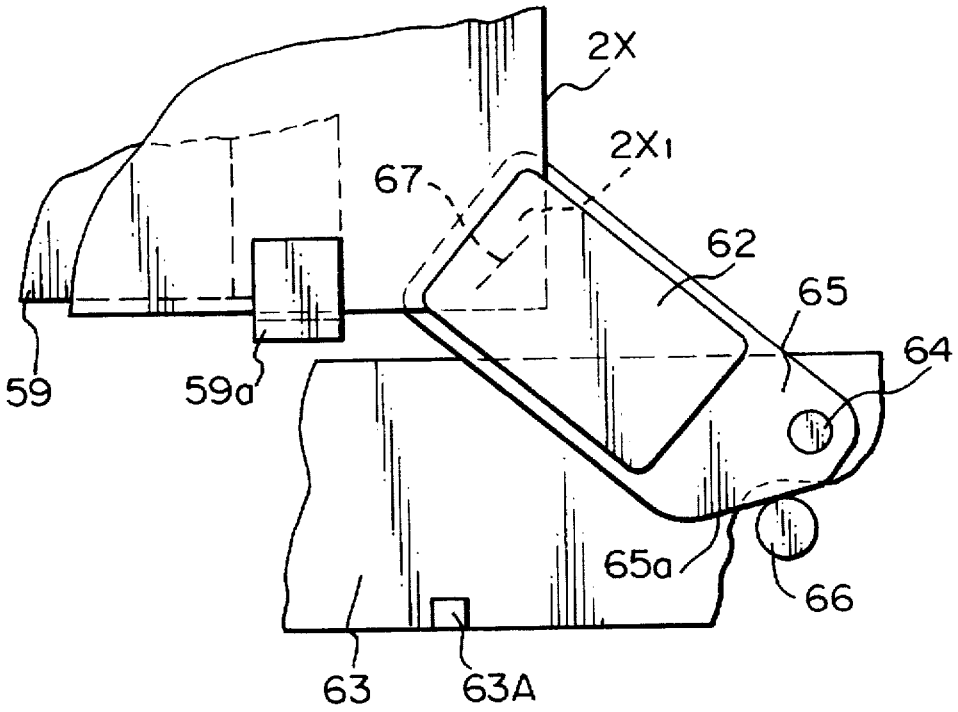
FIG. 21 shows a stapler brought to its operative position.

When the lower edge of the sheet stack 2X, as viewed in FIG. 18, rests on the pawls 59*a* of the tray 59, the stack 2X is positioned or trued in the direction in which the belt 56 extends. The sheet stack 2X is positioned in the direction perpendicular to the above direction by positioning means, not shown. After the sheet stack 2X has been positioned, the stapler 62 (FIG. 21) staples the bottom corner $2X_1$ of the stack 2X (FIG. 20) with a staple in response to a staple command based on a sheet end signal received from the controller of the image forming apparatus.

Figure 22:
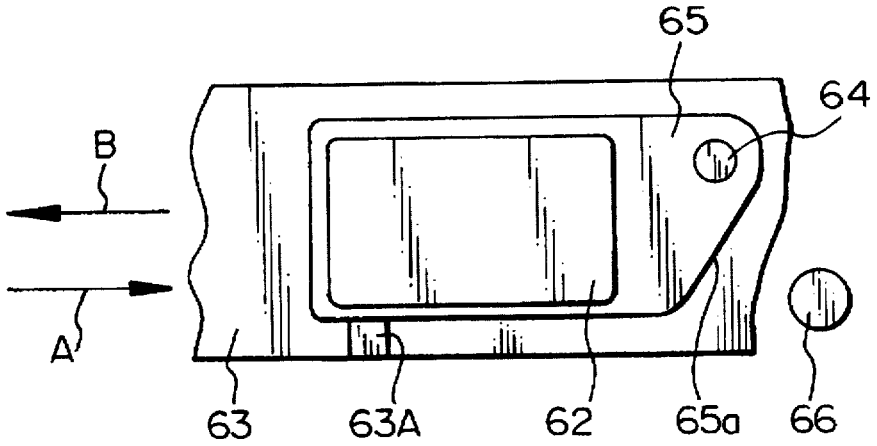
FIG. 22 is a view associated with FIG. 21.

As shown in FIG. 22, the stapler 62 is affixed to a stapler bracket 65 which is in turn supported by a guide plate 63 via a pivot shaft 64. Biasing means, not shown, constantly biases the bracket 65 counterclockwise, as viewed in FIG. 22. In the condition shown in FIG. 22, the rotation of the bracket 65 is restricted by a lug 63A provided on the guide plate 63.

A stationary stop pin 66 is positioned independently of the guide plate 63. When the guide plate 63 is pushed in a direction A toward the rear of the finisher either manually or mechanically, the bracket 65 abuts against the stop pin 66 at its inclined edge 65*a*. The stop pin 66 causes the bracket 65 to rotate from the position shown in FIG. 22 to a position shown in FIG. 21. In this position, the stapler 62 receives the bottom corner $2X_1$ of the sheet stack 2X and staples it with a staple 67. Specifically, the stapler 62 is usually held in the position shown in FIG. 21. When the preselected number of sheets are received between the clincher and the stapler body of the stapler 62, the clincher and stapler body are moved toward each other to staple the sheets.

When the stapler body of the stapler 62 runs out of staples, the guide plate 63 is pulled outward the front of the finisher body 10, i.e., in a direction indicated by an arrow B in FIG. 22. As a result, the the bracket 65 is returned to the position shown in FIG. 22 and allows the stapler 62 to be pulled out of the finisher body 10. After the stapler body has been loaded with staples, the guide plate 63 is again pushed into the finisher body 10 (direction A) as far as the position shown in FIG. 21.

After the sheet stack 2X has been stapled by the stapler 62, the belt 56 starts rotating in a direction indicated by an arrow a in FIG. 18. A pawl 56A extends out from the belt 56. While the belt 56 is in rotation, the pawl 56A is brought to the lower edge of the sheet stack 2X shown in FIG. 20 and sequentially raises the stack 2X toward the path 35 shown in FIG. 16.

On entering the path 35, the sheet stack 2X is driven by the rollers 28 and 29 toward the tray 31. The belt 56 passed over the rollers 57 and 58 and the path 35 constitute a specific form of sheet discharging means for discharging the stapled stack of sheets to the outside of the finisher.

The sheet stack is driven out to the tray 31 face down with its page number sequentially increasing from the bottom to the top. On the other hand, when the sheets sequentially enter the inlet 1 face down, the last page being first, the resulting sheet stack will be driven out to the tray 31 face up with its page number sequentially increasing from the top to the bottom.

It has been customary with a sheet finisher to locate a pair of conveyor rollers between the first turning section and the second turning section or switchback section. That is, the conventional finisher has only the rollers 51 and 52 shown in FIG. 18 and lacks the roller 53. This kind of scheme has the following problem. The sheet is conveyed from the first turning section 11 to the second turning section and then to the stapling section 3. At this instant, the next sheet cannot be transferred from the turning section 11 to the turning section 12 unless the trailing edge of the preceding sheet fully moves away form the rollers 51 and 52. This increases the distance between the consecutive sheets and therefore the period of time necessary for a preselected number of sheets to be fully stacked. As a result, the overall stapling time is increased.

As shown in FIG. 18, the illustrative embodiment is characterized in that the roller 53 is added to the rollers 51 and 52. In FIG. 18, the preceding sheet and following sheet are labeled 2 and 2*b*, respectively. When the trailing edge of the preceding sheet 2 moves away from the sensor 54, the solenoid 48 is energized and causes the roller 44 to press the trailing edge toward the roller 43, as stated earlier. As a result, the trailing edge of the sheet 2 is nipped by the rollers 43 and 44. As soon as the sheet 2 is nipped by the rollers 52 and 53 with its trailing edge now leading the rest, the solenoid 48 is deenergized. Consequently, the arm 47 is raised by the spring 49 and causes the lever 46 to rotate clockwise about the pivot shaft 45 until the roller 44 has been released from the roller 43. Just after the release of the roller 44 from the roller 43, the next sheet 2*b* is driven into the switchback path 55 by the rollers 51 and 52. The two sheets 2 and 2*b* are therefore conveyed in opposite directions to each other during the same time zone. Such a system noticeably reduces the period of time necessary for a preselected number of sheets to be fully stacked on the tray 59, thereby reducing the stapling time.

The conventional system using only two rollers 51 and 52 must switch over the directions of their rotation. The embodiment makes this needless, and in addition should only drive the additional roller 53 constantly in the same direction. In any case, the intermediate roller 52 cooperates with the other rollers 51 and 53 and thereby simplifies the construction of the turning section and reduces the number of parts and cost.

In the mode which does not staple the sheets, when the sheets sequentially entering the inlet 1 directly discharged to the tray 31 by the rollers 28 and 29, it sometimes occurs that they are not adequately arranged in order of page. Even in this condition, the sheets can be stacked on the tray 31 in order of page if turned over by the first turning section 11.

In FIG. 16, the sheet 2 indicated by the dashed line is a sheet which is not to be stapled and has been turned over for page arrangement. This sheet 2 is assumed to be relatively short in the direction of sheet transport and is discharged from the position shown in FIG. 16 to the tray 31 via the paths 22 and 35.

Figure 23:
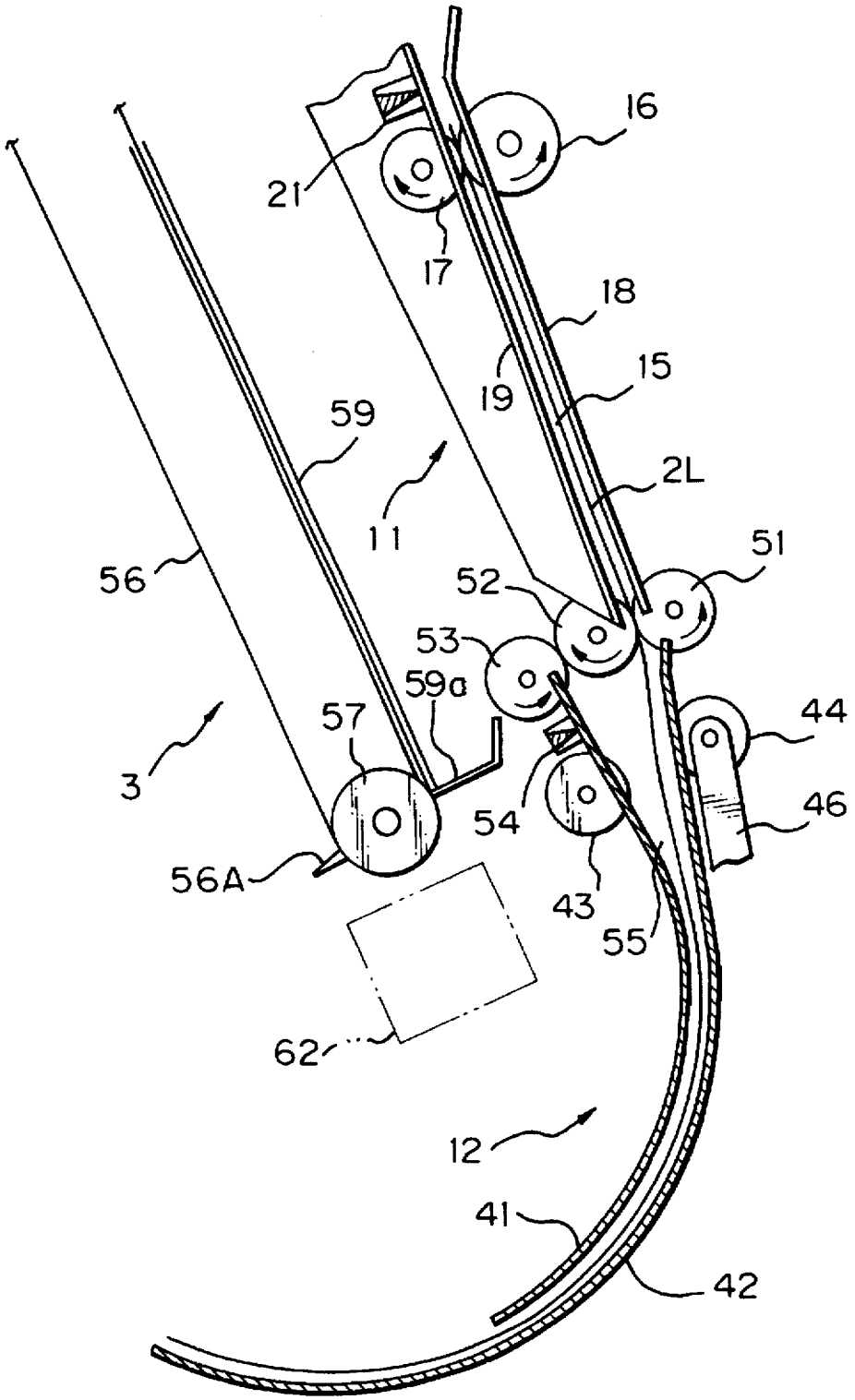
FIG. 23 shows the lower sheet transport section of the finisher and demonstrates how a relatively long sheet is turned over and conveyed.

In FIG. 23, a sheet 2L is relatively long in the direction of sheet transport, i.e., it is of size A3. Even this kind of sheet 2L can be temporarily driven into the turning mechanism by using both of the first and second turning sections 11 and 12. Specifically, not only the path 15 above the three rollers 51, 52 and 53 but also the switchback path 55 below them are used. When the rollers 51 and 52 convey the sheet 2L toward the tray 31 from the position shown in FIG. 23, they are rotated in directions opposite to the directions shown in FIG. 23.

As stated above, the embodiment has the paths 22 and 35 for allowing the sheet 2L driven into the first and second turning sections 11 and 12 to be conveyed to the outlet by the rollers 28 and 29, bypassing the stapling section 3. In addition, the turning sections 11 and 12 serve as a conveying section for the page arrangement of the sheet 2L which is relatively long in the direction of sheet transport and is not to be stapled. Therefore, even such a relatively long sheet can be smoothly turned over and conveyed. The rollers 51 and 52 not only convey the sheet to be stapled, but also contributes to the conveyance of the relatively long sheet. This successfully reduce the number of parts and reduces the size of the turning mechanism.

In the staple mode, the sheets are sequentially stacked on the tray 59. Assume that the sheets are relatively long in the direction of sheet transport, as stated above. Then, when each sheet is driven out of the switchback path 55 toward the tray 59, its leading edge is apt to abut against the outlet rollers 29 and 290 and jam the path. In light of this, the upper roller 29, as viewed in FIG. 16, may be so arranged as to be selectively movable away from the lower roller 28. Then, even the relatively long sheets, e.g., sheets of size A3 can be neatly stacked on the tray 59 and stapled together. In the illustrative embodiment, the upper roller 29 is rotatably mounted on the previously mentioned roller support member 37. The support member 37 is supported by the side walls of the finisher via a pivot shaft 38. Further, the support member 37 is connected to the plunger 68A of a solenoid 68 via a link 69.

When the sheets to be transferred from the image forming apparatus to the finisher are relatively long, the controller of the apparatus sends a command to a controller installed in the finisher. In response, the controller of the finisher outputs a solenoid ON signal so as to energize the solenoid 68. The solenoid 68 pulls the link 69 and thereby causes the roller support member 37 to rotate about the shaft 38 to a position indicated by a phantom line in FIG. 16. As a result, the upper roller 29 is spaced from the lower roller 28. In this condition, even the long sheets can be easily stacked and stapled. After such sheets have been stapled, the solenoid 68 is deenergized. Then, biasing means, not shown, moves the roller support member 37 from the phantom line position to the position indicated by a solid line in FIG. 16. As a result, the upper roller 29 is again brought into contact with the lower roller 28. The stapled sheet stack has its leading edge nipped by the rollers 28 and 29 and is immediately driven out to the tray 31 thereby.

As stated above, the illustrative embodiment has discharge roller drive means. Assume that the sheet driven into the stapling section 3 is so long, its leading edge reaches the sheet discharging section implemented by the rollers 28 and 29. Then, when such a long sheet is brought into the stapling section 3, the rollers 28 and 29 are released from each other. When the sheets stapled by the stapler are driven out to the tray 31, the rollers 28 and 29 are again brought into contact in order to convey the stapled sheets. In the embodiment, the roller support member 37, pivot shaft 38, solenoid 68, link 69, biasing means, not shown, and the controller for controlling the solenoid 68 constitute the discharge roller drive means.

The various rotary bodies including the rollers shown in FIG. 16 are operatively connected to a drive motor, not shown, installed in the finisher body 10 by way of suitable torque transmitting means and suitable clutch means.

This embodiment has various unprecedented advantages as enumerated below.

(1) The period of time necessary for a preselected number of sheets to be stacked in a stapling section is reduced. This reduces the stapling time and produces a stapled sheet stack in a short period of time.

(2) When sheets are not to be stapled, a first sheet turning section can be used as a sheet conveying section for arranging the sheets in order of page. This simplifies the construction of the finisher.

(3) When sheets are not to be stapled, the first sheet turning section and a second sheet turning section can be used as a sheet conveying section for arrangement the sheets in order of page. This simplifies the construction of the finisher and insures the smooth and sure transport of even relatively long sheets.

(4) Even relatively long sheets can be smoothly stapled in the stapling section.

3rd Embodiment

Figure 24:
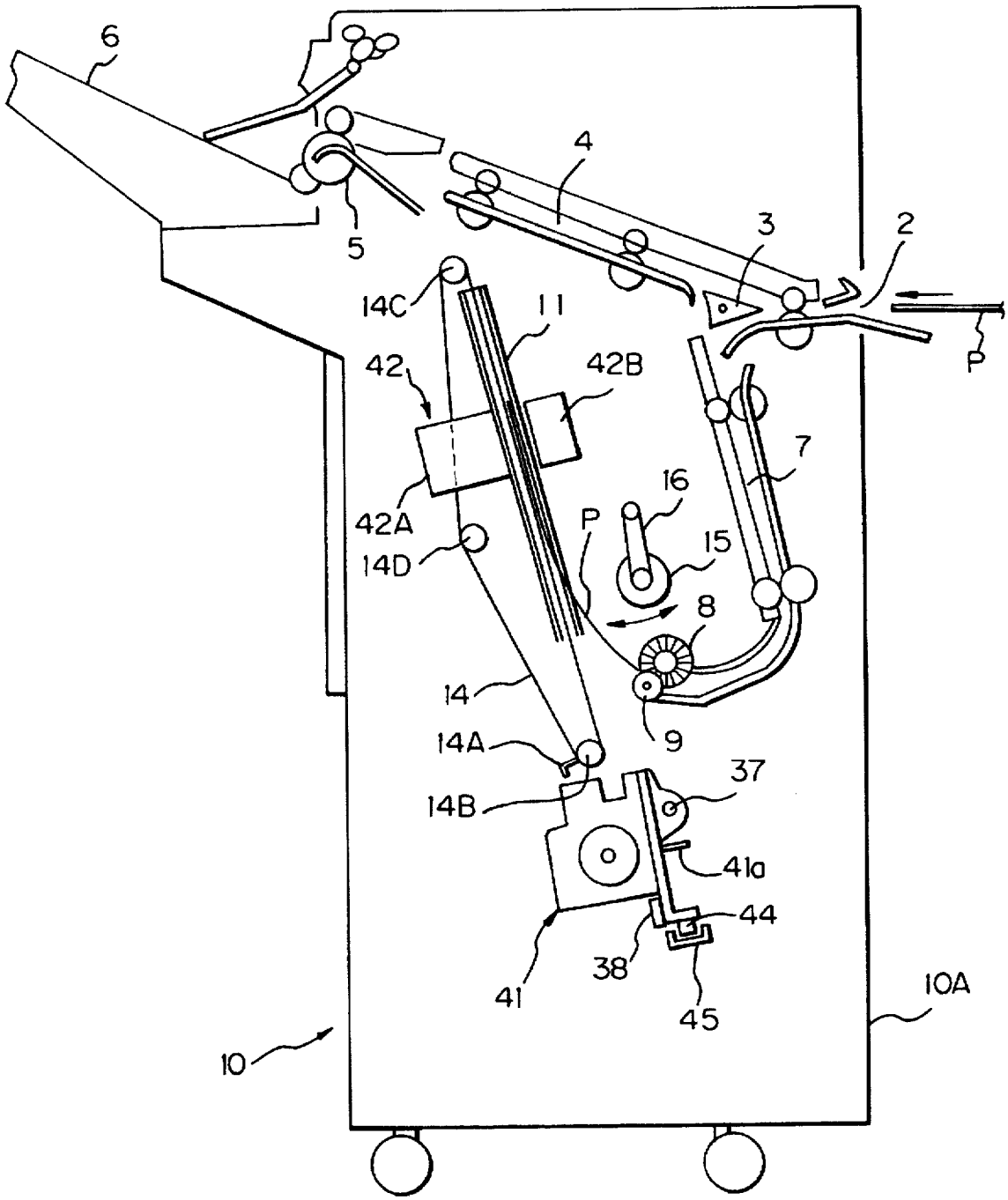
FIG. 24 is a sectional side elevation showing a third embodiment of the present invention.

Referring to FIG. 24, another alternative embodiment of the present invention will be described. As shown, a finisher 10 has a body 10A formed with a sheet inlet 2. A sheet P coming out of a copier, printer, facsimile apparatus, multiplex machine or similar image forming apparatus is introduced into the finisher body 10A via the inlet 2. When the sheet P does not need stapling which will be described, it is guided by a switchable guide or path selector 3 to a transport path 4. Then, the sheet P is driven out of the finisher body 10A to a tray 6 by a discharge roller 5. On the other hand, when the sheet P needs stapling, the path selector 3 is switched to steer the sheet P to another transport path 7. When the sheet P reaches a feed roller or brush roller 8 and a roller 9 by way of the path 7, the rollers 8 and 9 cooperate to convey it toward an endless belt 14. A pair of jogger fences 11 and 12A (FIG. 25) position the sheet P in the lateral direction perpendicular to the direction of sheet transport (up-and-down direction).

An arm 16 has a pusher roller 15 at its free end and pivotally moved periodically by a driving device, not shown. On the movement of the arm 16, the pusher roller 15 pushes the sheet P driven toward the belt 14 by the rollers 8 and 9, thereby moving it toward the belt 14. The belt 14 is passed over a plurality of pulleys 14B, 14C and 14D rotatably supported by the finisher body 10A. One of the pulleys 14B–14D is a drive pulley.

The sheet P is positioned also in the direction of sheet transport (up-and-down direction), as will be described specifically later. A plurality of sheets so positioned are stapled together, as will also be described later. Subsequently, the belt 14 is rotated counterclockwise, as viewed in FIG. 24. As a result, the sheet stack is driven out to a tray 6 by the discharge roller pair 5 while being raised by a stop pawl 14A provided on the belt 14.

Figure 25:
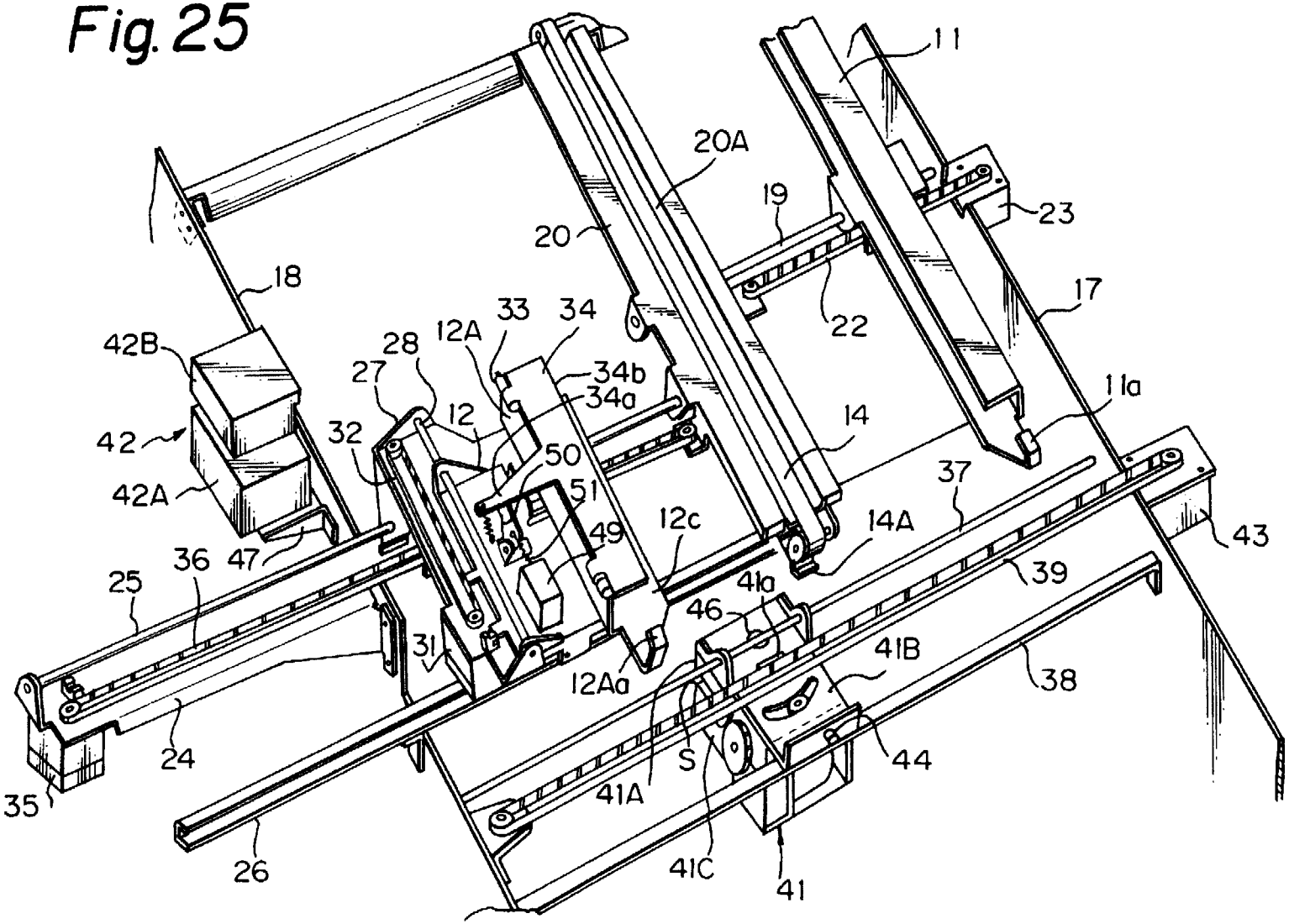
FIG. 25 is a perspective view of a finishing mechanism included in the third embodiment.

As shown in FIG. 25, a guide stay 20 is affixed to the finisher body 10A and extends in the direction of sheet transport. The upper run of the belt 14 is received in the longitudinal channel 20A formed in the center of the guide stay 20. A guide shaft 19 is affixed to one end to a side wall 17 and at the other end to the guide stay 20. The side fence 11 is mounted on the shaft 19 in such a manner as to be movable in the direction perpendicular to the direction of sheet transport, i.e., in the widthwise direction of the sheet. Specifically, substantially the intermediate portion of the side fence 11 is anchored to one run of a timing belt 72 passed over a pair of pulleys. A stepping motor or similar motor 23 is reversibly rotated in order to drive one of the above pulleys. As a result, the timing belt 22 is rotated to move the side fence 11 in the lateral direction perpendicular to the direction of sheet transport.

A bracket 24 is affixed to another side wall 18 facing the side wall 17. A guide shaft 25 is affixed at one end to the bracket 24 and at the other end to the guide stay 20. A holder 27 is supported by the guide shaft 25 and a guide rail 26 parallel to the guide shaft 25. The holder 27 is movable in the lateral direction.

A stepping motor or similar motor 35 is affixed to the bracket 24 and drives a timing belt 36 extending between the bracket 24 and the guide stay 20. The timing belt 36 is passed over a pair of pulleys supported by the bracket 24 and guide stay 20, i.e., finisher body 10A; one of the pulleys is driven by the motor 35. The holder 27 is anchored to one run of the timing belt 36. The motor 35 is reversibly rotated in order to move the belt 36, so that the holder 27 is moved in the lateral direction.

A guide shaft 28 is affixed to the holder 27 in the longitudinal direction. A clamp holder 12 is provided on the holder 27 and supported by the guide shaft 28 in such a manner as to be movable in the longitudinal direction. A stepping motor or similar motor 31 is mounted on the bottom of the holder 27. A timing belt 32 extends longitudinally on the holder 27 and driven by the motor 31. The timing belt 32 is passed over a pair of pulleys supported by the holder 27; one of the pulleys is driven by the motor 31.

Figure 26:
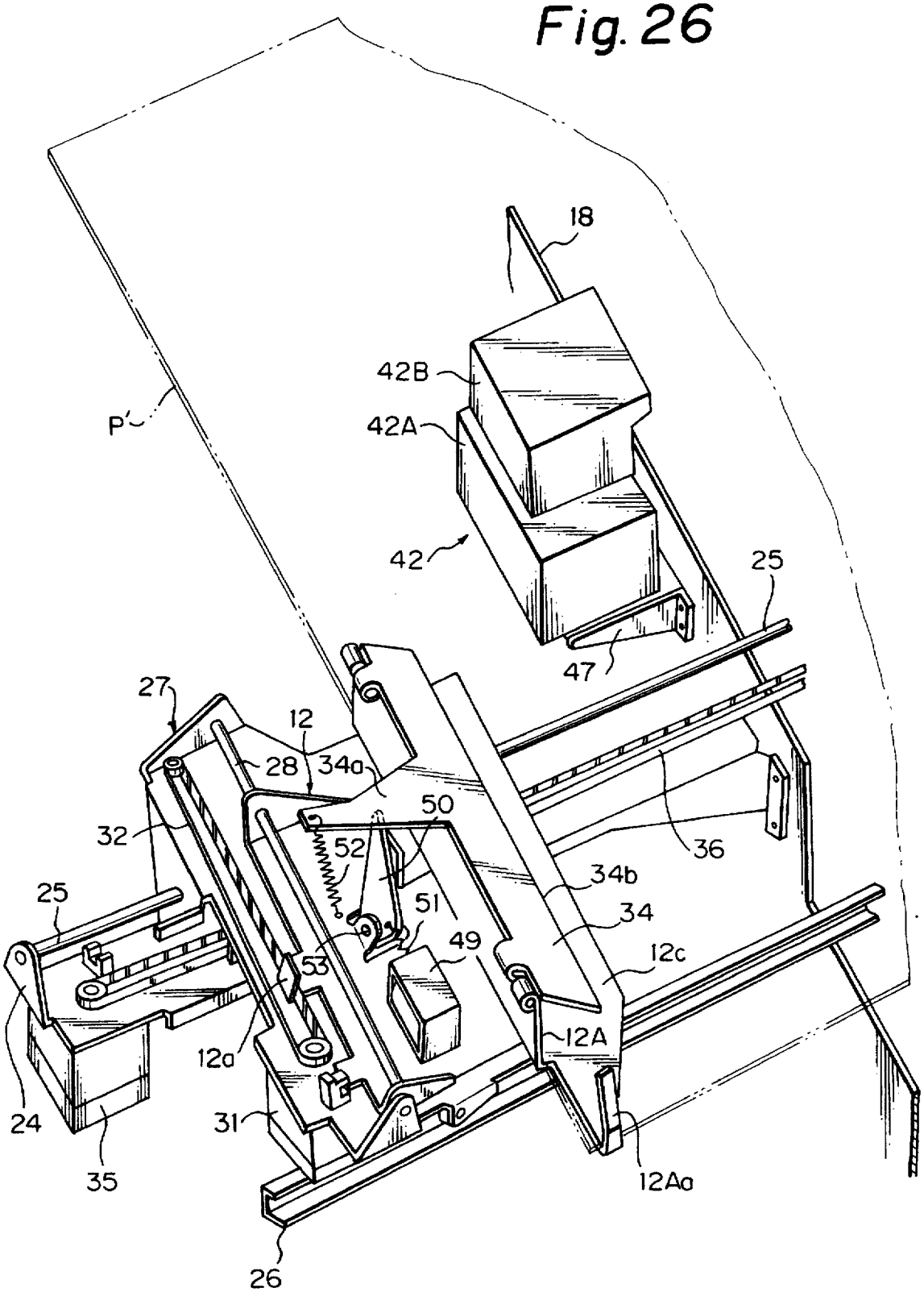
FIG. 26 is an enlarged perspective view demonstrating the operation of lateral sheet shifting means included in the third embodiment.

The clamp holder 12 is anchored to one run of the timing belt 32 at its portion 12*a* (FIG. 26). When the motor 31 is rotated in the forward or reverse direction, the timing belt 32 is moved in the same direction as the motor 31, moving the clamp holder 12 in the longitudinal direction.

The side fence 12A is affixed to the clamp holder 12 or formed integrally therewith. When the clamp holder 12 moves longitudinally, the side fence 12A moves integrally with the clamp holder 12. A clamp member 34 is rotatably connected to the side fence 12A by a hinge 33. The side fences 12A and 11 facing each other are respectively formed with bent pawls 11*a* and 11A*a* at their ends.

The sheet P is conveyed by the rollers 8 and 9 (FIG. 24) toward the guide stay 20 and belt 14 which is held in a halt (FIG. 25). At this instant, the side fences 11 and 12A are spaced a distance slightly greater than the width of the sheet P. In this condition, the sheet P is brought to between the side fences 11 and 12A while being pushed by the roller 15.

As soon as the sheet P is brought to between the side fences 11 and 12A, a controller, not shown, outputs a motor drive signal. In response, the motor 35 (FIG. 25) and therefore the timing belt 36 starts rotating. As a result, the holder 27 moves toward the guide stay 20 together with the clamp holder 12, i.e., the side fence 12A approaches the side fence 12A. At this instant, the pawl 12A*a* of the side fence 12A is rapidly brought to below the lower edge of the sheet P. The side fence 12A moves the sheet P by pressing the side edge of the sheet P until the sheet P lightly abuts against the other side fence 11. As a result, the sheet P is positioned or trued in both the lateral direction and the longitudinal direction. Specifically, the sheet P is positioned by the pawls 11*a* and 12A*a* in the longitudinal direction and by the side fences 11 and 12A in the lateral direction. For example, the center of the sheet P in the widthwise direction is substantially aligned with the center of the belt 14.

When the next sheet comes in, the motor 35 is reversed in order to move the holder 27 slightly toward the motor 35 together with the clamp holder 12. As a result, the side fence 12A is moved away from the side fence 11. After the next sheet has been brought to between the side fences 11 and 12A, the side fence 12A is again moved toward the guide stay 20. Because the stroke over which the side fence 12A moves is, e.g., as short as about 5 mm, the sheet P existing on the pawls 11*a* and 12A*a* is prevented from slipping out of the pawls 11*a* and 12A*a* and dropping.

As stated above, the side fence 12A moves back and forth in the lateral direction for every sheet P and positions it. If desired, the other side fence 11 may also be moved in synchronism with the side fence 12A by the reversible motor 23 via the timing belt 22.

The side fences 11 and 12A at least one of which is movable in the lateral direction and the pawls 11*a* and 12A*a* constitute a specific form of sheet truing means for positioning the sheet P introduced into the finisher body 10A in the vertical direction or direction of sheet transport and the lateral direction perpendicular thereto. One or both of the side fences 11 and 12A may each be driven by the respective drive means, as desired.

Figure 35:
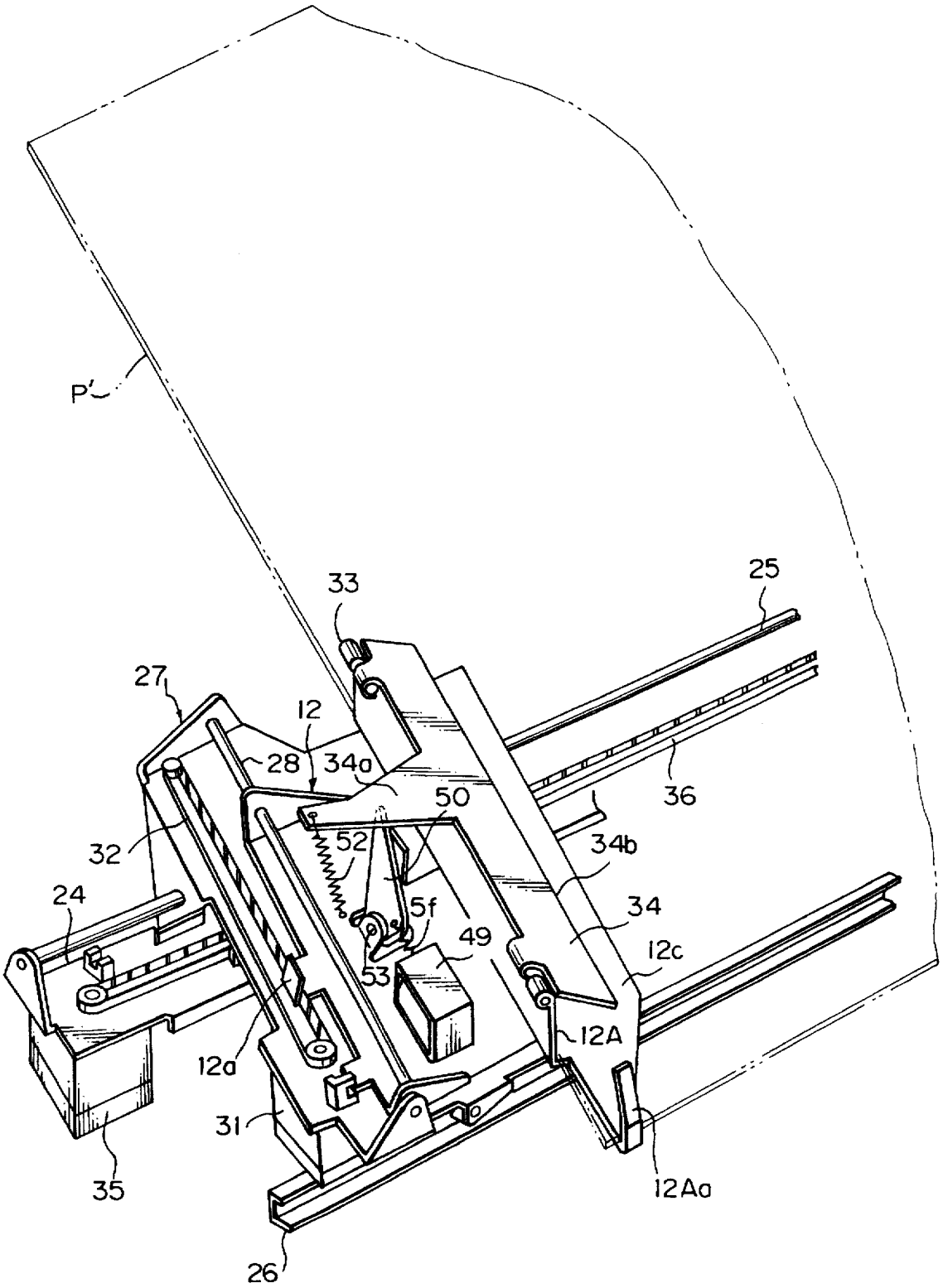
FIG. 35 is an enlarged perspective view demonstrating the operation of lateral sheet shifting means.

As shown in FIG. 35, a guide shaft 37 and a guide stay 38 parallel to each other extend between the side walls 17 and 18. A unitary stapler 41 for edge stapling is movable on and along the guide shaft 37 and guide stay 28 in the lateral direction. In the illustrative embodiment, the stapler 41 is mounted on a bracket 41*b* which will be described. A lug 41*a* extending out from the bracket 41 is anchored to one run of a timing belt 39. The timing belt 39 is passed over a pair of pulleys mounted on the finisher body 10A. One of these pulleys is connected to a stepping motor or similar reversible motor 43. When the motor 43 is rotated, the belt 39 is moved in the lateral direction perpendicular to the longitudinal direction or direction of sheet transport.

The stapler 41 has a stapler body 41A storing staples, not shown, and a clincher 41C. When a staple is fed from the body 41A, the clincher 41C clinches it and staples sheets in cooperation with the body 41A. The body 41A and clincher 41C, like an ordinary stapler for office use, are hinged to each other at their base ends. After the end of a stack of sheets has been inserted in a space S between the body 41A and the clincher C, a motor, not shown, included in the stapler 41 is energized. As a result, the free ends of the body 41A and clincher 41C are moved toward each other, thereby bending a staple fed form the body 41A.

Figure 27A:
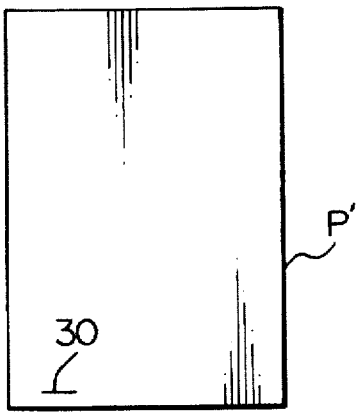
FIGS. 27A–27C each shows a particular condition for stapling the edge of a sheet stack.

Specifically, when a plurality of sheets are fully trued by the side fences 11 and 12A and their pawls 11*a* and 12A*a*, a motor drive signal is output in order to rotate the motor 43. As a result, the stapler 41 is moved toward a preselected stapling position. On the turn-off of the motor 43, the stapler 41 is brought to a stop at the stapling position and staples the sheets there. For example, as shown in FIG. 27A, the stapler 41 staples the bottom left corner of a sheet stack P' with a staple 30. In any case, the stapler 41 staples the sheet stack at one of opposite longitudinal edges thereof.

Figure 27B:
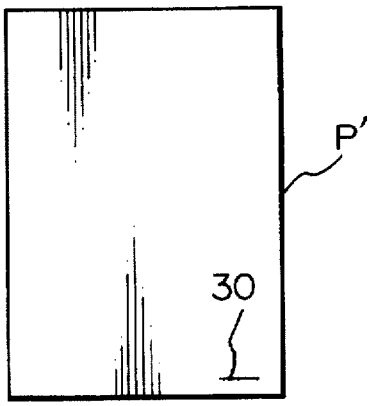
Figure 27C:
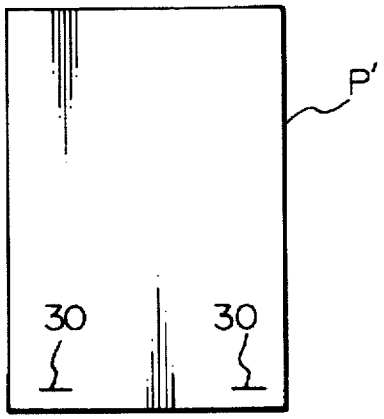

The stapler 41 may be moved laterally to another position so as to staple the sheet stack P' at the bottom right corner thereof, as shown in FIG. 27B. Further, as shown in FIG. 27C, the stapler 41 may be stopped at two spaced positions and operated at each of them so as to staple the sheet stack P' at the bottom right and bottom left corners.

The guide shaft 37, guide stay 38, bracket 41B, motor 43 and timing belt 39 driven by the motor 43 constitute a specific form of unitary stapler drive means for moving the unitary stapler 41 for edge stapling in the lateral direction relative to a sheet stack and positioning it at a desired position or positions.

Figure 28:
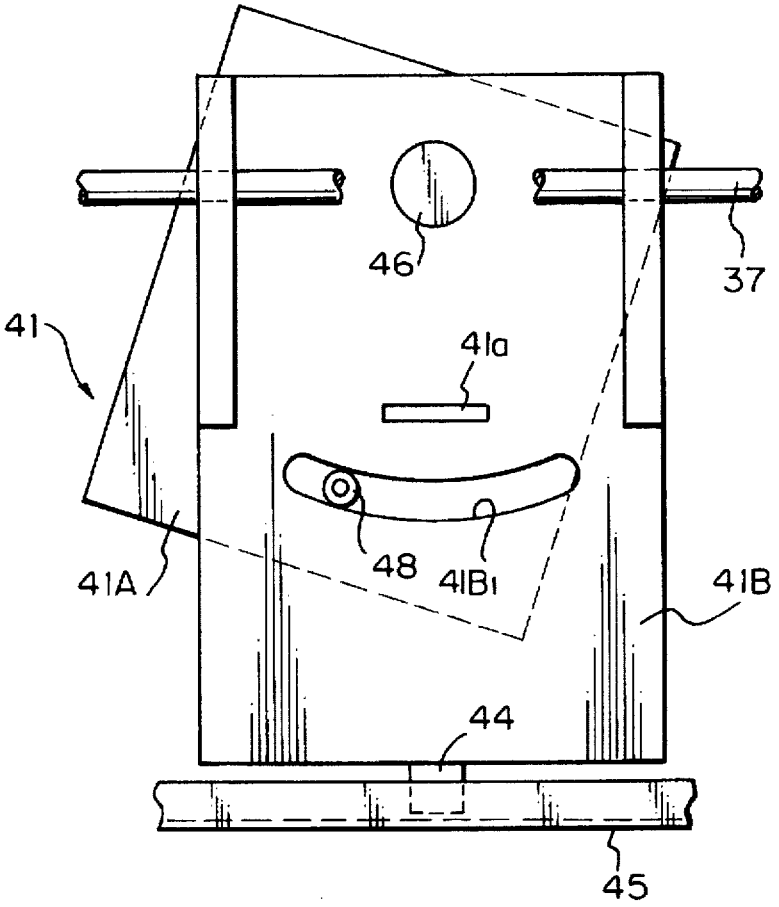
FIG. 28 shows a swingable unitary stapler rotated to a position for driving a staple in an inclined position.

In FIG. 25, the bracket 41B supporting the stapler 41 is supported by the guide shaft 37 and guide stay 38 in such a manner as to be movable in the lateral direction. FIGS. 24 and 28 show an alternative arrangement in which a roller 44 is mounted on the bent end of the bracket 41B. The roller 44 is rollably received in a guide rail 45 affixed to the finisher body 10A. This also allows the bracket 41B and therefore the stapler 41 to move in the lateral direction.

The stapler 41 is capable of driving the staple 30 into the sheets in an inclined position, as needed. The stapler 41 is supported by the bracket 41B via a shaft 46 and rotatable about the axis of the shaft 46. A drive mechanism, not shown, is arranged in the stapler body 41A in order to move the stapler 41 to a desired angular position. As shown in FIG. 28, a guide roller 48 is mounted on the body 41A while an arcuate guide hole $41B_1$ is formed in the bracket 41B. When the stapler 41 is rotated about the shaft 46, the body 41B is guided by the guide roller 48 and guide hole $41B_1$.

Figure 29:
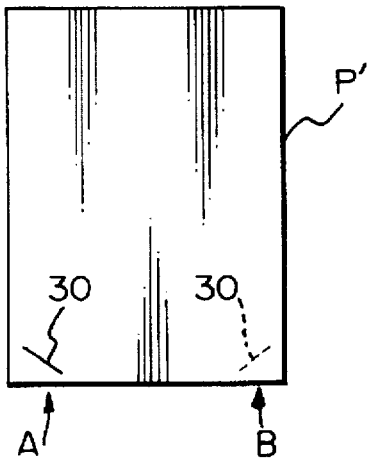
FIG. 29 shows how a staple is driven into a sheet stack in an inclined position.

Assume that the sheet stack P' is positioned, as shown in FIG. 29. Then, the stapler 41 may be brought to a position A, rotated by the drive mechanism to an inclined position shown in FIG. 28, and then operated. In this case, the staple 30 will be driven into the sheet stack P' at the position A. Likewise, the stapler 41 may be moved to a position B, rotated in the direction opposite to the above direction, and then operated so as to drive the staple 30 into the sheet stack P' at the position B. In this manner, the stapler 41 is capable of stapling the sheet tack P' in an inclined position at either one of the left and right corners of the stack P'.

As stated above, the unitary stapler 41 is implemented as a swingable stapler capable of stapling the sheet stack P' in the horizontal position shown in FIGS. 27A–27C or in the inclined position shown in FIG. 29. The bracket 41B, shaft 46, drive mechanism arranged in the stapler body 41A, guide roller 48 and guide hold $41B_1$ constitute a specific form of stapler swinging means for adjusting the position of the stapler 41 relative to the positioned sheet stack P'. With this swinging means, it is possible to drive the staple 30 into the sheet stack P' in any desired angle.

After the stapler 41 has stapled the edge of the sheet stack P' either horizontally or obliquely, the controller outputs a drive signal for driving a motor, not shown, for driving the belt 14. As a result, the belt 14 starts moving counterclockwise, as viewed in FIG. 24, causing the stop 14A to raise the sheet stack P'. Consequently, the sheet stack P' is conveyed by the discharge roller 5 onto the tray 6.

Further, the illustrative embodiment is capable of stapling a sheet stack at the center, as follows. As shown in FIG. 25, a separate stapler 42 is used to staple a sheet stack positioned by the sheet truing means at substantially the center thereof in the longitudinal direction. The stapler 42 has a stapler body 42A storing staples, not shown, and a clincher 42B disposed above the stapler body 42A. The clincher 42B bends a staple fed from the body 42A in cooperation with the body 42A for thereby binding a sheet stack. The body 42A and clincher 42B are separate from each other, so that a sheet stack can be passed through therebetween.

The separate stapler 42 for center stapling is positioned laterally outward of the truing zone to which a sheet stack will be brought. The body 42A is mounted on a bracket 47 affixed to the side wall 18 while the clincher 42B is supported by an upper wall, not shown, disposed above the side wall 18. Although the body 42A and clincher 42B slightly move relative to each other in the event of stapling, they are unmovably supported by the finisher body 10A.

After a sheet stack to be stapled at its center has been positioned in the lateral direction by one or both of the side fences 11 and in the longitudinal direction by the pawls 11*a* and 12A*a*, the controller outputs a solenoid ON signal. In response, a solenoid 49 affixed to the clamp holder 12 is energized and pulls a spring 51 loaded between the solenoid 49 and a level 50. As a result, the lever 50 is rotated about a shaft 53 (FIG. 26) in a direction for raising the lug 34*a* of the clamp member 34. This causes the clamp member 34 to rotate about the hinge 33 such that its side edge 34*b* moves downward, against the action of a spring 52 (FIG. 26) loaded between the end of the lug 34*a* and the clamp holder 12. Consequently, the clamp member 34 clamps the side edge of the sheet stack in cooperation with a flat body portion 12*c* included in the side fence 12A.

After the clamping operation, the controller outputs a motor drive signal for driving the stepping motor 35. In response, the motor 35 and therefore the belt 36 is rotated and moves the holder 27 toward the motor 35 together with the clamp holder 12. As a result, the sheet stack is moved laterally from the truing position to a center stapling position while being clamped by the clamp member 34. At this instant, the sheet stack enters the space between the stapler 42A and the clincher 42B (FIG. 26). As to the lateral direction, the words "truing position" refer to the position where the sheet stack is positioned by the side fences 11 And 12A, e.g., the position where the widthwise center of the sheet stack is aligned with the center of the belt 14, as shown in FIG. 25. As to the longitudinal direction, the truing position refers to the position where the sheet stack is received by the pawls 11*a* and 12A*a*.

Figure 30:
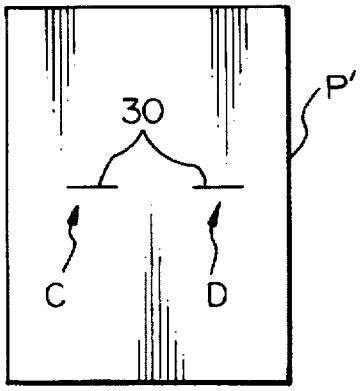
FIG. 30 shows how a staple is driven into the center of a sheet stack.

FIG. 26 shows the sheet stack P' located at the center stapling position. When the sheet stack P' is brought to this position, the stepping motor 35 is deenergized in order to locate the stack P' there. Subsequently, the stapler 42 is operated by a staple signal received from the controller, as stated earlier. As a result, the sheet stack P' is stapled at its position C, as shown in FIG. 30. Then, the sheet stack P' is moved to the left, as viewed in FIG. 26. On the arrival of another stapling point D of the sheet stack P' (FIG. 30) at the stapler 42, the stapler 42 is again operated so as to drive another staple 30 into the sheet stack P at the point D. As a result, the sheet stack P' is stapled at two spaced points. Of course, the sheet stack P' may be stapled at a single point or at three or more points, as desired.

After the stapler 42 has stapled the sheet stack P' at the center, the stepping motor 35 is reversed to return the holder 27 to the original position, e.g., position shown in FIG. 25 together with the clamp holder 12. At the same time, the solenoid 49 is deenergized with the result that 50 is rotated to the position shown in FIG. 25. The clamp member 34 is pulled by the spring 52 to the position shown in FIG. 25. Subsequently, the belt 14 starts rotating while causing its stop pawl 14A raising the sheet stack P' toward the outlet roller 5.

The bracket 24, guide shaft 25, guide rail 26, motor 35, timing belt 36, holder 27 and clamp holder 12 constitute a specific form of lateral sheet shifting means for shifting a sheet stack positioned by the sheet truing means laterally from the truing position to the center stapling position where the separate stapler 42 is located.

Figure 31:
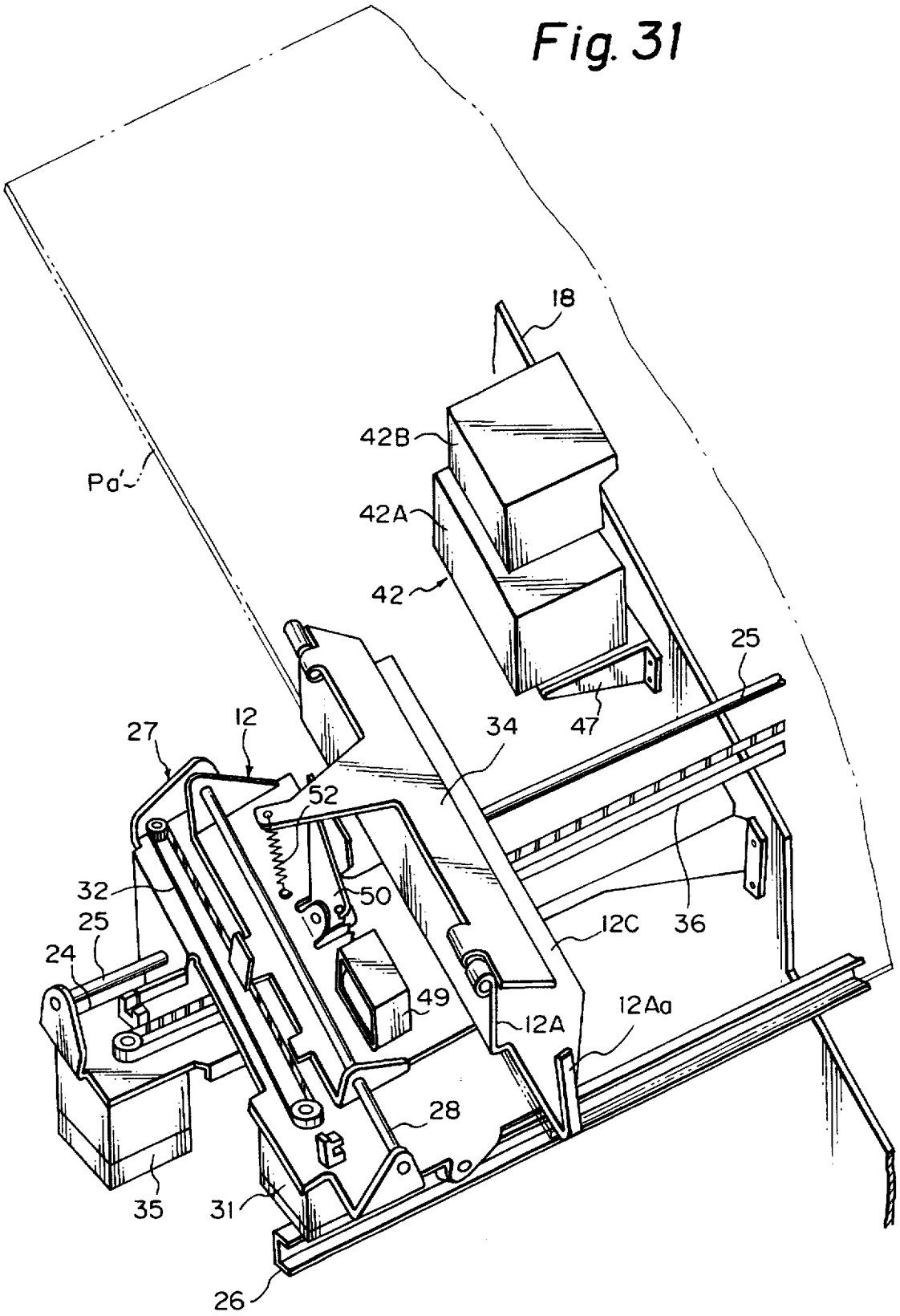
FIG. 31 is a perspective view showing a sheet stack of relatively great size held in a center stapling position, and demonstrating the operation of longitudinal sheet shifting means.

When sheets to be stapled together have a size greater than the sheet stack P' in the longitudinal direction, they are shifted by the following procedure. FIG. 31 shows a sheet stack P'a greater in size than the sheet stack P' specifically. After the sheet stack P'a has been positioned by the sheet truing means in the longitudinal and lateral directions, the solenoid 49 is energized to rotate the lever 50. Further, the clamp member 34 is rotated to clamp the side edge of the sheet stack P'a.

Subsequently, the stepping motor 31 and therefore the timing belt 32 starts rotating. The belt 32 moves the clamp holder 12 from the position shown in FIG. 26 to the position shown in FIG. 31. At this instant, the clamp holder 12 is guided by the shaft 28. In this manner, the sheet stack P'a is moved such that its center in the longitudinal direction aligns with the stapler 42, while being clamped by the clamp member 34.

After the sheet stack P'a has been positioned in the longitudinal direction by the above procedure, the stepping motor 35 starts rotating and shifts the sheet stack P'a in the lateral direction. Specifically, the sheet stack P'a is shifted such that its point C (FIG. 30) aligns with the stapler 42. After the sheet stack P'a has been located at the stapling position, the stapler 42 drives a staple into the sheet stack P'a. The motor 35 again starts rotating in order to locate the point D (FIG. 30) of the sheet stack P'a at the stapling position. Then, the stapler 42 drives another staple into the sheet stack P'a. Of course, the stapler 42 may drives only one staple or three or more staples into the sheet stack P'a, as desired. In this manner, the center stapling position for the sheet stack P'a is adjustable in matching relation to the longitudinal size of the stack P'a.

After the stapling operation, the motor 35 shown in FIG. 31 is reversed to return the holder 27 from the position of FIG. 31 to the position of FIG. 25. Further, stepping motor 31 is reversed to return the clamp holder 123 from the position of FIG. 31 to the position of FIG. 26. Then, the solenoid 49 is deenergized to return the clamp member 34 to the position shown in FIG. 25. Thereafter, the belt 14 is rotated to discharge the stapled sheet stack P'a to the tray 6 via the discharge roller 5.

The motor 31, timing belt 32, clamp holder 12 and guide shaft 28 constitute a specific form of longitudinal sheet shifting means for shifting a sheet stack positioned by the sheet truing means longitudinally in order to adjust the center stapling position of the stack. With this shifting means, it is possible to staple a sheet stack at the center without regard to the sheet size.

When the sheet stack P' or P'a is shifted by the lateral or longitudinal shifting means, it is clamped by the clamping means, as stated earlier. In this embodiment, the clamp holder 12, clamp member 34, hinge 33, solenoid 49, lever 50 and springs 51 and 52 constitute a specific form of clamping means. With this clamping means, it is possible to shift the sheet stack Pa or P'a while clamping it and to staple it accurately.

Figure 32:
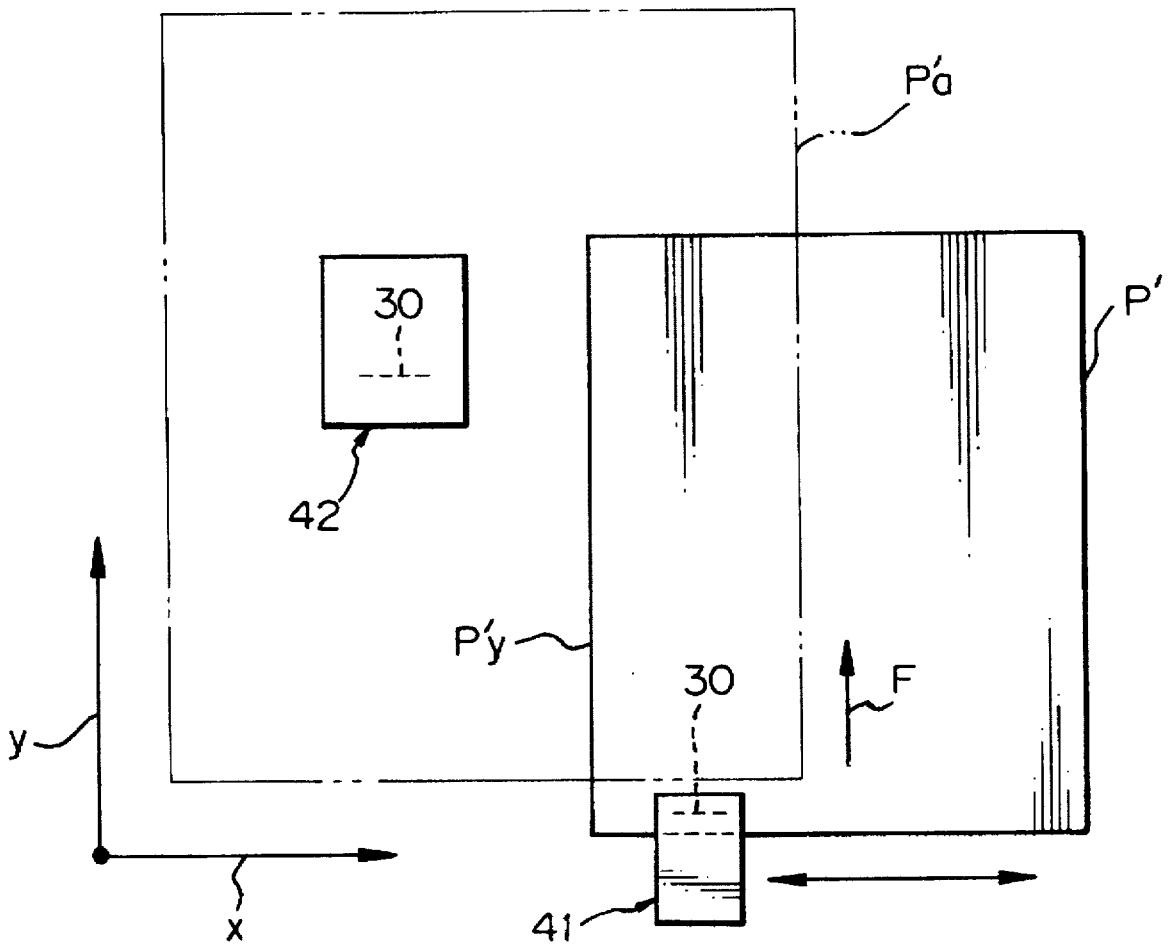
FIG. 32 shows how a stapler assigned to edge stapling and a sheet stack are moved in the event of edge stapling and center stapling.

FIG. 32 summarizes the characteristic features of the present invention. As shown, to staple the sheet stack at its edge, the unitary stapler 41 is moved in the direction perpendicular to the direction of sheet transport, i.e., along the lateral edge x of the stack. To staple the sheet stack at its center, the separate stapler 42 is used, and the stack is passed through between the stapler body and the clincher until it reaches the predetermined center stapling position. Specifically, the stapler 42 is fixed in place while the sheet stack is shifted relative to the stapler 42 in the direction x and, if necessary, in the direction y. In FIG. 32, the sheet stack P'a of relatively great size is assumed to be stapled at its center by way of example.

To effect the edge stapling and center stapling, the stapler 41 may be replaced with a conventional separate stapler. In this case, a sheet stack will be passed through between a stapler body and a clincher and shifted in the lateral direction. This, however, brings about a problem that the relation between the position of the stapler body and that of the clincher is apt to change when the separate stapler is moved in the lateral direction, resulting in defective stapling. Should the stapler be so constructed as to obviate the above occurrence, it would increase the cost of the finisher.

In the illustrative embodiment, the unitary stapler 41 for edge binding has the stapler body 41A and clincher 41C which are free from displacement relative to each other during the lateral movement. This obviates defective binding and allows the edge of a sheet stack to be accurately stapled.

Although the separate stapler 42 is assigned to center stapling, its body and clincher are fixed in place in the lateral direction. Only if a sheet stack is shifted to the predetermined center stapling position, it can be surely stapled at its center, as in the case of edge stapling.

Because the stapler 41 for edge stapling is unitary, it can be provided with the previously stated swinging means. Hence, the stapler 41 can drive a staple or staples into a sheet stack in any desired angle. This cannot be done with the conventional separate stapler.

In the illustrative embodiment, the separate stapler 42 for center stapling is located laterally outward of a sheet stack to arrive at the truing position. Specifically, assume that the sheet stack P' shown in FIG. 32 has been positioned in the direction of sheet transport and in the lateral direction perpendicular thereto. Then, the stapler 42 is located outside of the side edge P'y of the sheet stack P' parallel to the direction of sheet transport and is fixed in place.

The sheet coming out of the rollers 8 and 9 advances in a direction F shown in FIG. 32. If the stapler 42 is located in the range of the sheet stack P' to be positioned, then the sheet is apt to jam the path or be obstructed between the stapler body 42A and clincher 42B despite that the stapler 42 is separate. The embodiment is free from this problem because the stapler 42 is located outside of the side edge P'y of the sheet stack P'.

When the sheet stack clamped by the clamp member 34 is shifted from the truing position to the center stapling position, the side fence 11 may either be held stationary or be also moved in the lateral direction while pressing the side edge of the stack. This is, of course, effected by the motor 23.

4th Embodiment

Figure 33:
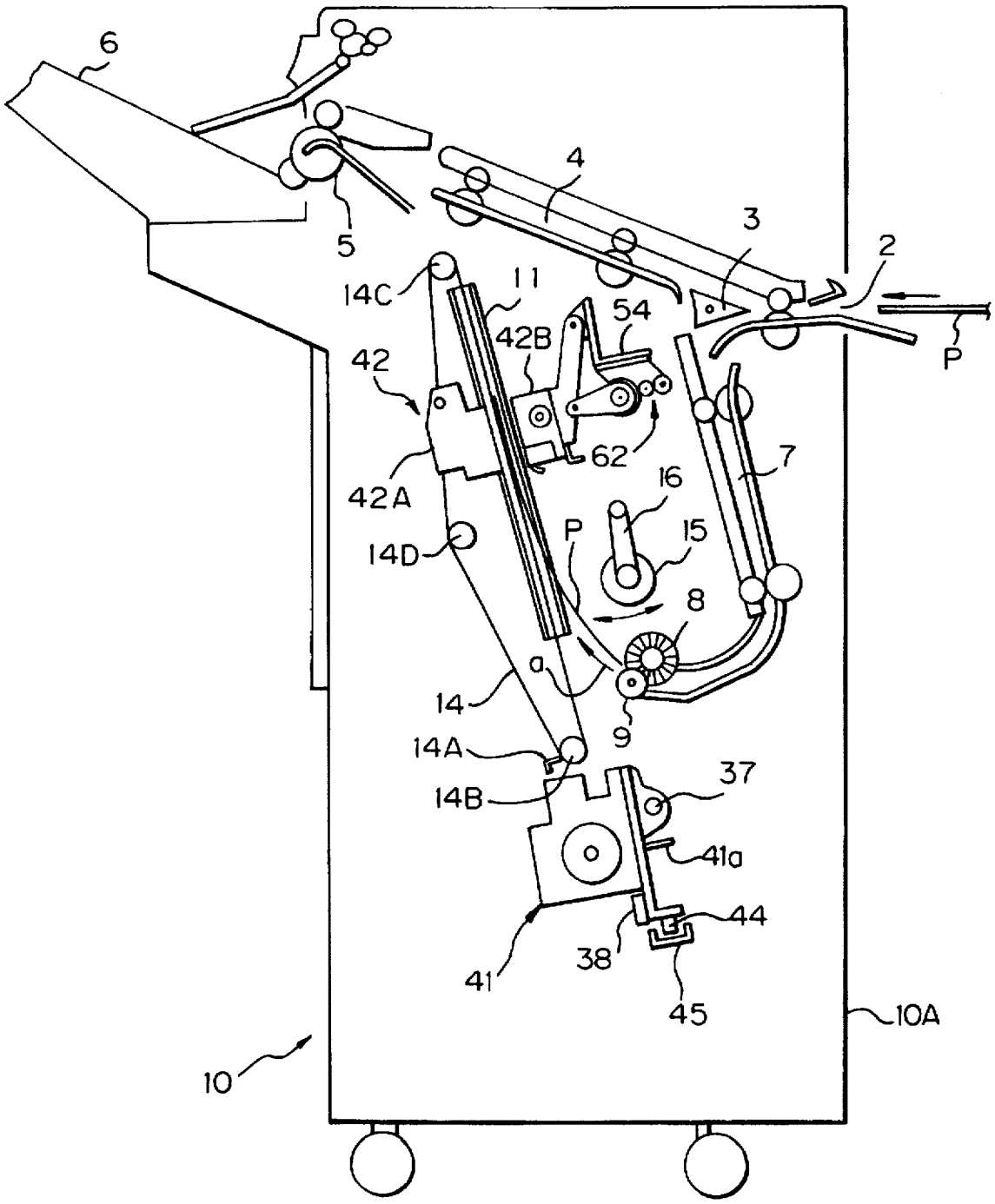
FIG. 33 is a sectional side elevation showing a fourth embodiment of the present invention.

Referring to FIG. 33, a further alternative embodiment of the present invention will be described. As shown, a finisher 10 has a body 10A formed with a sheet inlet 2. A sheet P coming out of a copier, printer, facsimile apparatus, multiplex machine or similar image forming apparatus is introduced into the finisher body 10A via the inlet 2. When the sheet P does not need stapling which will be described, it is guided by a switchable guide or path selector 3 to a transport path 4. Then, the sheet P is driven out of the finisher body 10A to a tray 6 by a discharge roller 5. On the other hand, when the sheet P needs stapling, the path selector 3 is switched to steer the sheet P to another transport path 7. When the sheet P reaches a feed roller or brush roller 8 and a roller 9 by way of the path 7, the rollers 8 and 9 cooperate to convey it toward an endless belt 14. A pair of jogger fences 11 and 12A (FIG. 34) position the sheet P in the lateral direction perpendicular to the direction of sheet transport (up-and-down direction).

An arm 16 has a pusher roller 15 at its free end and pivotally moved periodically by a driving device, not shown. On the movement of the arm 16, the pusher roller 15 pushes the sheet P driven toward the belt 14 by the rollers 8 and 9, thereby moving it toward the belt 14. The belt 14 is passed over a plurality of pulleys 14B, 14C and 14D rotatably supported by the finisher body 10A. One of the pulleys 14B–14D is a drive pulley.

The sheet P is positioned also in the direction of sheet transport (up-and-down direction), as will be described specifically later. A plurality of sheets so positioned are stapled together, as will also be described later. Subsequently, the belt 14 is rotated counterclockwise, as viewed in FIG. 24. As a result, the sheet stack is driven out to a tray 6 by the discharge roller pair 5 while being raised by a stop pawl 14A provided on the belt 14.

Figure 34:
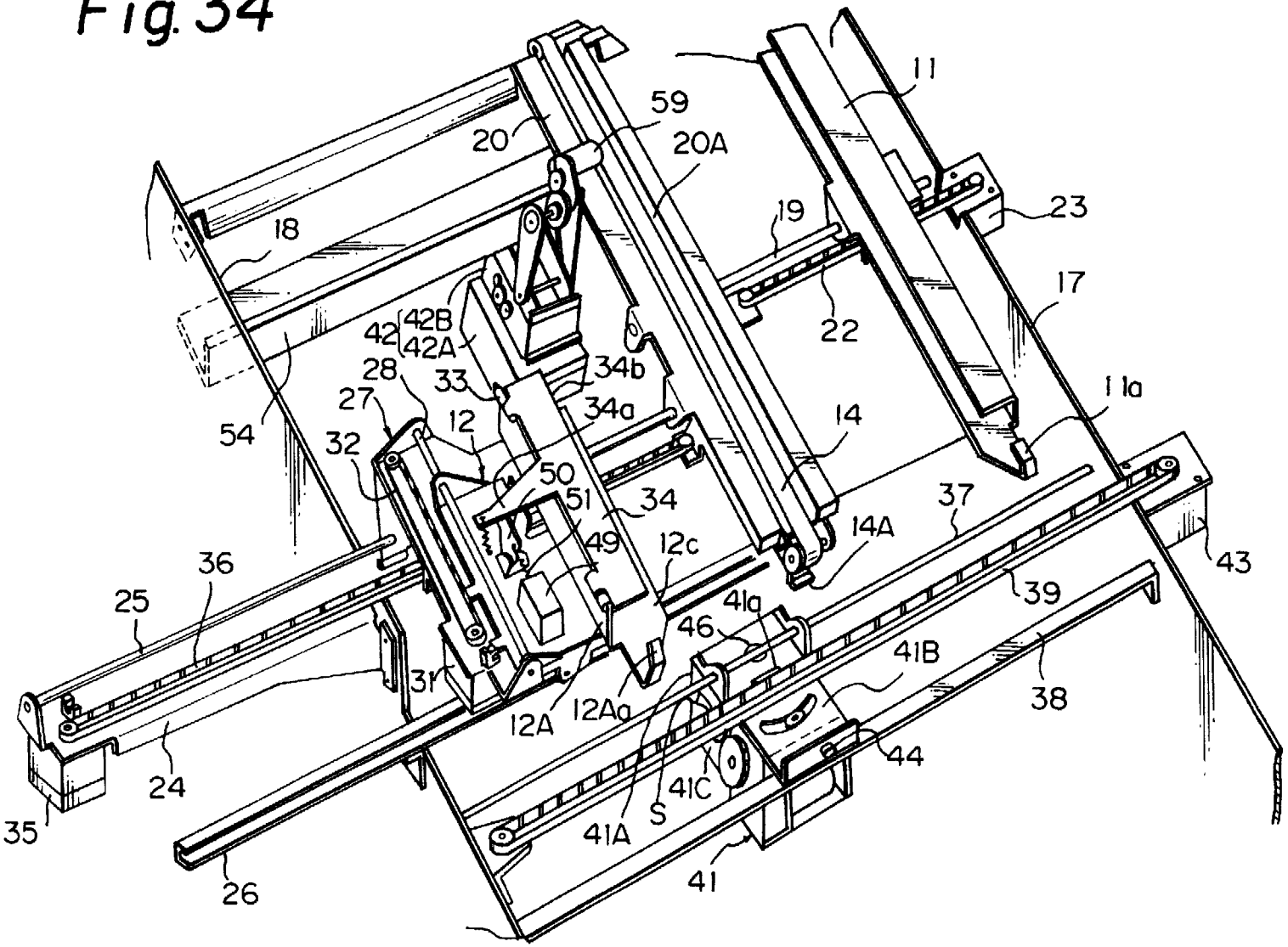
FIG. 34 is a perspective view of a sheet finishing section included in the fourth embodiment.

As shown in FIG. 34, a guide stay 20 is affixed to the finisher body 10A and extends in the direction of sheet transport. The upper run of the belt 14 is received in a longitudinal channel 20A formed in the center of the guide stay 20. A guide shaft 19 is affixed at one end to a side wall 17 and at the other end to the guide stay 20. The side fence 11 is mounted on the shaft 19 in such a manner as to be movable in the direction perpendicular to the direction of sheet transport, i.e., in the widthwise direction of the sheet. Specifically, substantially the intermediate portion of the side fence 11 is anchored to one run of a timing belt 22 passed over a pair of pulleys. A stepping motor or similar motor 23 is reversibly rotated in order to drive one of the above pulleys. As a result, the timing belt 22 is rotated to move the side fence 11 in the lateral direction perpendicular to the direction of sheet transport.

A bracket 24 is affixed to another side wall 18 facing the side wall 17. A guide shaft 25 is affixed at one end to the bracket 24 and at the other end to the guide stay 20. A holder 27 is supported by the guide shaft 25 and a guide rail 26 parallel to the guide shaft 25. The holder 27 is movable in the lateral direction.

A stepping motor or similar motor 35 is affixed to the bracket 24 and drives a timing belt 36 extending between the bracket 24 and the guide stay 20. The timing belt 36 is passed over a pair of pulleys supported by the bracket 24 and guide stay 20, i.e., finisher body 10A; one of the pulleys is driven by the motor 24. The holder 27 is anchored to one run of the timing belt 36. The motor 35 is reversibly rotated in order to move the belt 36, so that the holder 27 is moved in the lateral direction.

A guide shaft 28 is affixed to the holder 27 in the longitudinal direction. A clamp holder 12 is provided on the holder 27 and supported by the guide shaft 28 in such a manner as to be movable in the longitudinal direction. A stepping motor or similar motor 31 is mounted on the bottom of the holder 27. A timing belt 32 extends longitudinally on the holder 27 and riven by the motor 31. The timing belt 32 is passed over a pair of pulleys supported by the holder 27; one of the pulleys is driven by the motor 31.

The clamp holder 12 is anchored to one run of the timing belt 32 at its portion 21*a* (FIG. 35). When the motor 31 is rotated in the forward or reverse direction, the timing belt 32 is moved in the same direction as the motor 31, moving the clamp holder 12 in the longitudinal direction.

The side fence 12A is affixed to the clamp holder 12 or formed integrally therewith. When the clamp holder 12 moves longitudinally, the side fence 12A moves integrally with the clamp holder 12. A clamp member 34 is rotatably connected to the side fence 12A by a hinge 33. The side fences 12A and 11 facing each other are respectively formed with bent pawls 11*a* and 11A*a* at their ends.

The sheet P is conveyed by the rollers 8 and 9 (FIG. 33) toward the guide stay 20 and belt 14 which is held in a halt (FIG. 34) in a direction a. At this instant, the side fences 11 and 12A are spaced a distance slightly greater than the width of the sheet P. In this condition, the sheet P is brought to between the side fences 11 and 12A while being pushed by the roller 15.

As soon as the sheet P is brought to between the side fences 11 and 12A, a controller, not shown, outputs a motor drive signal. In response, the motor 35 (FIG. 34) and therefore the timing belt 36 starts rotating. As a result, the holder 27 moves toward the guide stay 20 together with the clamp holder 12, i.e., the side fence 12A approaches the side fence 12A. At this instant, the pawl 12A*a* of the side fence 12A is rapidly brought to below the lower edge of the sheet P. The side fence 12A moves the sheet P by pressing the side edge of the sheet P until the other side edge of the sheet P lightly abuts against the upright portion of the other side fence 11. As a result, the sheet P is positioned or trued in both the lateral direction and the longitudinal direction. Specifically, the sheet P is positioned by the pawls 11*a* and 12A*a* in the longitudinal direction and by the side fences 11 and 12A in the lateral direction. For example, the center of the sheet P in the widthwise direction is substantially aligned with the center of the belt 14.

When the next sheet comes in, the motor 35 is reversed in order to move the holder 27 slightly toward the motor 35 together with the clamp holder 12. As a result, the side fence 12A is moved away from the side fence 11. After the next sheet has been brought to between the side fences 11 and 12A, the side fence 12A is again moved toward the guide stay 20. Because the stroke over which the side fence 12A moves is, e.g., as short as about 5 mm, the sheet P existing on the pawls 11*a* and 12A*a* is prevented from slipping out of the pawls 11*a* and 12A*a* and dropping.

As stated above, the side fence 12A moves back and forth in the lateral direction for every sheet P and positions it. If desired, the other side fence 11 may also be moved in synchronism with the side fence 12A by the reversible motor 23 via the timing belt 22.

The side fences 11 and 12A at least one of which is movable in the lateral direction and the pawls 11*a* and 12A*a* constitute a specific form of sheet truing means for positioning the sheet P introduced into the finisher body 10A in the vertical direction or direction of sheet transport and the lateral direction perpendicular thereto. One or both of the side fences 11 and 12A may each be driven by the respective drive means, as desired.

As shown in FIG. 25, a guide shaft 37 and a guide stay 38 parallel to each other extend between the side walls 17 and 18. A unitary stapler 41 for edge stapling is movable on and along the guide shaft 37 and guide stay 28 in the lateral direction. In the illustrative embodiment, the stapler 41 is mounted on a bracket 41*b* which will be described. A lug 41*a* extending out from the bracket 41 is anchored to one run of a timing belt 39. The timing belt 39 is passed over a pair of pulleys mounted on the finisher body 10A. One of these pulleys is connected to a stepping motor or similar reversible motor 43. When the motor 43 is rotated, the belt 39 is moved in the lateral direction perpendicular to the longitudinal direction or direction of sheet transport.

The stapler 41 has a stapler body 41A storing staples, not shown, and a clincher 41C. When a staple is fed from the body 41A, the clincher 41C clinches it and staples sheets in cooperation with the body 41A. The body 41A and clincher 41C, like an ordinary stapler for office use, are hinged to each other at their base ends. After the edge of a stack of sheets has been inserted in a space S between the body 41A and the clincher C, a motor, not shown, included in the stapler 41 is energized. As a result, the free ends of the body 41A and clincher 41C are moved toward each other, thereby bending a staple fed form the body 41A.

Specifically, when a plurality of sheets are fully trued by the side fences 11 and 12A and their pawls 11*a* and 12A*a*, a motor drive signal is output in order to rotate the motor 43. As a result, the stapler 41 is moved toward a preselected stapling position. On the turn-off of the motor 43, the stapler 41 is brought to a stop at the stapling position and staples the sheets there. For example, as shown in FIG. 27A, the stapler 41 staples the bottom left corner of a sheet stack P' with a staple 30. In any case, the stapler 41 staples the sheet stack at one of opposite longitudinal edges thereof.

The stapler 41 may be moved laterally to another position so as to staple the sheet stack P' at the bottom right corner thereof, as shown in FIG. 27B. Further, as shown in FIG. 27C, the stapler 41 may be stopped at two spaced positions and operated at each of them so as to staple the sheet stack P' at the bottom right and bottom left corners.

The guide shaft 37, guide stay 38, bracket 41B, motor 43 and timing belt 39 driven by the motor 43 constitute a specific form of unitary stapler drive means for moving the unitary stapler 41 for edge stapling in the lateral direction relative to a sheet stack and positioning it at a desired position or positions.

In FIG. 34, the bracket 41B supporting the stapler 41 is supported by the guide shaft 37 and guide stay 38 in such a manner as to be movable in the lateral direction. FIGS. 28 and 33 show an alternative arrangement in which a roller 44 is mounted on the bent end of the bracket 41B. The roller 44 is rollably received in a guide rail 45 affixed to the finisher body 10A. This also allows the bracket 41B and therefore the stapler 41 to move in the lateral direction.

The stapler 41 is capable of driving the staple 30 into the sheets in an inclined position, as needed. The stapler 41 is supported by the bracket 41B via a shaft 46 and rotatable about the axis of the shaft 46. A drive mechanism, not shown, is arranged in the stapler body 41A in order to move the stapler 41 to a desired angular position. As shown in FIG. 28, a guide roller 48 is mounted on the body 41A while an arcuate guide hole $41B_1$ is formed in the bracket 41B. When the stapler 41 is rotated about the shaft 46, the body 41B is guided by the guide roller 48 and the guide hole $41B_1$.

Assume that the sheet stack P' is positioned, as shown in FIG. 29. Then, the stapler 41 may be brought to a position A, rotated by the drive mechanism to an inclined position shown in FIG. 28, and then operated. In this case, the staple 30 will be driven into the sheet stack P' at the position A. Likewise, the stapler 41 may be moved to a position B, rotated in the direction opposite to the above direction, and then operated so as to driven the staple 30 into the sheet stack P' at the position B. In this manner, the stapler 41 is capable of stapling the sheet tack P' in an inclined position at either one of the left and right corners of the stack P'.

As stated above, the unitary stapler 41 is implemented as a swingable stapler capable of stapling the sheet stack P' in the horizontal position shown in FIGS. 27A–27C or in the inclined position shown in FIG. 29. The bracket 41B, shaft 46, drive mechanism arranged in the stapler body 41A, guide roller 48 and guide hole $41B_1$ constitute a specific form of stapler swinging means for adjusting the position of the stapler 41 relative to the positioned sheet stack P'. With this swinging means, it is possible to driven the staple 30 into the sheet stack P' in any desired angle.

After the stapler 41 has stapled the edge of the sheet stack P' either horizontally or obliquely, the controller outputs a drive signal for driving a motor, not shown, for driving the belt 14. As a result, the belt 14 starts moving counterclockwise, as viewed in FIG. 33, causing the stop 14A to raise the sheet stack P'. Consequently, the sheet stack P' is conveyed by the discharge roller 5 onto the tray 6.

Further, the illustrative embodiment is capable of stapling a sheet stack at the center, as follows. As shown in FIG. 34, a separate stapler 42 is used to staple a sheet stack positioned by the sheet truing means at substantially the center thereof in the longitudinal direction. The stapler 42 has a stapler body 42A storing staples, not shown, and a clincher 42B disposed above the stapler body 42A. The clincher 42B bends a staple fed from the body 42A in cooperation with the body 42A for thereby binding a sheet stack. The body 42A and clincher 42B are separate from each other, so that a sheet stack can be passed through therebetween.

The separate stapler 42 for center stapling is positioned such that the positions where the body 42A and clincher 42B cooperate to drive a staple into a sheet stack sandwich the sheet brought the truing position in the longitudinal and lateral directions. The body 42A and clincher 42B are supported by the finisher body in such a manner as to be movable toward and away from each other. Although the body 42A and clincher 42B slightly move relative to each other in the event of stapling, they do not move in the direction parallel to the sheet brought to or being brought to the truing position.

The sheets sequentially brought to the truing position enter the space between the body 42A and the clincher 42B of the stapler 42. Each sheet is positioned in the lateral direction by the side fences 11 and 12A at least one of which is movable, and positioned in the longitudinal direction by the pawls **11*a* and 12A*a***.

After a sheet stack to be stapled at its center has been positioned in the lateral direction by one or both of the side fences 11 and in the longitudinal direction by the pawls **11*a* and 12A*a*, the controller outputs a solenoid ON signal. In response, the solenoid 49 affixed to the clamp holder 12 is energized and pulls a spring 51 loaded between the solenoid 49 and the lever 50. As a result, the lever 50 is rotated about the shaft 53 in a direction for raising the lug 34*a* of the clamp member 34. This causes the clamp member 34 to rotate about the hinge 33 such that its side edge 34*b* moves downward, against the action of the spring 52 loaded between the end of the lug 34*a* and the clamp holder 12. Consequently, the clamp member 34 clamps the side edge of the sheet stack in cooperation with the flat body portion 12*c* included in the side fence 12A**.

Figure 36:
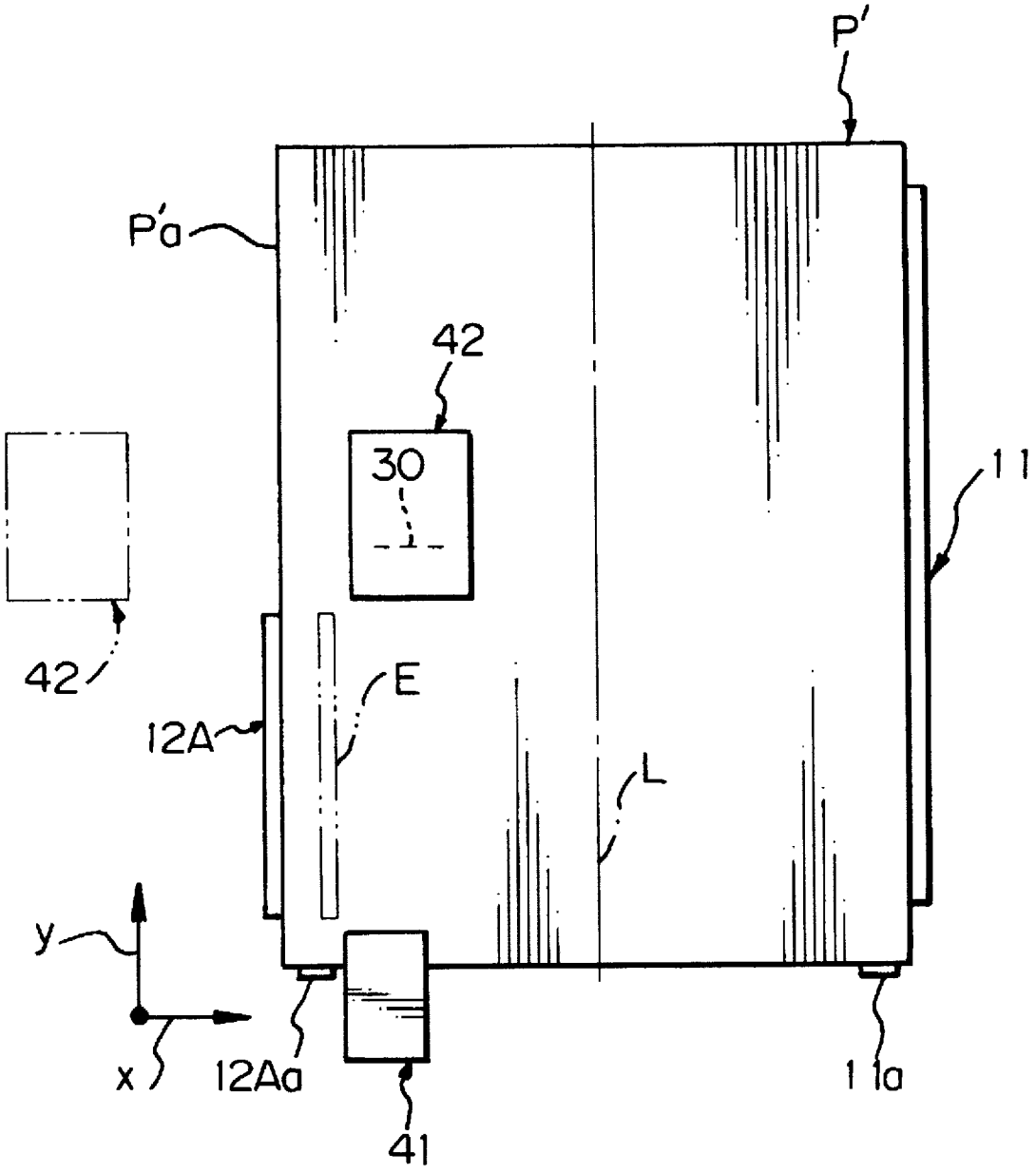
FIG. 36 shows how a stapler assigned to edge stapling and a stapler assigned to center stapling are moved.

FIG. 35 shows a sheet stack P' having its side edge clamped by the clamp member 34. FIG. 36 shows the sheet stack P' positioned and then clamped in the same manner. As shown, the sheet stack P' is positioned in the lateral direction by the upright portions of the side fences 11 and 12A, positioned in the longitudinal direction by the pawls **11*a* and 12A*a*, and clamped by the clamp member 34 at its portion E adjoining the side edge P'a. In this condition, the sheet stack P' is trued between the stapler body 42A and the clincher 42B**, as stated earlier.

The separate stapler 42 for center stapling is fixed in place in the direction parallel to the sheet stack, as indicated by a solid line in FIG. 36. After the sheet stack P' has been trued and then clamped, the controller outputs a staple signal. In response, the stapler 42 is operated in the previously described manner and staples the sheet stack P' at the portion C, as shown in FIG. 30. Specifically, the sheet stack P' is stapled at one side of its center in the direction of sheet transport or longitudinal direction. The clamp member 34 continuously clamps the sheet stack throughout the stapling operation.

After the sheet stack P' has been stapled at its one side, the controller outputs a motor drive signal for energizing the motor 35. In response, the motor 35 and therefore the belt 36 is rotated with the result that the holder 27 moves toward the motor 35 together with the clamp holder 12, as shown in FIG. 34. In this manner, the sheet stack P' clamped by the clamp member 34 is shifted laterally from the above center stapling position (truing position) to the next center stapling position. At this instant, the side fence 11 may either be held stationary or be moved to the left, as viewed in FIG. 34, in synchronism with the side fence 12A. The lateral movement of the side fence 11 is effected by the motor 23 via the timing belt 22.

FIG. 35 shows the sheet stack P' shifted to the center stapling position. When the sheet stack P' is brought to this position, the motor 35 is deenergized in order to locate the stack P' there. That is, the point D of the sheet stack P' is brought to the stapler 42, as indicated by a solid line in FIG. 36. Subsequently, the stapler 42 is again operated by a staple signal received from the controller. As a result, the sheet stack P' is stapled at its position D, as shown in FIG. 30. As a result, the sheet stack P' is stapled at two spaced points by the staples 30.

After the stapler 42 has stapled the sheet stack P' at the center, the stepping motor 35 is reversed to return the holder 27 to the original position, e.g., position shown in FIG. 34 together with the clamp holder 12, thereby returning the stack P' to the truing position. At the same time, the solenoid 49 is deenergized with the result that 50 is rotated to the position shown in FIG. 34. The clamp member 34 is pulled by the spring 52 to the position shown in FIG. 34.

Subsequently, a motor, not shown, for driving the belt 14 starts rotating in response to a motor drive signal received from the controller. As a result, the belt 14 starts rotating while causing its stop pawl 14A raising the sheet stack P' toward the outlet roller 5.

The bracket 24, guide shaft 25, guide rail 26, motor 35, timing belt 36, holder 27 and clamp holder 12 constitute a specific form of lateral sheet shifting means for shifting a sheet stack positioned by the sheet truing means laterally from the truing position to the center stapling position where the separate stapler 42 is located.

As shown in FIGS. 30 and 36 specifically, with the lateral sheet shifting means described above, it is possible to staple the sheet stack at a plurality of spaced points at the center in the longitudinal direction with a single stapler 42. If the sheet stack positioned by the truing means is stapled for the first time without being shifted in the lateral direction, as stated above, then the stapling time will be reduced.

The sheet stack P' shown in FIG. 36 is positioned such that its center line L, for example, substantially aligns with the center of the belt 14. In addition, the sheet stack P' is positioned by the pawls 11*a* and 12A*a* in the longitudinal direction. In this condition, if the stapler 42 staples the sheet stack P' at one side immediately, then the stack P' should only be moved from truing position in the lateral direction only (n−1) times where n is the number of stapling points ($n \geqq 2$). If the stapler 42 is located from the beginning at a position where it can staple the center of sheets of ordinary size, as indicated by a solid line in FIG. 36, then it can staple the sheets at two spaced points if the sheets are shifted only once.

A sheet stack of different size in the lateral direction will be stapled at a plurality of points at the center in the above direction, as follows. After the sheet stack has been located at the truing position, it is shifted laterally by the lateral sheet shifting means until the first stapling point reaches the separate stapler 42, as indicated by a solid line. Then, the stapler 42 drives a staple into the first point of the sheet stack. Subsequently, the sheet stack is again shifted in the lateral direction in order to drive another staple into the second point of the stack. Such a procedure is repeated until a desired number of staples have been driven into the sheet stack. Thereafter, the sheet stack is returned to its original position and then unclamped to be driven out to the tray 6.

The lateral sheet shifting means is omissible. For example, a plurality of separate staplers 42 shown in FIG. 36 may be arranged at spaced locations in the lateral direction of the sheet stack P', or a single stapler 42 may be located on the center line L. This kind of scheme also allows the sheet stack P' to be stapled without being shifted in the lateral direction.

It will be seen from the above that a sheet stack may be stapled at its center at a single point or at a plurality of points, as desired.

Figure 37:
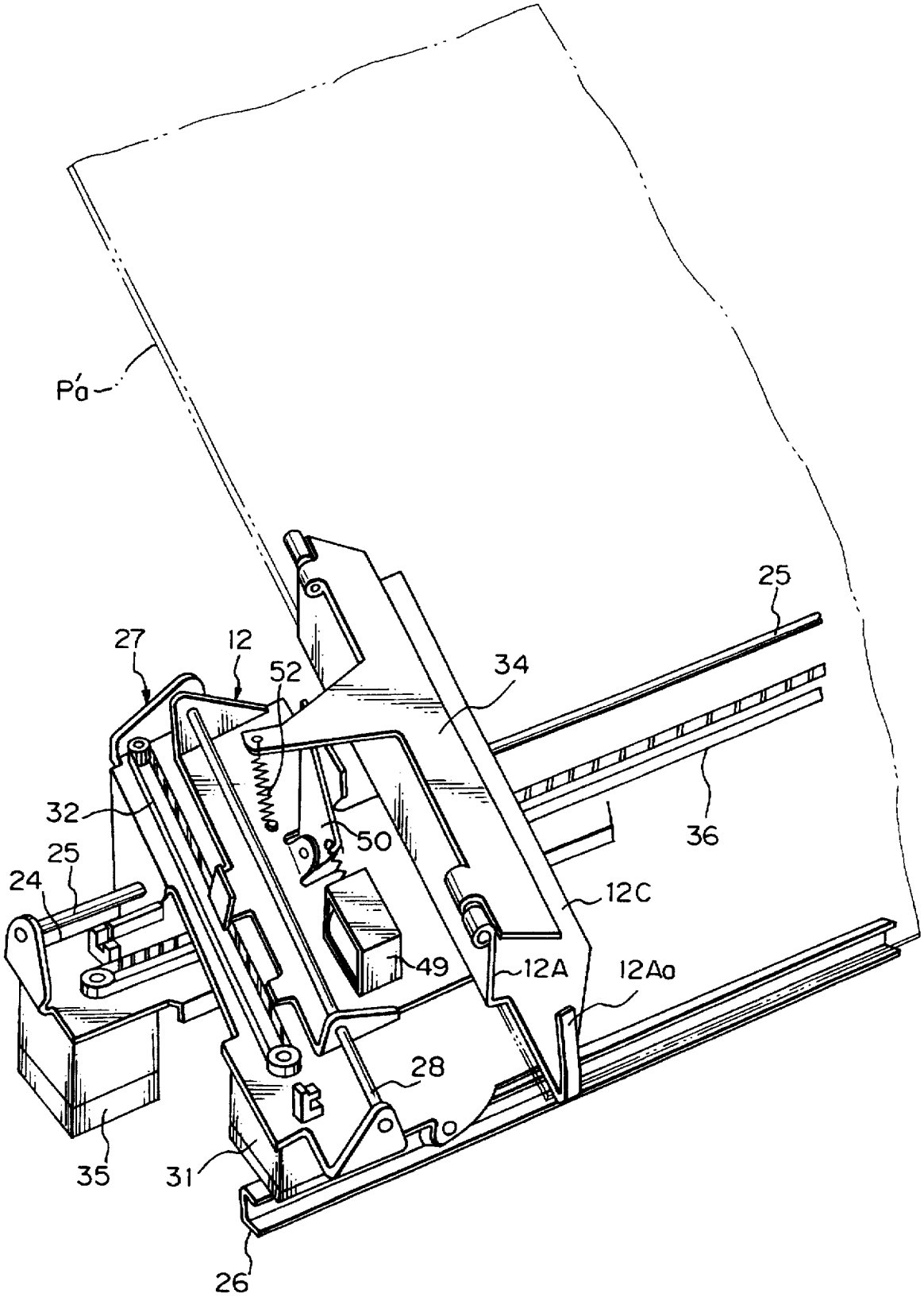
FIG. 37 is a perspective view showing a sheet stack of relatively great size held at a center stapling position, and demonstrating the operation of longitudinal sheet shifting means.

When sheets to be stapled together have a size greater than the sheet stack P' of FIG. 35 in the longitudinal direction, they are shifted by the following procedure. FIG. 37 shows a sheet stack P'a greater in size than the sheet stack P' specifically. After the sheet stack P'a has been positioned by the sheet truing means in the longitudinal and lateral directions, the solenoid 49 is energized to rotate the lever 50. Further, the clamp member 34 is rotated to clamp the side edge of the sheet stack P'a.

Subsequently, the stepping motor 31 and therefore the timing belt 32 starts rotating. The belt 32 moves the clamp holder 12 from the position shown in FIG. 35 to the position shown in FIG. 37. At this instant, the clamp holder 12 is guided by the shaft 28. In this manner, the sheet stack P'a is moved such that its center in the longitudinal direction aligns with the separate stapler 42, while being clamped by the clamp member 34.

After the sheet stack P'a has been positioned in the longitudinal direction by the above procedure, the stepping motor 35 starts rotating and shifts the sheet stack P'a in the lateral direction. Specifically, the sheet stack P'a is shifted such that its point C (FIG. 30) aligns with the stapler 42. After the sheet stack P'a has been located at the stapling position, the stapler 42 drives a staple into the sheet stack P'a. The motor 35 again starts rotating in order to locate the point D (FIG. 30) of the sheet stack P'a at the stapling position. Then, the stapler 42 drives another staple into the sheet stack P'a. This is demonstrated in FIG. 37. Again, the stapler 42, may, of course, drive only one staple or three or more staples into the sheet stack P'a, as desired. In this manner, the center stapling position for the sheet stack P'a is adjustable in matching relation to the longitudinal size of the stack P'a.

After the stapling operation, the motor 35 shown in FIG. 37 is reversed to return the holder 27 from the position of FIG. 37 to the position of FIG. 34. Further, the stepping motor 31 is reversed to return the clamp holder 123 from the position of FIG. 37 to the position of FIG. 35. Then, the solenoid 49 is deenergized to return the clamp member 34 to the position shown in FIG. 34. Thereafter, the belt 14 is rotated to discharge the stapled sheet stack P'a to the tray 6 via the discharge roller 5.

The motor 5, timing belt 32, clamp holder 12 and guide shaft 28 constitute a specific form of longitudinal sheet shifting means for shifting a sheet stack positioned by the sheet truing means longitudinally in order to adjust the center stapling position of the stack. With this shifting means, it is possible to staple a sheet stack at the center without regard to the sheet size.

When the sheet stack P' or P'a is shifted by the lateral or longitudinal shifting means, it is clamped by the clamping means, as stated earlier. In this embodiment, the clamp holder 12, clamp member 34, hinge 33, solenoid 49, lever 50 and springs 51 and 52 constitute a specific form of clamping means. With this clamping means, it is possible to shift the sheet stack Pa or P'a while clamping it and to staple it accurately.

FIG. 36 summarizes the characteristic features of the present invention. As shown, to staple the sheet stack at its edge, the unitary stapler 41 is moved in the direction perpendicular to the direction of sheet transport, i.e., along the lateral edge x of the stack. To staple the sheet stack at its center, the separate stapler 42 is used, and the stack to be brought to the truing position is passed through between the stapler body and the clincher. Then, the sheet stack is shifted in one or both of the longitudinal and lateral directions, as needed.

To effect the edge stapling and center stapling, the stapler 41 may be replaced with a conventional separate stapler. In this case, a sheet stack will be passed through between a stapler body and a clincher and shifted in the lateral direction. This, however, brings about a problem that the relation between the position of the stapler body and that of the clincher is apt to change when the separate stapler is moved in the lateral direction, resulting in defective stapling. Should the stapler be so constructed as to obviate the above occurrence, it would increase the cost of the finisher.

In the illustrative embodiment, the unitary stapler 41 for edge binding has the stapler body 41A and clincher 41C which are free from displacement relative to each other during the lateral movement. This obviates defective binding and allows the edge of a sheet stack to be accurately stapled.

Although the separate stapler 42 is assigned to center stapling, its body and clincher are fixed in place in the lateral direction. Only if a sheet stack is shifted to the predetermined center stapling position, it can be surely stapled at its center, as in the case of edge stapling.

Because the stapler 41 for edge stapling is unitary, it can be provided with the previously stated swinging means. Hence, the stapler 41 can drive a staple or staples into a sheet stack in any desired angle. This cannot be done with the conventional separate stapler.

In the illustrative embodiment, the portion of the stapler body 42A for feeding staples and the portion of the clincher 42A for clinching the staples are so positioned as to hold sheets sequentially brought to the truing position therebetween. With this arrangement, it is possible to achieve advantages which will be described. However, it is likely that the sheets entering the truing position jam the space between the body 42A and the clincher 42B. In light of this, the embodiment further includes separate stapler drive means for spacing the body 42A and clincher 42B more when they are held in their stand-by positions for stapling than when sheets are sequentially brought to the truing position. The construction and operation of the separate stapler drive means will be described hereinafter.

Figure 38:
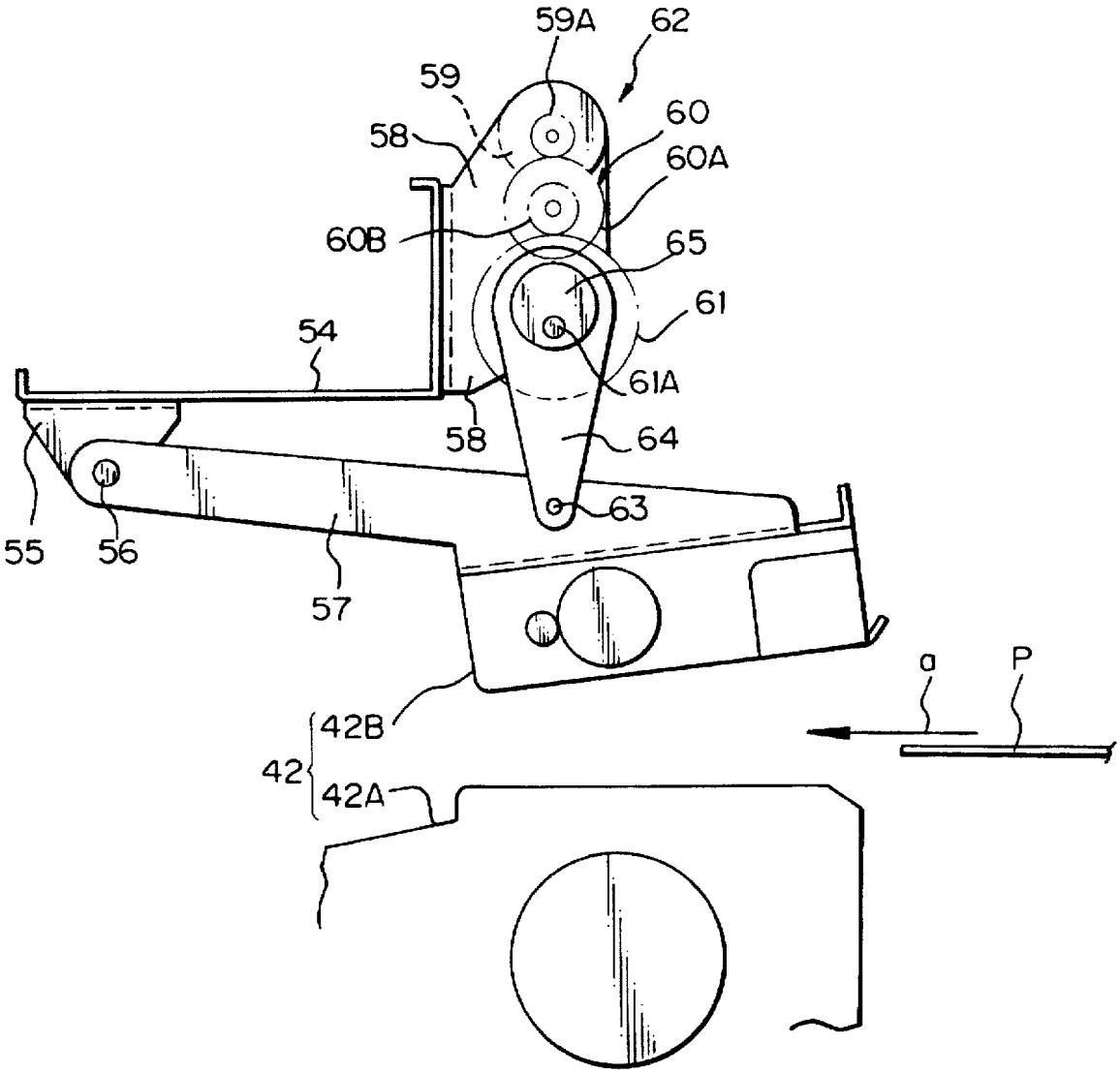
FIG. 38 is a side elevation showing a specific configuration of a mechanism for moving a clincher of a separate stapler up and down.
Figure 39:
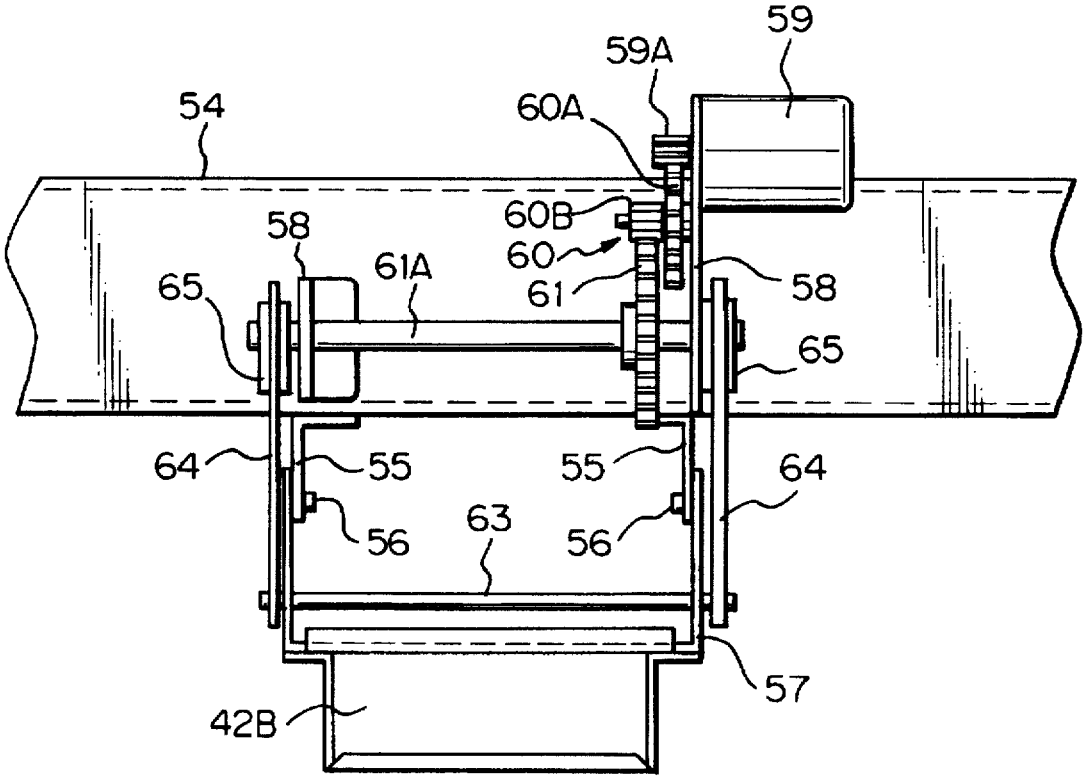
FIG. 39 shows the mechanism of FIG. 38 in a view as seen from a sheet inlet side.
Figure 40:
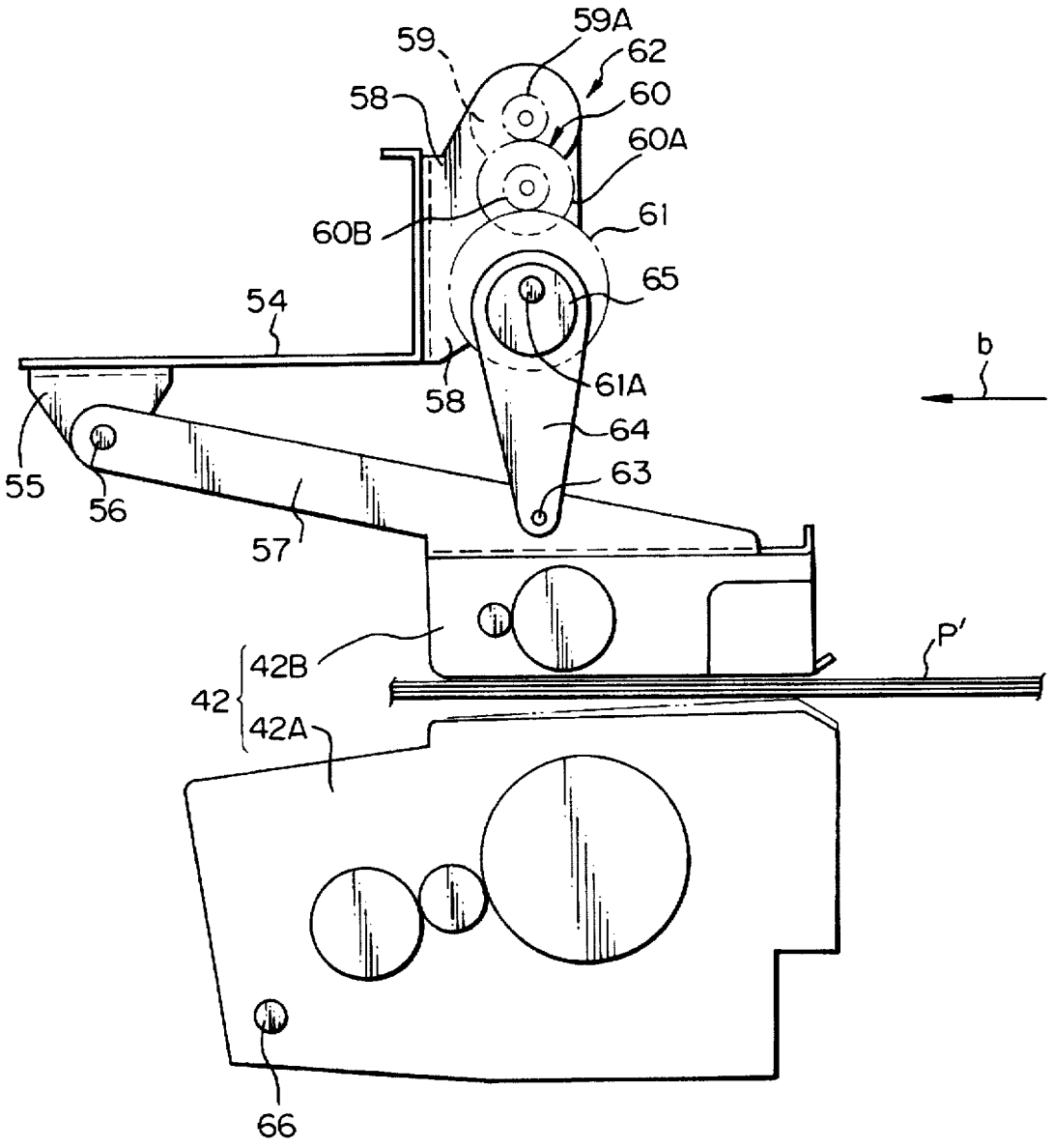
FIG. 40 shows the clincher brought to a stand-by position adjoining a stapler body.

In the stapler 42 shown in FIG. 33, the clincher 42B is movable away from the body 24A. As shown in FIG. 34, a stay 54 having an L-shaped section is affixed to the side wall 18 and guide stay 20 at opposite ends thereof. As shown in FIGS. 38 and 39, a pair of spaced brackets 55 are affixed to the stay 54. A clincher holder 57 is supported by the brackets 55 via pivot shafts 56 while the clincher 42B is affixed to the clincher holder 57. A drive mechanism 62 is mounted on one end of the brackets 58 and consists of a motor 59, a two-step gear 60, and a gear 61. The gear 61 has a center shaft 61A freely rotatably supported by the brackets 58. Eccentric rollers 65 are mounted on opposite ends of the center shaft 61A. Rods 64 are each rotatably supported by the clincher holder 57 via a respective pin 63. The eccentric rollers 65 are respectively engaged with the rods 64. As shown in FIG. 40, the body 42A is pivotably connected to the finisher body by a shaft 66.

In FIGS. 33 and 36, the sheet P introduced into the finisher body is routed through the path 7 and rollers 8 and 9 and delivered in the direction a. As shown in FIG. 38, the sheet P enters the broad space between the body 42A mounted on the finisher body and the clincher 42B greatly spaced from the body 42A. The clincher 42B is held in the greatly spaced position, i.e., the position shown in FIG. 38 until all the sheets have been trued.

After the sheets have been trued, they are clamped by the clamping means. Then, a stepping motor or similar motor 59 (FIG. 38) starts rotating in response to a motor drive signal received from the controller. As a result, a large diameter gear 60A included in the two-step gear 60 and meshing with a drive pinion 59A of the motor 59 is rotated. The gear 60A causes a gear 61 meshing with a small diameter gear 60B to rotate.

The gear 61 causes the eccentric rollers 65 coaxial therewith to rotate with the result that the rod 64 is lowered from the position shown in FIG. 38 to the position shown in FIG. 40. Consequently, the clincher holder 57 is rotated about the shaft 56 from the position of FIG. 38 to the position of FIG. 40. Then, the motor 59 is deenergized in order to hold the clincher 42B at a position close to the body, i.e., a stand-by position, as shown in FIG. 40. In this condition, the stapler 42 drives a staple into the sheet stack P', as stated earlier.

Specifically, after the deenergization of the motor 59, the controller outputs a staple signal. In response, the stapler drive means, not shown, causes the body 42A to rotate about the shaft 66 to the position indicated by a phantom line in FIG. 40. At this position, the stapler 42 drives a staple into one point of the positioned and clamped sheet stack P' at the center in the longitudinal direction. After the sheet has been shifted in the lateral direction, the stapler 42 drives another staple into another point of the sheet stack P'. Thereafter, the sheet stack P' is returned to its original position laterally by the lateral sheet shifting means and then unclamped.

Subsequently, the motor 59 again starts rotating in response to a motor driven signal received from the controller, so that the clincher 42B is returned to the position greatly spaced from the body 42A. Then, the stapled sheet stack P' is driven out to the tray (FIG. 33). FIG. 39 is a view as seen in a direction b shown in FIG. 40, showing the mechanism for moving the clincher 42B up and down.

The separate stapler drive means described above surely prevents the sheets sequentially brought to the truing position from jamming the path.

As shown in FIGS. 36 and 40, the stapling portions of the stapler body 42A and clincher 42B are so located as to hold the papers conveyed to the truing position therebetween, as stated previously. Specifically, the stapler 42 is located in the range to which the sheets will be located, and is unmovable in the direction perpendicular to the sheets. Even if the stapler 42 is located outside of the side edge P'a of the sheet stack P', as indicated by a phantom line, it can staple the stack P' at its center. However, such a position of the stapler 42 is not desirable in that the sheet stack P' must be shifted in great amounts, particularly in the lateral direction.

In the illustrative embodiment, the stapler 42 is located in the range to which the sheets will be located. This successfully reduces the amounts of shift of the sheet stack, even to zero. If the stapler 42 is positioned such that the first stapling point of the sheet stack aligns with the stapler 42 (solid line) from the beginning, as stated earlier, then the stack should only be shifted laterally until the next stapling point aligns with the stapler 42.

In summary, the above embodiment has various advantages as enumerated below.

(1) A plurality of sheets can be surely stapled either at their edge or at their center, as desired. In the event of center stapling, the sheets should only be shifted in a small amount which may even be zero.

(2) The sheets sequentially conveyed to a positioning position are prevented from jamming a path between a stapler body and a clincher constituting a separate stapler. The sheets can therefore be surely positioned at the truing position.

(3) The sheets can be stapled at a plurality of points of their center even if the number of separate staplers is reduced.

(4) The sheets can be accurately stapled at their center without regard to the sheet size in the longitudinal direction.

(5) The sheets can be shifted in an accurately positioned state and surely stapled at their center.

(6) The sheet scan be stapled at its edge either horizontally or obliquely, as desired.

Various modifications will become possible for those skilled in the art after receiving the teachings of the present disclosure without departing from the scope thereof.

What is claimed is:

1. A sheet finisher for finishing at least one sheet introduced into a body thereof and conveyed within said body, said sheet finisher comprising:

sheet truing means for positioning the sheet at a truing position in an intended direction of sheet transport and a direction perpendicular thereto;

a clamp member for clamping the sheet positioned by said sheet truing means at said truing position;

finishing means for finishing the sheet at a position difference from said truing position;

clamp member drive means for shifting the sheet away from said truing position until a part of said sheet arrives at said finishing means, and for positioning said sheet such that a position of said sheet relative to said finishing means is variable in a direction in which said sheet is shifted; and positioning means for moving said finishing means in a direction perpendicular to said direction in which said sheet is shifted, and positioning said finishing means at a desired position in said direction in which said finishing means is moved.

2. A sheet finisher for finishing a plurality of sheets sequentially introduced into a body thereof and conveyed within said body, said sheet finisher comprising:

sheet truing means for positioning the sheets at a truing position in a longitudinal direction in which said sheets are transported and a lateral direction perpendicular to said longitudinal direction;

a separate stapler comprising a stapler body and a clincher separate from and facing each other, wherein a portion of said stapler body and a portion of said clincher for stapling the sheets hold said sheets brought to said truing position therebetween for stapling said sheets at substantially a center of said sheets in said longitudinal direction;

a unitary stapler comprising a stapler body and a clincher operatively connected to each other, and for stapling the sheets positioned by said sheet truing means at one edge of said sheets in said longitudinal direction; and unitary stapler drive means for moving said unitary stapler in said lateral direction relative to the sheets, and positioning said unitary stapler at a desired position.

3. A sheet finisher as claimed in claim 2, further comprising separate stapler drive means for operating said separate stapler such that said stapler body and said clincher thereof are spaced more when the sheets are sequentially brought to said truing position than when said separate stapler is located in a stand-by position for stapling.

4. A sheet finisher as claimed in claim 2, further comprising lateral sheet shifting means for shifting the sheets positioned by said sheet truing means laterally from said positioning position to a center stapling position where said separate stapler drives a staple into the center of said sheets.

5. A sheet finisher as claimed in claim 2, further comprising longitudinal sheet shifting means for shifting the sheets positioned by said sheet truing means in said longitudinal direction for thereby adjusting a point of the center of the sheets to be stapled.

6. A sheet finisher as claimed in claim 5, further comprising clamping means for clamping the sheets positioned by said sheet truing means when said sheets are shifted.

7. A sheet finisher as claimed in claim 2, further comprising staple swinging means for adjusting a position of said unitary stapler relative to the sheets positioned by said sheet truing means, such that a position of a staple to be driven into said sheets by said unitary stapler is adjustable.

* * * * *

UNITED STATES PATENT AND TRADEMARK OFFICE

CERTIFICATE OF CORRECTION

PATENT NO. : 5,709,376

DATED : January 20, 1998

INVENTOR(S) : Yoshiaki USHIROGATA

It is certified that error appears in the above-identified patent and that said Letters Patent is hereby corrected as shown below:

On the title page, item [30], Foreign Application Priority Data should be:

--[30] Foreign Application Priority Data

| | | | | |
|---|---|---|---|---|
| Jan. 30, 1996 | [JP] | Japan | ..... | 8-035583 |
| Jun. 1, 1995 | [JP] | Japan | ..... | 7-158393 |
| Jun. 13, 1995 | [JP] | Japan | ..... | 7-170162 |
| Jun. 13, 1995 | [JP] | Japan | ..... | 7-170163 |
| Feb. 29, 1996 | [JP] | Japan | ..... | 8-69118 |
| Mar. 4, 1996 | [JP] | Japan | ..... | 8-073274-- |

Signed and Sealed this

Thirty-first Day of March, 1998

*Attest:*

Bruce Lehman

BRUCE LEHMAN

*Attesting Officer*

*Commissioner of Patents and Trademarks*